US006346773B1

(12) United States Patent
Takegami

(10) Patent No.: US 6,346,773 B1
(45) Date of Patent: Feb. 12, 2002

(54) METHOD OF MANUFACTURING AN ELECTRON SOURCE AND AN IMAGE-FORMING APPARATUS, AND APPARATUS FOR MANUFACTURING THE SAME

(75) Inventor: Tsuyoshi Takegami, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/505,142

(22) Filed: Feb. 15, 2000

(30) Foreign Application Priority Data

| | | |
|---|---|---|
| Feb. 24, 1999 | (JP) | 11-047072 |
| Feb. 24, 1999 | (JP) | 11-047073 |
| Feb. 26, 1999 | (JP) | 11-049372 |
| Feb. 14, 2000 | (JP) | 2000-034852 |

(51) Int. Cl.[7] ..... G09G 3/10

(52) U.S. Cl. ..... 315/169.1; 313/310; 345/211; 445/51

(58) Field of Search ..... 315/169.1, 169.3; 313/310, 495; 345/74.1, 210, 211, 212; 445/46, 50, 51; 257/48; 438/14, 17

(56) References Cited

U.S. PATENT DOCUMENTS

| | | | | |
|---|---|---|---|---|
| 5,066,883 A | | 11/1991 | Yoshioka et al. | 313/309 |
| 5,593,335 A | * | 1/1997 | Suzuki et al. | 445/50 |
| 5,861,227 A | * | 1/1999 | Ikeda et al. | 313/309 |
| 5,952,775 A | * | 9/1999 | Sato et al. | 313/495 |
| 6,114,804 A | * | 9/2000 | Kawase et al. | 313/495 |
| 6,144,154 A | * | 11/2000 | Yamazaki et al. | 315/169.3 |
| 6,147,449 A | * | 11/2000 | Iwasaki et al. | 313/310 |
| 6,184,610 B1 | * | 2/2001 | Shibata et al. | 313/310 |
| 6,184,619 B1 | * | 2/2001 | Yamazaki et al. | 313/495 |

FOREIGN PATENT DOCUMENTS

| | | |
|---|---|---|
| JP | 64-31332 | 2/1989 |
| JP | 2-257551 | 10/1990 |

OTHER PUBLICATIONS

C. A. Spindt et al., "Physical Properties of Thin–film Field Emission Cathodes with Molybdenum Cones", J. Applied Physics, vol. 47, No. 12, Dec. 1976, pp. 5248–5263.

C. A. Mead, "Operation of Tunnel–Emission Devices," J. Applied Physics, vol. 32, No. 4, Apr. 1961, pp. 646–652.

W. P. Dyke et al., "Field Emission", Advances in Electronics and Electron Physics, 1956, pp. 89–185.

M. Elinson et al. "The Emission of Hot Electrons and the Field Emissions of Electrons From Tin Oxide", Radio Engineering and Electronic Physics, Jul. 1965, pp. 1290–1296.

G. Dittmer, "Electrical Conduction and Electron Emission of Discontinuous Thin Films", Thin Solid Films, 9, 1972 pp. 317–328.

M. Hartwell et al., "Strong Electron Emission From Patterned Tin–Indium Oxide Films", IEDM, 1975, pp. 519–521.

H. Araki, et al., "Electroforming and Electron Emission of Carbon Thin Films", Journal of the Vacuum Soc. of Japan, vol. 2–6, No. 1, 1983, pp. 22–29 (with English Abstract on p. 22).

* cited by examiner

*Primary Examiner*—Don Wong
*Assistant Examiner*—Thuy Vinh Tran
(74) *Attorney, Agent, or Firm*—Fitzpatrick, Cella, Harper & Scinto

(57) ABSTRACT

To suppress occurrence of abnormal voltage in the energization process. The present invention provides a method of manufacturing an electron source comprising an electron-emitting device comprising a pair of electroconductive members, and first wires and second wires being connected to the pair of electroconductive members, respectively, the method comprising the step of applying a pulse voltage to the pair of electroconductive members via the first and/or second wires, wherein the pulse voltage is a pulse where a specific frequency band included in a pulse voltage outputted from a pulse power supply is restricted.

29 Claims, 53 Drawing Sheets

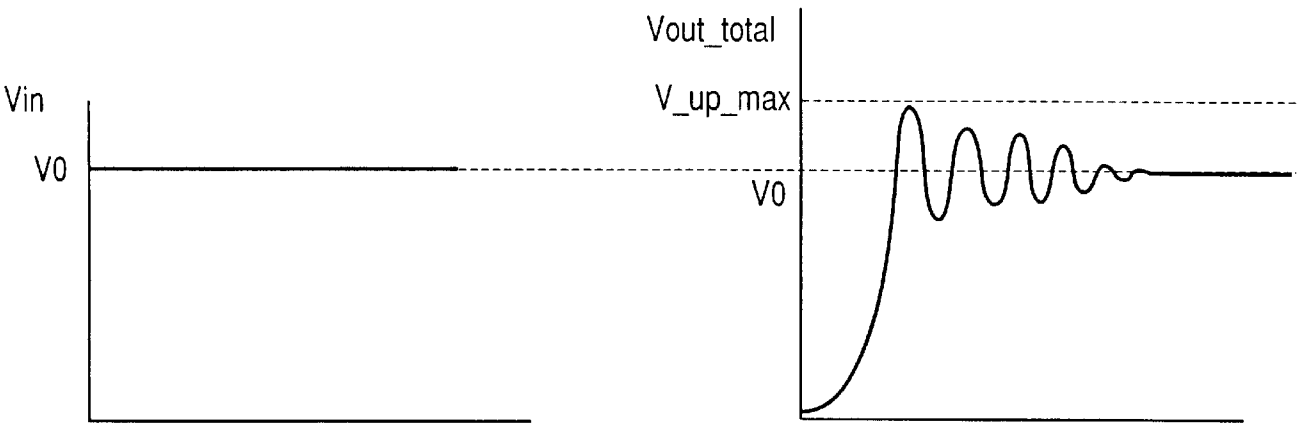
FIG. 7A
FIG. 7B
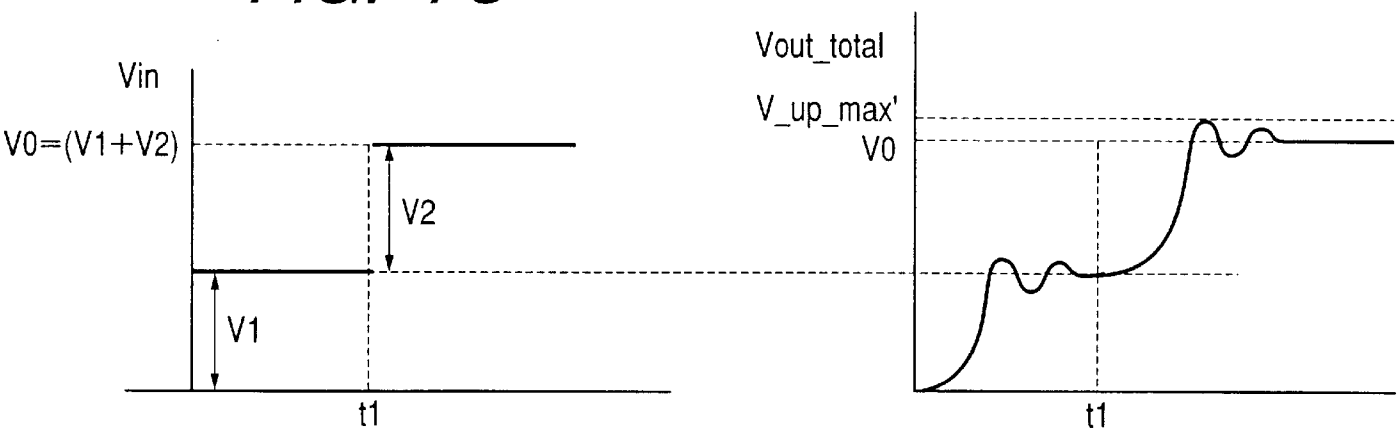
FIG. 7C
FIG. 7D

SELECTION OF ROW SIDE

SELECTION OF COLUMN SIDE

SELECTION OF ROW SIDE

SELECTION OF COLUMN SIDE

METHOD OF MANUFACTURING AN ELECTRON SOURCE AND AN IMAGE-FORMING APPARATUS, AND APPARATUS FOR MANUFACTURING THE SAME

BACKGROUND OF THE INVENTION

1. Field of the Invention

The present invention relates to a method of manufacturing an electron source and an image-forming apparatus, and an apparatus for manufacturing the same.

2. Related Background Art

Two kinds of device, i.e., a thermoionic cathode and a cold cathode are conventionally known as an electron-emitting device. Known cold cathode include a field emitter device (hereinafter referred to as "FE type"), a metal/insulating layer/metal type emitting device (hereinafter referred to as "MIM type"), and a surface conduction electron-emitting device.

Known examples of the FE type are disclosed, for example, by W. P. Dyke & W. W. Dolan, in "Field emission", Advance in Electron Physics, 8, 89 (1956) or in C. A. Spindt, "Physical properties of thin-film field emission cathodes with molybdenium cones", J. Appl. Phys. 47, 5248 (1976).

Known examples of the MIM type are disclosed, by C. A. Mead, in "Operation of tunnel-emission Devices", J. Appl. Phys., 32, 646 (1961), for example.

A surface conduction electron-emitting device disclosed in, for example, M. I. Elinson, Radio Eng. Electron Phys., 10, 1290 (1965) or others as will be described later are known.

A surface conduction electron-emitting device utilizes the phenomenon in which electron emission is caused by flowing an electric current to a thin film formed with a small area on a substrate and in parallel to the film surface. This surface conduction electron-emitting device that has been reported includes those employing a SnO2 thin film developed by Elinson et al. named in the above, those employing an Au thin film (G. Dittmer, "Thin Solid Films", Vol.9, p.317, 1972), those employing a In203/SnO2 thin film (M. Hartwell and C. G. Fonstad, "IEEE Trans. ED Conf.", p.519, 1975), and those employing a carbon thin film (Hisashi Araki, et al. "SHINKU(Vacuum)", Vol.26, No.1, p.22, 1983).

Typical device structure example of these surface conduction electron-emitting devices is shown in FIG. 35, which is a plan view of a device disclosed by M. Hartwell et al. named in the above. In this figure, reference numeral 3001 denotes a substrate, and reference numeral 3004 denotes an electroconductive thin film made of metal oxides formed by sputtering. The electroconductive thin film 3004 is formed into an H-shaped plan configuration as illustrated. The electroconductive thin film 3004 is subjected to an energization operation called an energization forming, as will be described later, to form an electron-emitting region 3005. In FIG. 35, intervals L and W are defined as 0.5 to 1 mm and 0.1 mm, respectively. For convenience of illustration, the electron-emitting region 3005 is shown as a rectangle formed in the middle of the electroconductive thin film 3004, but it is schematically shown, and the exact position or configuration of the actual electron-emitting region is not faithfully expressed herein.

In the above-stated surface conduction electron-emitting device representative of those disclosed in M. Hartwell et al., it has been typically practiced to form the electron-emitting region 3005 by an energization operation called an energization forming on the electroconductive thin film 3004 before effecting the electron emission. More specifically, in an energization forming, a constant dc voltage or dc voltage with an increase at a greatly slow rate, for example, on the order of 1 v/minute is applied to the both ends of the electroconductive thin film 3004, and a current is made to flow to the electroconductive thin film to bring the electroconductive thin film 3004 to be locally destroyed, deformed or denatured, thus forming the electron-emitting region 3005 kept in a state of electrically high resistance. A gap is formed in a portion of the electroconductive thin film 3004 which is brought to be locally destroyed, deformed or denatured. If an appropriate voltage is applied to the electroconductive thin film 3004 after the energization forming, an electron emission is generated in the vicinity of the gap.

The foregoing surface conduction electron-emitting device has an advantage to form a number of devices over a large area since it is simple in structure and is easily manufactured. Therefore, methods of arranging and driving a number of devices have been studied as disclosed by the present applicant in Japanese Patent Application Laid-Open No. 64-31332.

An application of surface conduction electron-emitting devices which has been studied includes an image-forming apparatus such as an image display device or an image recording device, and a charging beam source.

In particular, an application to the image display device which has been studied includes an image display device taking advantage of a combination of a surface conduction electron-emitting device and a phosphor irradiated by an electron to effect light-emission, as disclosed by the present applicant in U.S. Pat. No. 5,066,883 and in Japanese Patent Application Laid-Open No. 2-257551. The image display device with use of a combination of a surface conduction electron-emitting device and a phosphor is expected to be more excellent in nature than other types of image display device in the prior art. It can be excellent in no requirement for back light since it is of a self-emission type or in larger view angle, as compared to a recently popular liquid crystal display device, for example.

SUMMARY OF THE INVENTION

An object of the present invention is to provide a method of manufacturing an electron source and an imageforming apparatus, and an apparatus for manufacturing the same, in which occurrence of an abnormal voltage can be suppressed in energization processes used for a manufacture process of an electron source.

The present invention provides a method of manufacturing an electron source comprising an electron-emitting device comprising a pair of electroconductive members, and first wires and second wires being connected to the pair of electroconductive members, respectively, the method comprising the step of applying a pulse voltage to the pair of electroconductive members via the first and/or second wires, wherein the pulse voltage is a pulse where a specific frequency band included in a pulse voltage outputted from a pulse power supply is restricted.

Further, according to the present invention, the frequency band is varied according to impedance fluctuation of the electron source.

The present invention also provides a method of manufacturing an electron source comprising an electron-emitting device comprising a pair of electroconductive members, and first wires and second wires being connected to the pair of electroconductive members, respectively, the method comprising the step of applying a pulse voltage between the pair of electroconductive members via the first and/or second wires so that a voltage increases and/or decreases in steps, wherein the pulse voltage increases by at least two steps from its absolute minimum voltage Vmin to its absolute maximum voltage Vmax, and wherein the absolute maximum value of a voltage to be effectively applied to the pair of electroconductive members is not larger than $Vmax+|Vmax-Vmin|\times 0.1$.

Further, according to the present invention, the maximum value of a voltage to be effectively applied to the pair of electroconductive members is not larger than $Vmax+|Vmax-Vmin|\times 0.05$.

Still further, according to the present invention, wherein the maximum value of a voltage to be effectively applied to the pair of electroconductive members is not larger than $Vmax+|Vmax-Vmin|\times 0.01$.

Still further, according to the present invention, the voltage applying step is a step to form a gap on an electroconductive film connecting the pair of electroconductive members.

Still further, according to the present invention, the voltage applying step is a step to arrange a carbon film between the pair of electroconductive members.

The present invention also applies the foregoing manufacture method of an electron source to a manufacture method of an electron source which is used for an image-forming apparatus.

The present invention also provides an apparatus for manufacturing an electron source comprising an electron-emitting device comprising a pair of electroconductive members, and first wires and second wires being connected to the pair of electroconductive members, respectively, the apparatus comprising: a pulse voltage source for applying a pulse voltage to the pair of electroconductive members via the first and/or second wires; and a pulse voltage control circuit connecting the pulse voltage source and the first and/or second wires, wherein the pulse voltage control circuit restricts a specific frequency band included in the pulse voltage.

Further, according to the present invention, the voltage control circuit makes the frequency band to be restricted vary according to impedance fluctuation of the electron source.

Still further, according to the present invention, the voltage control circuit includes a low-pass filter circuit.

Still further, according to the present invention, the voltage control circuit is provided with a capacitance component and a resistance component.

The present invention also applies the foregoing manufacture apparatus for an electron source to an apparatus for manufacturing an electron source which is used for an image-forming apparatus.

BRIEF DESCRIPTION OF THE DRAWINGS

FIGS. 7A, 7B, 7C and 7D are views for explaining an applied voltage used for energization;

FIGS. 32A, 32B and 33C are views showing a voltage waveform used for a preliminary driving operation in accordance with the embodiment of the present invention;

DETAILED DESCRIPTION OF THE PREFERRED EMBODIMENTS

Figure 1A:
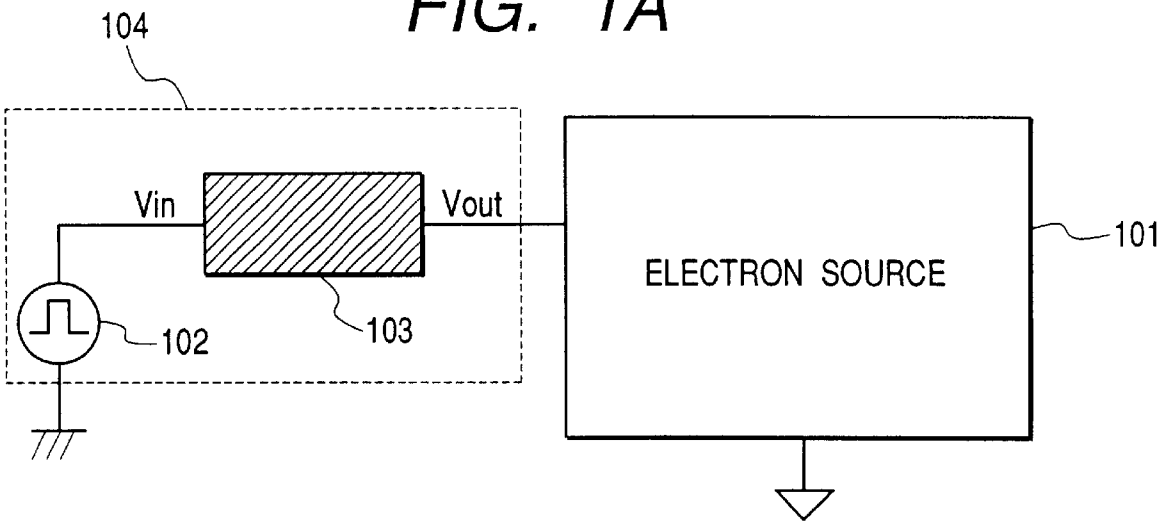
FIGS. 1A and 1B are schematic view showing an energization apparatus capable of suppressing occurrence of ringing.

The present inventors have made intensive study to improve a characteristic of an electron-emitting device, such as a surface conduction electron-emitting device, having a pair of electroconductive members, and as a result, they have now found that the energizing activation operation, the preliminary driving operation, and the aging operation are useful.

As described above, in one example, an electron-emitting region is formed in a surface conduction electron-emitting device by flowing a current to an electroconductive thin film for connecting a pair of electrodes which serves as a pair of electroconductive members thus forming a gap in the thin film (i.e., an energization forming operation). Through this process, the electroconductive thin film substantially becomes a pair of electroconductive thin films (electroconductive members) defined by the gap as a boundary. This pair of electroconductive thin films (the electroconductive thin films having a gap) may be called a pair of electroconductive members.

The resultant electroconductive film having a gap (or merely a pair of electroconductive films) can be further subjected to an energization operation called an energizing activation operation to obtain a device with an electron-emitting characteristic increased, typically, a hundred times or more.

Also, fluctuation in constituent members can be reduced which may cause instability in a time-sequential characteristic of the thus obtained surface conduction electron-emitting device by an energization operation called a preliminary driving operation.

The "energization operation" as used herein is indicative of a process of applying a pulse voltage to a pair of electroconductive members. Or, the "energization operation" as used herein may be a process of making a current flow between a pair of electroconductive members. Or, the "energization operation" as used herein may be a process of applying a pulse voltage to a pair of electroconductive members to the extent to flow a current between a pair of electroconductive members.

While the electron-emitting region may be made up of a gap formed by the forming operation as described above, an electroconductive film (a pair of electroconductive films) previously formed with a gap may be subjected to the above-stated activation operation to finally form an electron-emitting region.

A method of applying a voltage by the energization forming operation, energizing activation operation, preliminary driving operation named in the above will now be described.

Referring to FIGS. 36 and 44C to 44E, an example of voltage applying process is schematically illustrated to form a surface conduction electron-emitting device.

In FIGS. 36 and 44C to 44E, reference numeral 1 denotes a substrate; 25, an electron-emitting region; 21, an electroconductive thin film; 22, an electrode; and 100, a coating film formed by the activation operation, and a power supply 24 is connected to the electrode 22. Reference numeral 31 denotes an anode electrode for acquiring an emission current Ie emitted from the surface conduction electron-emitting device. A dc high voltage power supply 33 and an ammeter 32 are connected to the anode electrode 31. The coating film 100 is preferably a carbon film. The ammeters 23 and 32 may be used to measure a device current If and an emission current Ie to monitor an ongoing state of the respective operations. The electrode 22 is used herein, but it is not essential.

The energization operations in each of the operations will now be described.

Figure 44A:
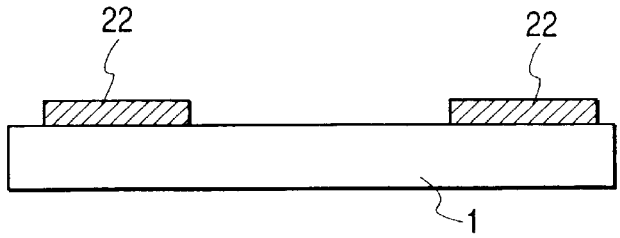
FIGS. 44A, 44B, 44C, 44D, 44E and 44F are sectional views showing a manufacturing process of a surface conduction electron-emitting device of a planar type.
Figure 44B:
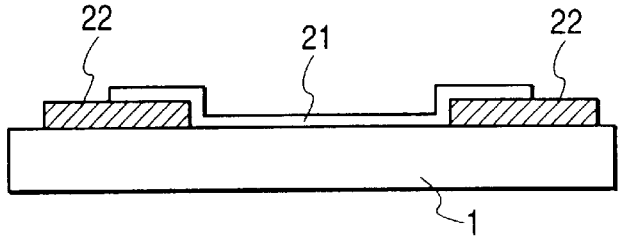
Figure 44C:
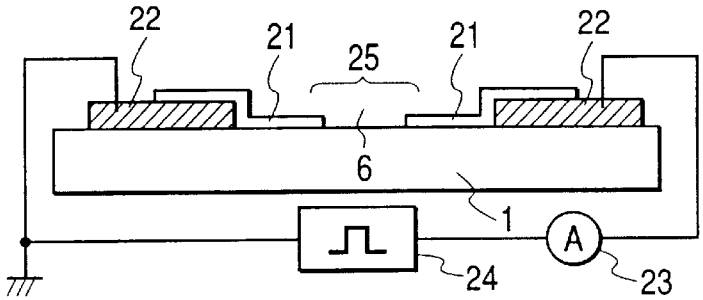

In the energization forming operation, the electroconductive thin film 21 is first deposited on the substrate 1, as shown in FIG. 44B. Then, as shown in FIG. 44C, an appropriate voltage pulse is applied to the electroconductive thin film 21 to form a second gap 6 (an electron-emitting region 25 in a part of the electroconductive thin film 21.

Figure 44D:
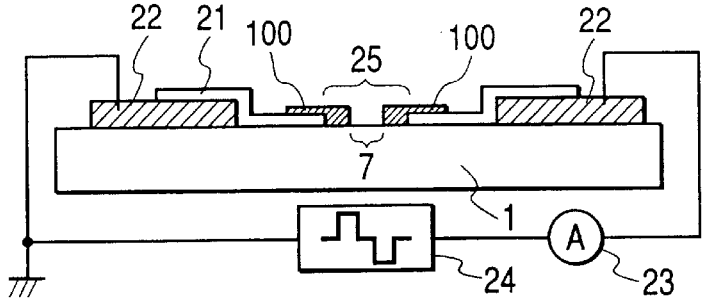

In the energizing activation operation, a voltage pulse is repeatedly applied in a carbon compound content atmosphere with an appropriate pressure to the electroconductive thin film having the second gap 6 formed by the energization forming operation or any electroconductive film previously formed with a gap, thus depositing the carbon film 100 made of a carbon or carbon compound in the vicinity of the gap (see FIG. 44D). Through this process, a first gap 7 is formed in the carbon film 100. The first gap 7 has a narrower width than that of the second gap 6. While a voltage pulse having the both polarity (bipolar pulse) is applied herein as a voltage pulse to be applied in the activation operation as shown in FIG. 44D, a voltage pulse having either polarity may be only applied, but it is preferred to apply the pulse having the both polarity.

In the preliminary driving operation, first, a device effected by this activation operation is set in vacuum where no carbon or carbon compound is deposited on the device. A voltage pulse is then applied to the device so that the electric field strength may be larger than the electric field strength applied to the electron-emitting region in a normal driving, thus reducing fluctuation factors in the normal driving (see FIG. 44E).

The present inventors have further found that the aging operation is useful in the manufacture process to improve a characteristic of an image-forming apparatus in which a surface conduction electron-emitting device is utilized as an electron source.

This image-forming apparatus is comprised of an airtight container for keeping the internal in a vacuumed state, an image-forming member such as phosphors disposed in the container, and an electron source, as will be described in detail with reference to embodiments described later.

The aging operation named above indicates a manufacture process prior to a regular work of an image-forming apparatus. With the aging operation, a dot failure, line failure, etc. that may be caused in the image-forming apparatus due to a gas separation of members constituting the image-forming apparatus such as electron sources, phosphors or electrodes can be prevented during the display driving (regular work) of the image-forming apparatus.

More specifically, in the aging operation, a pulse voltage is applied to the device prior to the regular work to facilitate sufficient degassing from the respective members with heat or electron-beam energy, thus reducing or avoiding significant exacerbation that may cause deterioration or vacuum discharge of an electron-emitting device.

An energization method in the aging operation will now be described.

Figure 36:
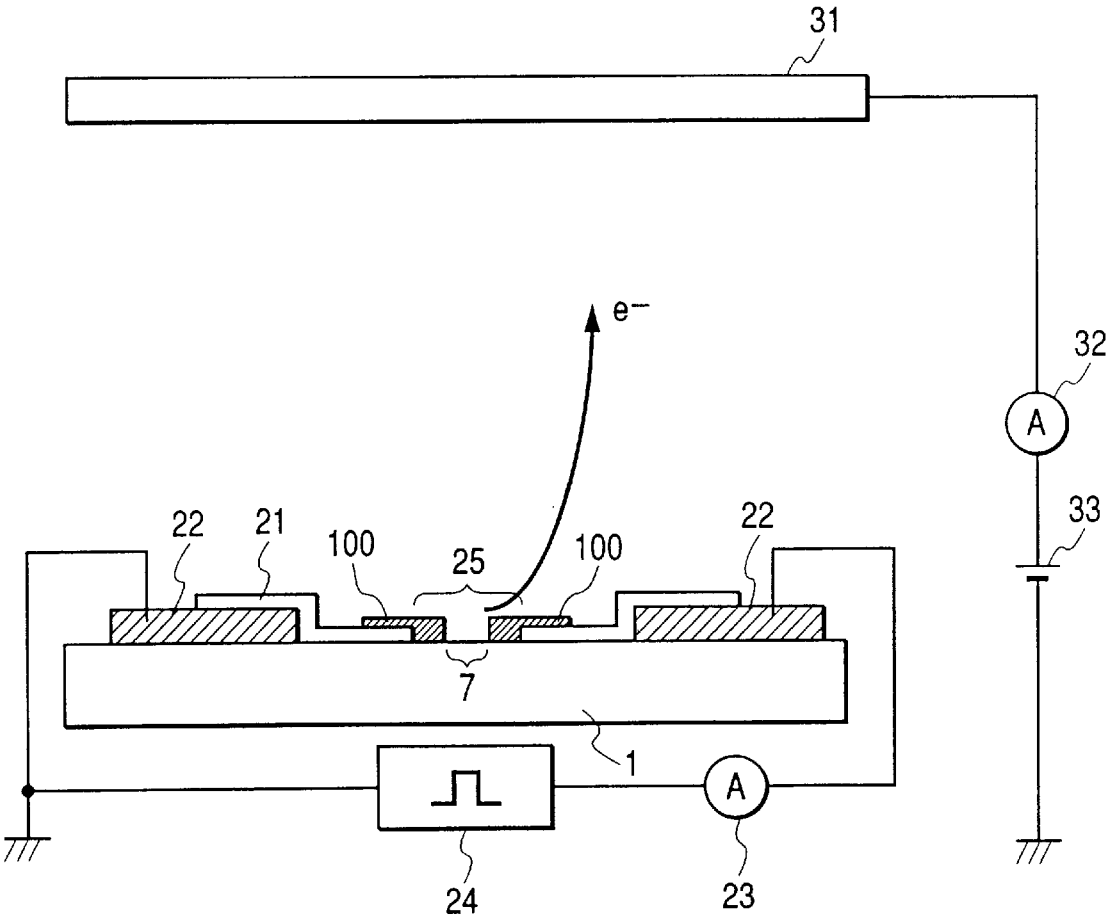
FIG. 36 is a schematic view showing an example of an energization operation apparatus for an electroconductive thin film and a surface conduction electron-emitting device.

An energization operation system shown in FIG. 36 is used for the explanation. The operation is effected by again setting the device subjected to the preliminary driving operation in a vacuum container where no carbon or carbon compound is deposited, applying a voltage to the anode electrode 31 from the dc high voltage power supply 33, and further repeatedly applying an appropriate voltage pulse to the electroconductive thin film 21 from the power supply 24.

While an energization operation method on a single device has been described herein, it may be applied to a so-called simple matrix array in which devices are connected with row-directional wires 72 and column-directional wires 73. In such a case, for example, the column-directional wires are set at a common potential (e.g., GND), and a voltage pulse is applied to one row-directional wire 72 as shown in FIGS. 44C to 44E and 36, so that the device connected to the one row-directional wire 72 can undergo the previously described energization operations in the same manner as the case of single device.

Now, a device current If flowing to the device (electroconductive film) during the energization forming operation, activation operation, preliminary driving operation, and aging operation is exemplified.

Figure 37:
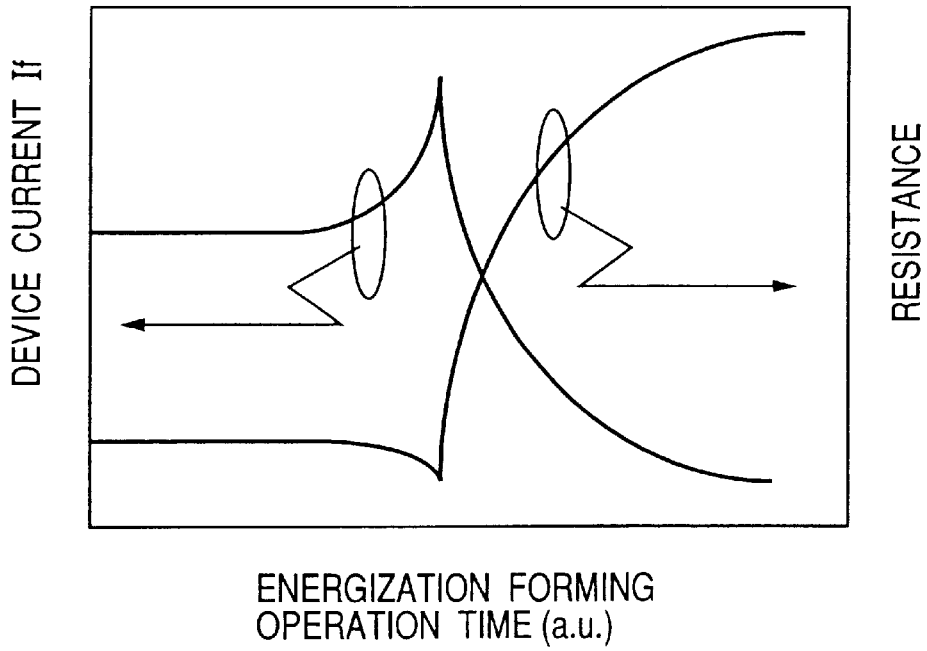
FIG. 37 is a view showing that a device current If of the surface conduction electron-emitting device varies as time elapses during the energization forming operation.

First, the device current If during the energization forming operation is shown in FIG. 37.

Once a pulse voltage is applied from the power supply 24 shown in FIG. 36, the device current If is observed to temporarily increase, but then decreases. At the time point when the device current If reaches a desired value, the application of voltage is stopped to end the process. Hereinafter, the device current If monitoring the on-going state during the energization forming is referred to as a forming device current If profile.

Figure 38:
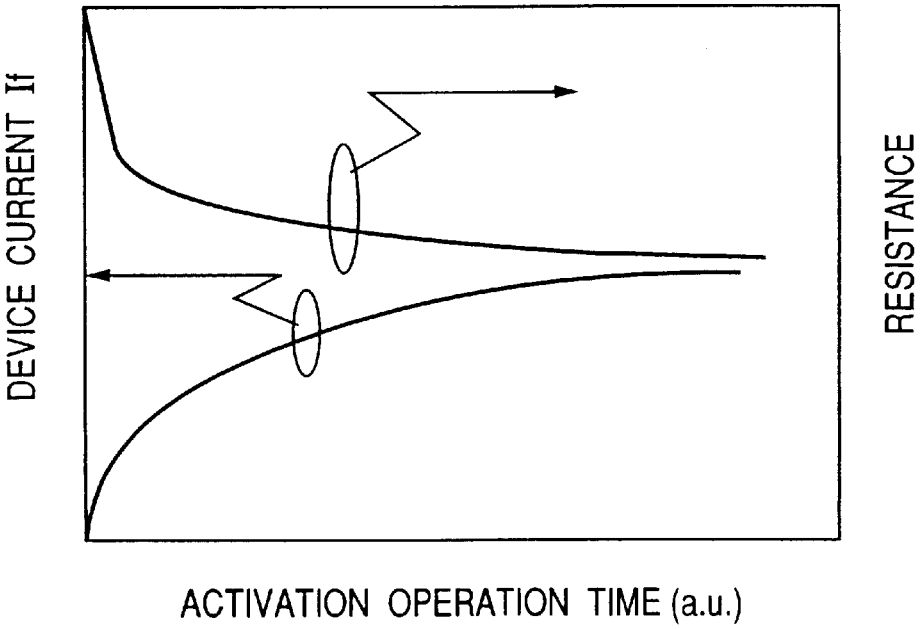
FIG. 38 is a view showing that the device current If of the surface conduction electron-emitting device varies as time elapses during the energizing activation operation.

Next, the device current If during the activation operation is shown in FIG. 38.

Once a pulse voltage is applied from the power supply 24, the device current If increases as time elapses. When the device current If reaches a desired value, application of voltage is stopped to end the process. Hereinafter, the device current If monitoring the on-going state during the activation is referred to as an activation device current If profile.

Figure 39:
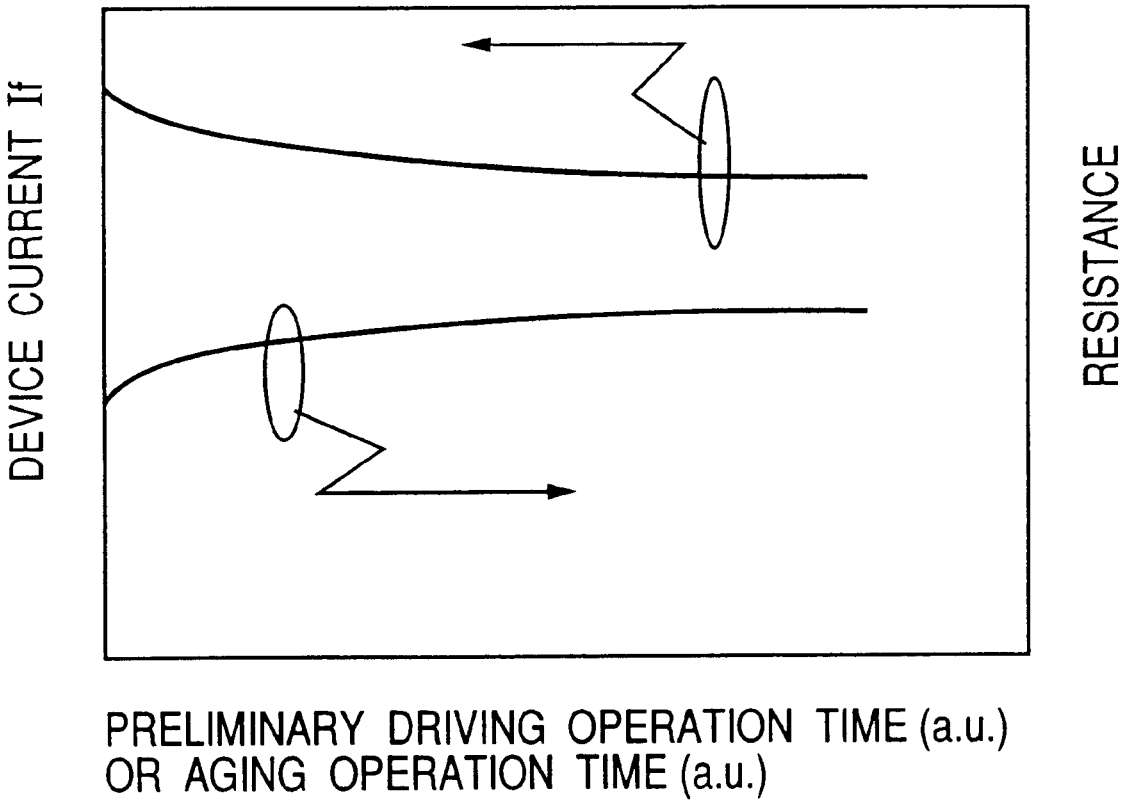
FIG. 39 is a view showing that the device current If and an emission current Ie of the surface conduction electron-emitting device vary as time elapses during the preliminary driving operation and the aging operation.

Finally, the device currents If during the preliminary driving operation and the panel degassing operation are shown in FIG. 39.

Once a pulse voltage is applied from the power supply 24, the device currents If are constant or decreases as time elapses.

Hereinafter, the device currents If monitoring the on-going state during the preliminary driving operation and the panel degassing operation (aging operation) are referred to as a preliminary driving device current If profile and a panel degassing device current If profile, respectively.

In this connection, the configuration of each profile is shown schematically, the profiles during the preliminary driving operation and the panel degassing operation do not coincide with each other.

For the foregoing energization operations (energization forming operation, energizing activation operation, preliminary driving operation, or aging operation), the device current or emission current of the electron-emitting device may be deteriorated due to the following problems. (Ringing caused by applying pulse voltage)

In the case where the energization operation is performed on an electroconductive thin film (prior to the activation process) or an electron-emitting device (after the activation process), inductance (L), capacitance (C) or resistance (R) of a "device part", "wiring connecting an energization apparatus and devices" and the "energization apparatus" may cause ringing, thereby applying a voltage different from a set voltage Vf0.

Figure 40A:
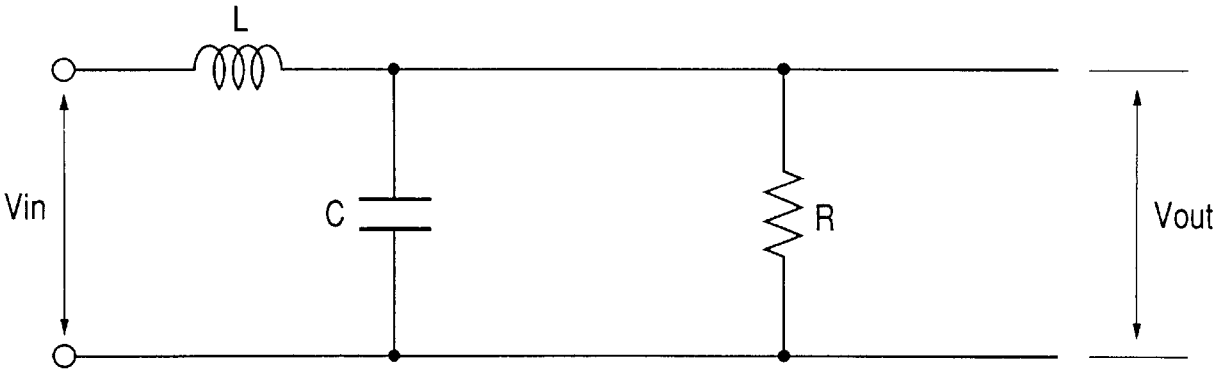
FIGS. 40A and 40B are views showing an equivalent circuit of a single device and its characteristic, respectively.
Figure 40B:
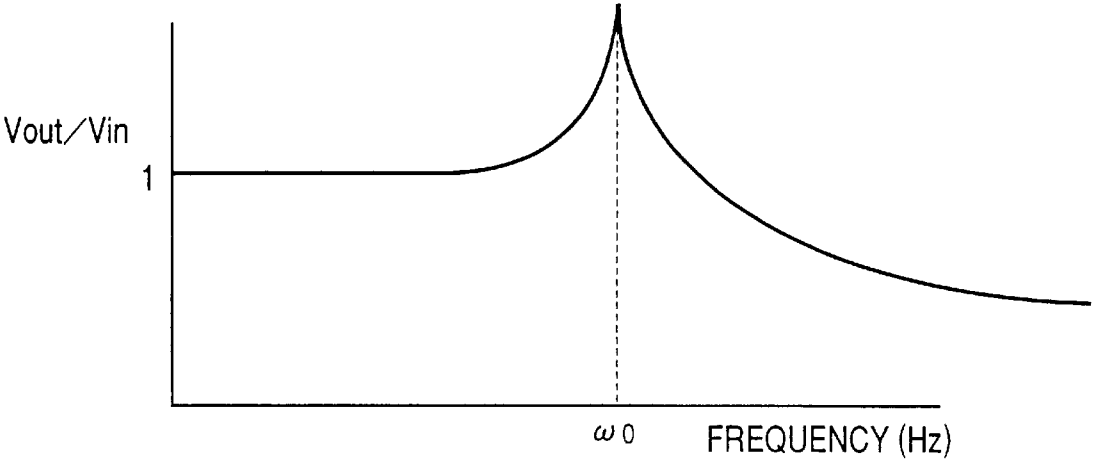

FIGS. 40A and 40B depict this state. FIG. 40A shows an equivalent circuit of devices including the wiring shown in FIG. 36. FIG. 40B shows a gain-frequency characteristic with gain |Vout/Vin| with respect to this equaling circuit. In FIG. 40B, a resonance condition is defined as $\omega_0$.

Figure 48:
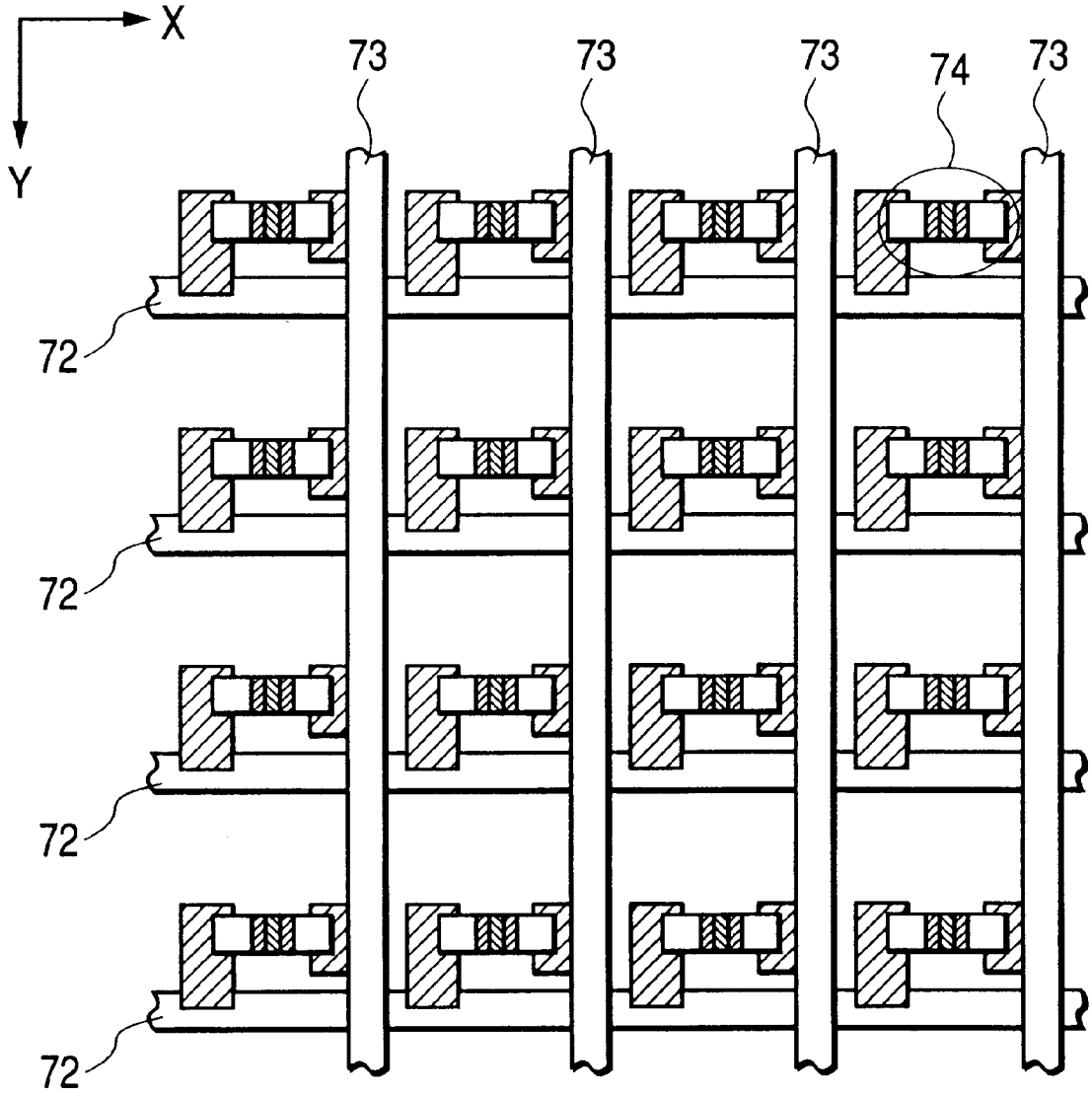
FIG. 48 is a schematic view showing devices arranged in simple matrix wiring.

Further, if the electron-emitting device 74 is arranged in so-called simple matrix with the row directional wires 72 and the column-directional wires 73 as illustrated in FIG. 48, the aforementioned problems of ringing may also arise when the energization operations are effected through these wires.

Figure 49:
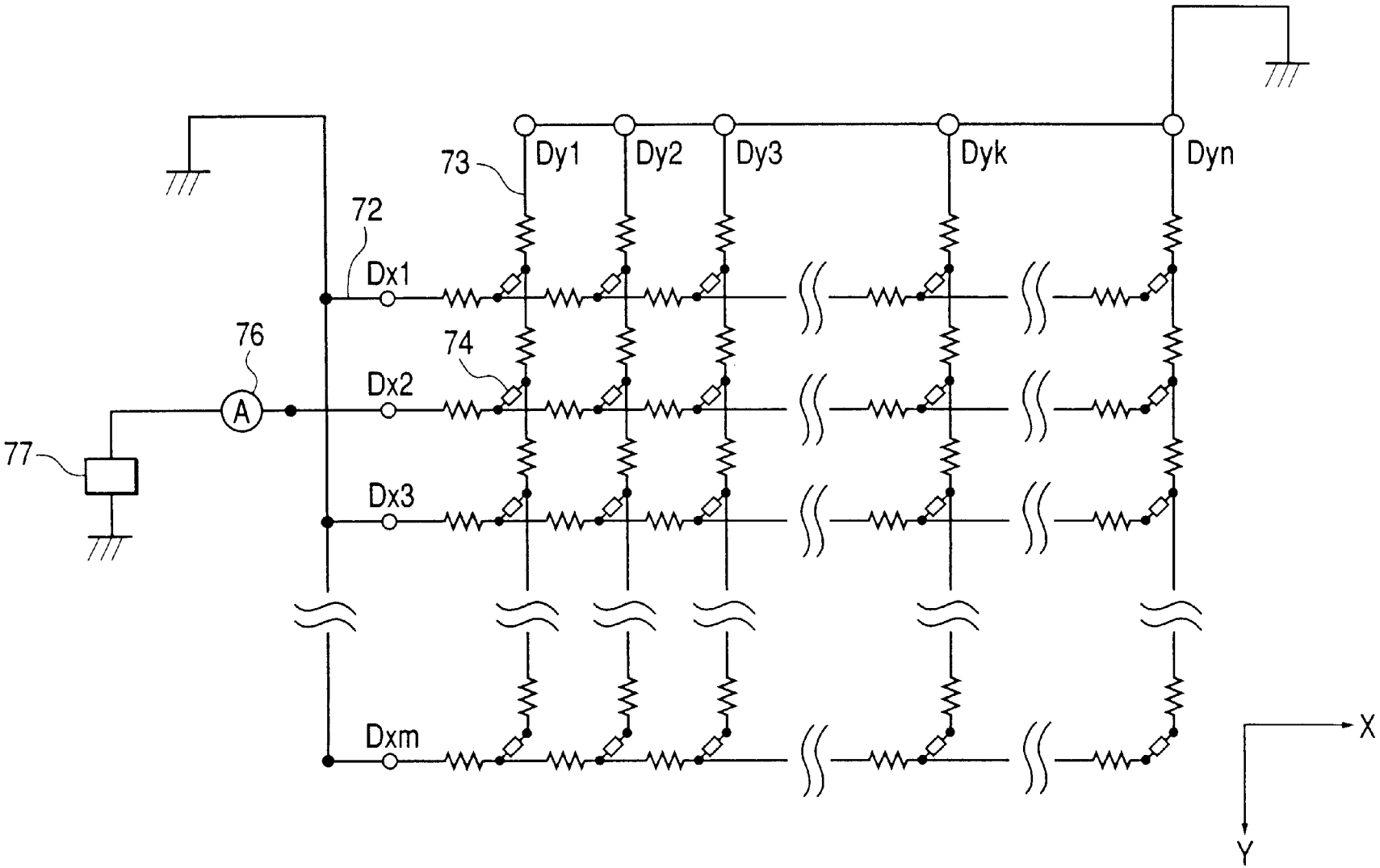
FIG. 49 is a view showing an energization method.

FIG. 49 shows an electric connection when an electroconductive film prior to the forming operation or the devices after the forming operation, which are connected to a simple matrix wiring is energized for every row wire (or column wire). In this figure, the devices in the second row which are arranged in m (rows) by n (columns) simple matrix wiring are energized.

The surface conduction electron-emitting device 74 is connected with the row-directional wires 72 and the column-directional wires 73. Reference numeral 77 denotes a power source, and reference numeral 76 denotes an ammeter for measuring the device current If. The row-directional wires 72 in the rows other than the second (Dx2) and the column-directional wires 73 are grounded. The power supply outputs a pulse voltage.

In the case where an energization operation is performed on (a pulse voltage is applied to) the devices of electroconductive film grounded to simple matrix wiring, due to inductance (L) of the simple matrix wiring, resistance (R) and capacitance (C) between the row-directional wires and the column-directional wires, between these wires and the ground, and between electrodes of each device, an oscillating phenomenon (ringing) is caused by high frequency components at the rise time of the applied voltage pulse and the fall time of the voltage pulse, thus applying a voltage different from a set voltage Vf0 to the devices.

In this connection, more exactly, the values of inductance (L), capacitance (C), and resistance (R) include inductance, capacitance, and resistance of the portion connected to the energization operation apparatus and the devices.

Figure 50A:
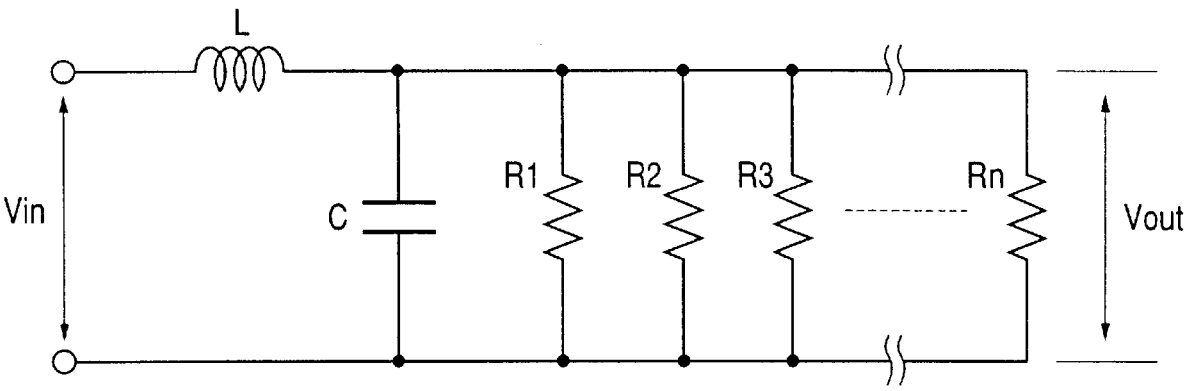
FIGS. 50A and 50B are a view showing an equivalent circuit of a device connected to a matrix wiring and a characteristic view, respectively.
Figure 50B:
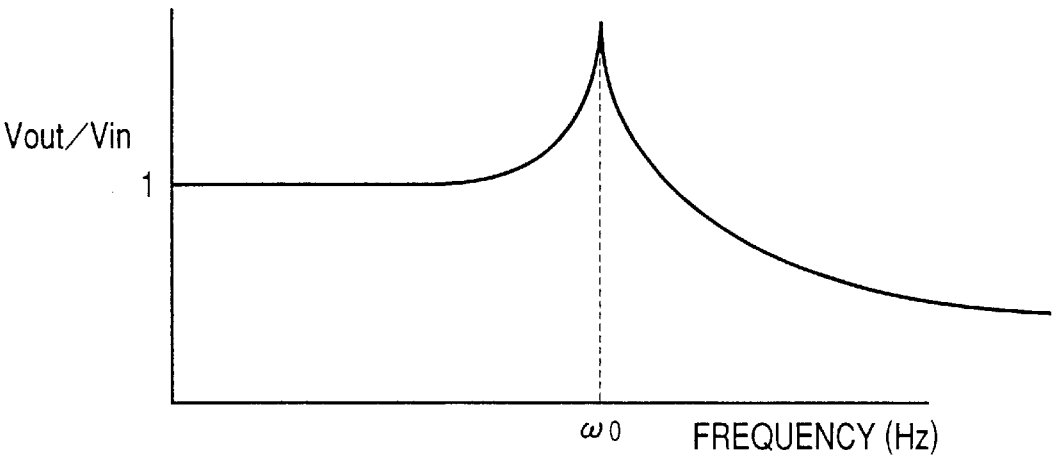

FIGS. 50A and 50B explain this state. FIG. 50A is an equivalent circuit diagram showing a plurality of electron-emitting devices 74 commonly connected to one row-directional wire (e.g., Dx2) shown in FIG. 49. FIG. 50B shows a gain-frequency characteristic of the gain |Vout/Vin| to this equivalent circuit, in which a frequency characteristic of an abnormal voltage caused by the above-stated oscillation is shown. In FIG. 50B, a resonance condition is defined as O.

It will be noted that this value Vout is indicative of a voltage to be effectively applied to a pair of electroconductive films, and Vin is indicative of a voltage to be outputted from a pulse power supply in the foregoing description. In this specification which follows, Vout indicates a voltage to be effectively applied to a pair of electroconductive film, and. Vin indicates a voltage to be outputted from a pulse voltage source unless otherwise especially specified.

Figure 41:
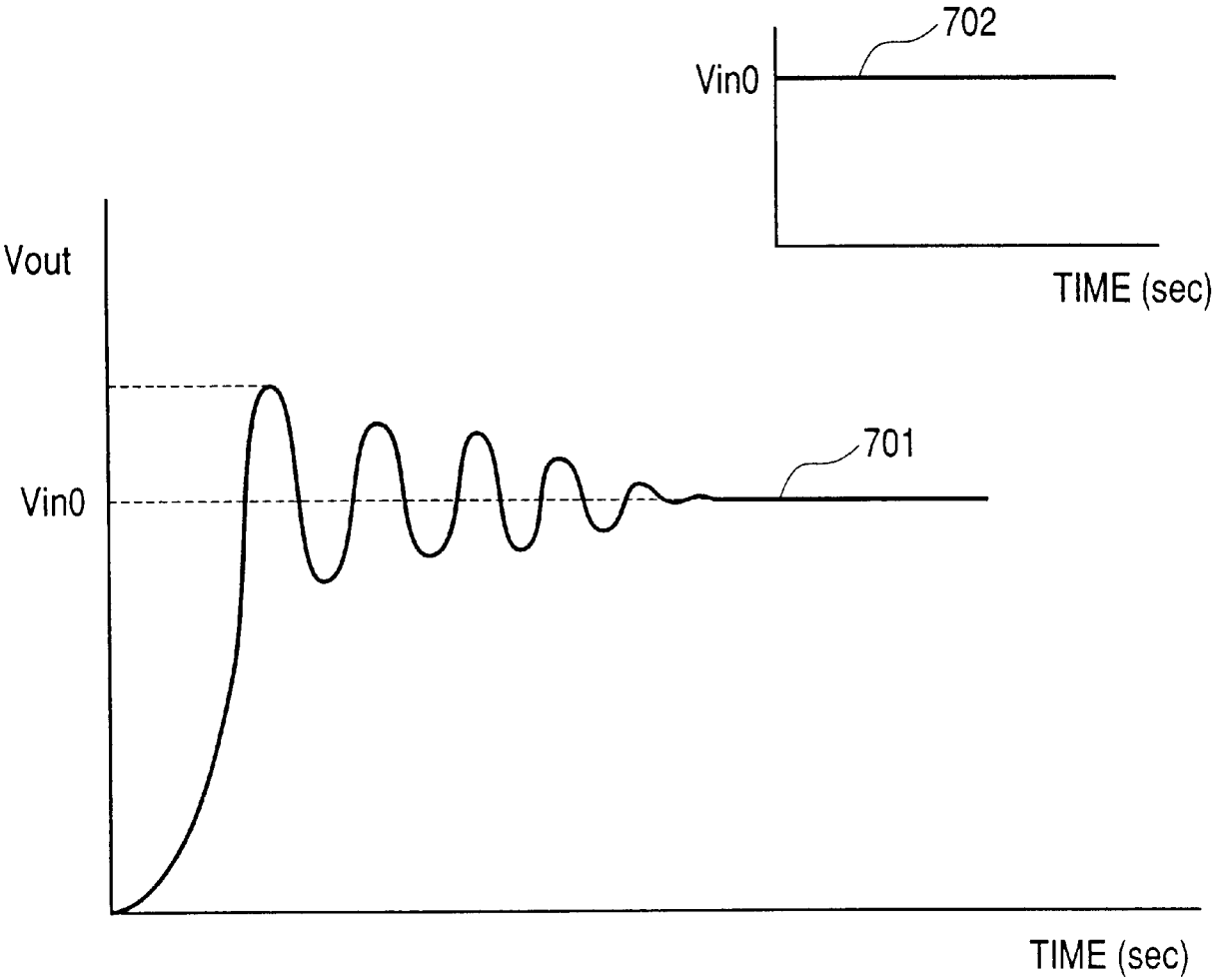
FIG. 41 is a view showing a ringing waveform.

A characteristic of an abnormal voltage caused by the above-stated oscillation vs. time is shown in FIG. 41. FIG. 41 shows a characteristic in the case where a voltage that becomes a step function where the voltage at the rise time of $dv/dt=\infty$, with $t>0$, is set at Vin0 ($\neq 0$) is inputted as Vin to the circuit shown in FIG. 40A or 50A (the waveform of Vin is shown in the upper right portion of FIG. 41). The abnormal voltage vs. time characteristic shown in FIG. 41 is basically the same in principle between a single device shown in FIGS. 40A and 40B and the devices arranged in simple matrix wiring described with reference to FIGS. 50A and 50B, except for a difference in the number of resistances (R).

When an abnormal voltage caused by the ringing occurs in the foregoing four energization processes, a desired voltage may not be applied to the device part, thereby deteriorating a device current and an emission current.

Therefore, the present invention has been made in view of the foregoing problems, and has an object to provide a method of manufacturing an electron-emitting device, an electron source and an image-forming apparatus, and an apparatus for manufacturing the same, in which occurrence of an abnormal voltage can be suppressed in energization processes used for a manufacturing process of an electron source.

The present invention will now be described in detail taken in conjunction with preferred embodiments thereof.

A Method of Suppressing Occurrence of an Abnormal Voltage

The ringing during the energization processes is caused by high frequency components at the rise/fall time of an applied pulse voltage. Therefore, means for eliminating these frequency components is required.

The present invention is intended to suppress occurrence of the ringing by means defined by the following (1) and/or (2):

(1) a method to eliminate frequency components, namely to eliminate a frequency band involved with the ringing from an applied voltage pulse used in the energization processes; and (2) a method to restrict the peak value of an abnormal voltage caused by the ringing by controlling a voltage value or output timing of an applied voltage pulse used in the energization processes.

The present invention utilizes either or both of these two methods to restrict the ringing.

As used herein, the "electron source" generally includes electron sources in case of the single device named in the above, in the case where a plurality of electron-emitting devices are connected with a common wiring, and the case where a plurality of electron-emitting devices are arranged in simple matrix wiring (see FIG. 48). The "electron source" used herein also includes an electron source before the above-described forming, i.e., an electron source having no electron-emitting region formed yet.

A Method of Restricting EL Frequency Band by Using a Filter Circuit (a voltage control circuit)

To begin with, a "method of restricting a frequency band" as named in the above (1) is described with reference to FIGS. 1A and 1B.

FIG. 1A shows in a block diagram a voltage applying system. A power supply 104 is connected to an electron source 101 to realize the foregoing energization operation processes. The power supply 104 is comprised of a pulse power supply 102 for generating a pulse voltage, and a low-pass filter circuit (voltage control circuit) 103.

Figure 1B:
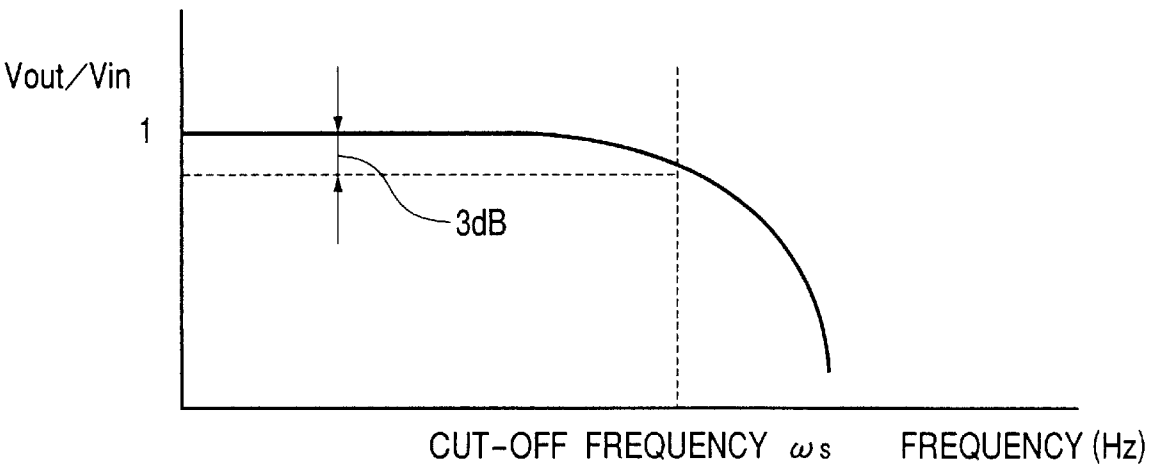

FIG. 1B shows a characteristic of the low-pass filter circuit. A cut-off frequency ωs in the low-pass filter circuit is adjusted to eliminate an abnormal voltage generated at a high frequency band.

Figure 2:
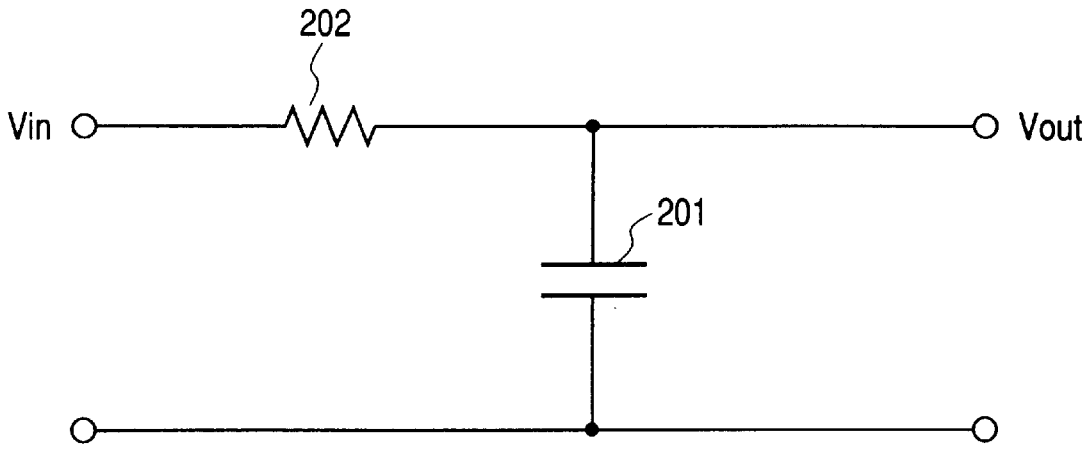
FIG. 2 is a circuit diagram showing a low-pass filtration circuit (LPF) used for the apparatus shown in FIG. 1A.

Referring now to FIG. 2, an example of the low-pass filter used in FIGS. 1A is shown. This circuit is comprised of a capacitance component 201 and a resistance component 202. ΔFrequency band evaluation method.

A description will now be made of a method of setting a condition to suppress occurrence of an abnormal voltage.

In the respective energization operation processes, impedance of an energization circuit system including an electroconductive thin film or a surface conduction electron-emitting device fluctuates as time elapses. Therefore, there is a need to set a condition according to the impedance fluctuation.

As a condition setting method are employed (A) a method of fixing and setting a frequency band of a voltage pulse at an optimal value in each process, and (B) a method of modulating a frequency band of a voltage pulse to an optimal value in accordance with the impedance fluctuation in each process.

The structure and operational effect is described as below.

Frequency band fixing and setting

First, "(A) fixing and setting a frequency band of a voltage pulse at an optimal value in each process" is described.

The main component of the impedance fluctuation in each process results from a change in resistance of an electroconductive thin film or a surface conduction electron-emitting device. A pre-evaluation of the change in resistance of a surface conduction electron-emitting device makes it possible to evaluate a resonance frequency in an energization circuit including the devices shown in FIG. 40A or 50A.

A relation between a frequency and a gain

A resonance condition of an energization circuit system including the devices shown in FIG. 40A or 50A is determined from the circuit diagram of FIG. 40A or 50A.

The gain (|Vout/Vin|) is defined as below, where R=R1// R2//R3// . . . //Rn for the circuit diagram (of the simple matrix wiring) shown in FIG. 50A.

Expression 13

$$|Vout/Vin|=1/SQRT(fx2+fy2) \quad \text{Eq. (1)}$$

where $$fx=1-(\omega/\omega_0^2) \quad \text{Eq. (2)}$$

$$fy=2\times\zeta\times\omega/\omega_0 \text{ with } \omega_0=1/SQRT(L\times C) \quad \text{Eq. (3)}$$

$$\zeta=\{1/(2\times R)\}\times SQRT(L\times C) \quad \text{Eq. (4)}$$

where SQRT(x) indicates $\sqrt{x}=x^{1/2}$.

From the above equations, the resonance frequency $\omega_0$ is evaluated 1/sqrt(L×C).

Given that the main component of the impedance fluctuation in each process be a resistance component, the resonance frequency $\omega_0$ is found unique to the resistance component in an energization system.

In order to avoid an excess voltage application due to the ringing, it is required to restrict a frequency band of the gain |Vout/Vin| which varies depending upon the resistance component (R).

The "excess voltage" used herein indicates a difference (|Vout−Vin|) between the voltage Vin used in each energization process and the voltage Vout to be applied to the device part. In order to prevent a device current and an emission current from deteriorating due to the excess voltage, the excess voltage |Vout−Vin| to be applied in each process must be set not larger than an excess voltage threshold value Vover (=|Vout−Vin|) predefined in each process.

Figure 3:
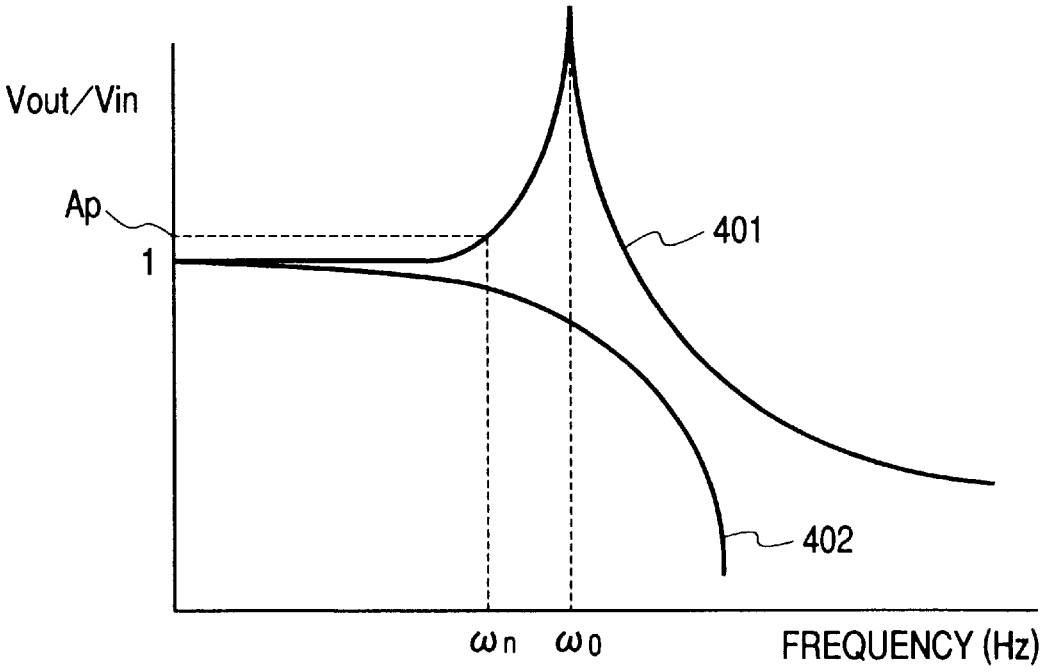
FIG. 3 is a view for explaining a ringing control parameter.

FIG. 3 shows a relation between the gain |Vout/Vin| and the frequency.

The gain curve is classified into the following two patterns depending upon the value of ζ defined in the above equations: a curve 401 for ζ< to 1 and a curve 402 for ζ≧ to 1. If ζ< to 1, the maximum value is taken at the resonance frequency $\omega_0$=1/sqrt(L×C). If ζ≧ to 1, on the other hand, the curve mono-one-decreases. If ζ< to 1, the ringing occurs.

Now, a Vout vs. time characteristic for ζ< to 1 is shown in FIG. 41. FIG. 41 shows a characteristic in the case where a voltage that becomes a step function where the voltage at the rise of dv/dt=∞, with t>0, is set at Vin0 is inputted as Vin to the circuit shown in FIG. 40A (the waveform of Vin is shown in the upper right portion of FIG. 41).

According to the present invention, a frequency band of a voltage pulse is set so that Vout for ζ< to 1 may be set not larger than a prescript value, thus avoiding an excess voltage. Vout not larger than a prescript value as used herein means a specified excess voltage threshold value Vover meeting |Vout−Vin|<Vover.

Further, it satisfies Vout=Ap×Vin.

According to the present invention, the value Ap is preferably in a range from 1.0 to 1.1, more preferably in a range from 1.0 to 1.05, in particular preferably in a range from 1.0 to 1.01, in each energization process of the electron-emitting device. In other words, the present invention is preferred to reduce a voltage to be effectively applied to the pair of electroconductive films to 10% or less of a pulse voltage to be outputted from a power source, preferably 5% or less, more preferably 1% or less.

A band setting method

Shown is a method of setting a band so as to fall within an error allowable value range which has been set for a voltage to be applied in each process.

More specifically, an excess voltage threshold value Vover is set in each process. The maximum resistance value R_pro_Max and the minimum resistance value R_pro_Min are evaluated in each process, and the gain |Vout/Vin| functions are determined for the respective resistance values.

A frequency range where these gain functions fall within the above-described Ap (defined from Vover) or less.

A detailed description is given with reference to FIG. 3.

Given the maximum resistance value R_pro_Max and the minimum resistance value R_pro_Min in a certain energization process. When the gain function at R_pro_Max corresponds to the curve 401 and the gain function at R_pro_Min corresponds to the curve 402, for evaluation, it is found that a frequency band having a voltage gain range of 1 to Ap (Ap≧1) is ωn or less.

That is, if a band of an applied voltage pulse is not larger than ωn, the process can terminate without output of any excess voltage.

A band of an applied voltage pulse is advantageously restricted by using such a calculation method.

Variable frequency band

Next, "(B) modulating a frequency band of a voltage pulse to an optimal value in each process" is described.

In order to apply a voltage pulse having an optimal pulse width in each process, a change in resistance of a surface conduction electron-emitting device (an electroconductive thin film) is advantageously measured at any time to determine a frequency band of the pulse according to the measured value since impedance fluctuates as time elapses during the process.

Figure 4:
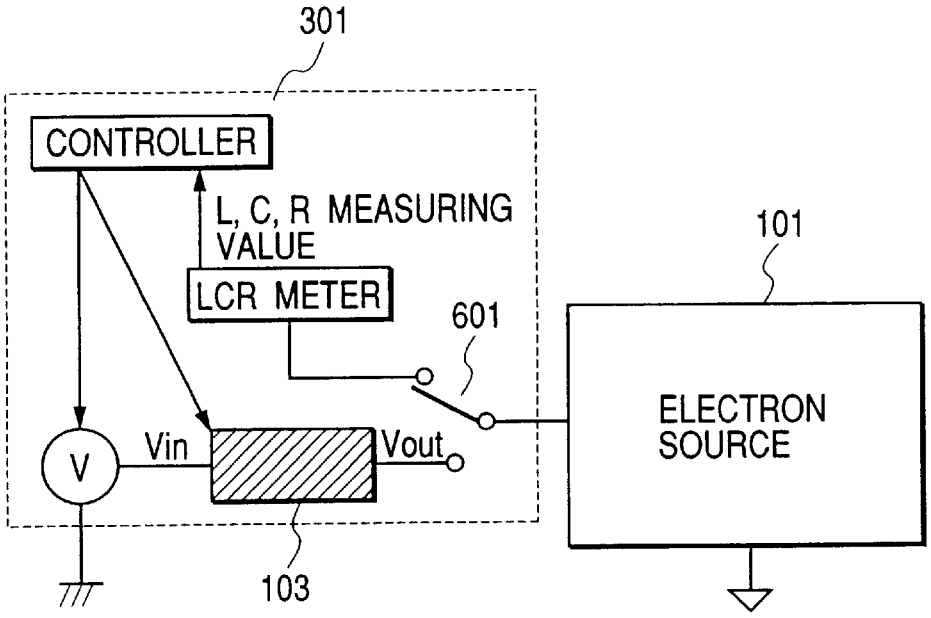
FIG. 4 is a schematic view showing an energization apparatus capable of suppressing occurrence of ringing according to an impedance fluctuation during the energization process.

FIG. 4 shows a measurement system implemented by an LCR measurement system. FIG. 4 is such that an LCR measurement apparatus is inserted into the circuit shown in FIG. 1A. The gain function |Vout/Vin| named in that above is calculated according to values measured by the LCR measurement apparatus, so that a frequency band falling within the above voltage gain range (Ap) can be set. The apparatus is switched over by a switch 601 between the LCR measurement and the energization processes. A high frequency band filter 103 having a variable filter band is employed.

Employment of this method makes it possible to optimally apply a voltage even though a capacitance component or an inductance component of the device part changes.

Herein, as a method of restricting a frequency band of a pulse is employed a method of "restricting a frequency band by using a low-pass filter circuit capable of externally controlling a frequency characteristic". However, there is no limitation on this method.

Figure 5:
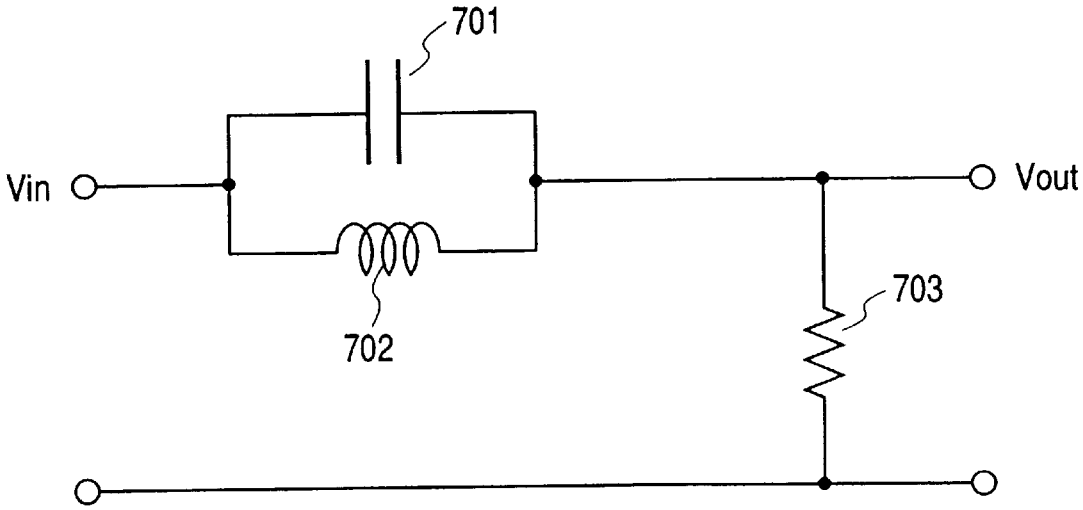
FIG. 5 is a circuit diagram of the LPF of FIG. 4.

In the foregoing description, a method of restricting a frequency band of an applied voltage pulse by using a low-pass filter is employed; however, a band illumination filter as shown in FIG. 5 may be usable. This circuit is comprised of a capacitance component 701, an inductance component 702, and a resistance component 703.

A Method of Restricting an Applied Voltage and a Timing of Applying an Applied Coltage A description will now be made with reference to FIG. 6 of another means of the present invention, (2) "a method to restrict the ringing by a voltage value and output timing of an applied voltage pulse".

Figure 6:
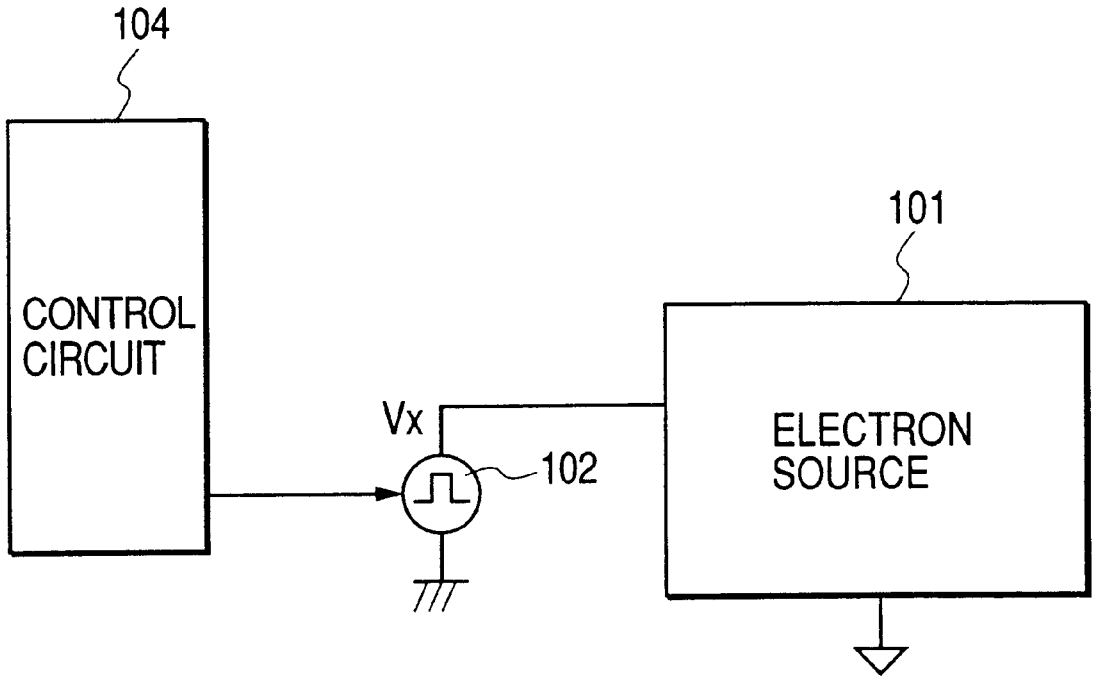
FIG. 6 is a schematic view showing an energization apparatus capable of inhibiting a ringing.

FIG. 6 shows in a block diagram a voltage applying system. A power supply 102 is connected to an electron source 101 to realize the energization processes. The power supply 102 is a pulse power supply. A control circuit 104 adjusts a pulse voltage value and the voltage output timing of the voltage outputted by the power source. A voltage applied in steps from one side FIGS. 7A and 7C show waveforms of voltage outputted from the power source 102 of FIG. 6 and FIGS. 7B and 7D show waveforms of voltage effectively applied to the electron source 101. FIGS. 7A to 7D show a portion associated with the rise of the voltage outputted by the power source 102. In FIGS. 7A and 7B, a step voltage is applied, and in FIGS. 7C and 7D, a waveform in steps is applied.

In FIGS. 7A and 7B showing a voltage applied in a conventional manner, the ringing occurs. In FIGS. 7C and 7D showing a voltage applying method in accordance with the present invention, the ringing is reduced.

In FIGS. 7C and 7D, given a voltage value required in the energization processes V0, a voltage is set to V0=V1+V2.

An output voltage Vin is defined as Vin=V1×U(t)+V2×U(t−t1), where U(t) is a step function with U(t)=0 (t<0), and u(t)=1 (t>0).

Here, the maximum value of a voltage to be applied to the electron source is indicated V_up_max', and the voltage V1, V2 and the rise delay time t1 must be set so that this voltage V_up_max' may be reduced not larger than a "rise voltage error threshold voltage" V_up_th.

In this connection, V_up_max' is 10% or less of this value V0 (=V1+V2), preferably 5% or less, more preferably 1% or less. In other words, the present invention is preferred to reduce a voltage to be effectively applied to the pair of electroconductive films to 10% or less of a pulse voltage to be outputted from a power source, preferably 5% or less, more preferably 1% or less.

Figure 8A:
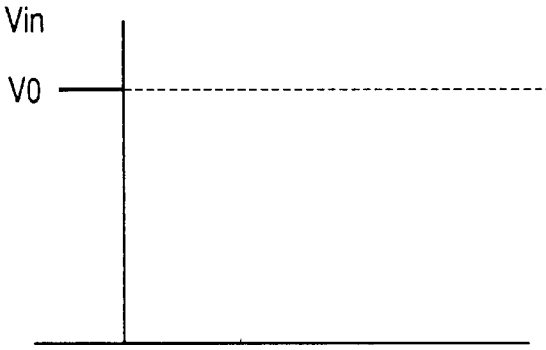
FIGS. 8A, 8B, 8C and 8D are views for explaining an applied voltage used for energization.
Figure 8B:
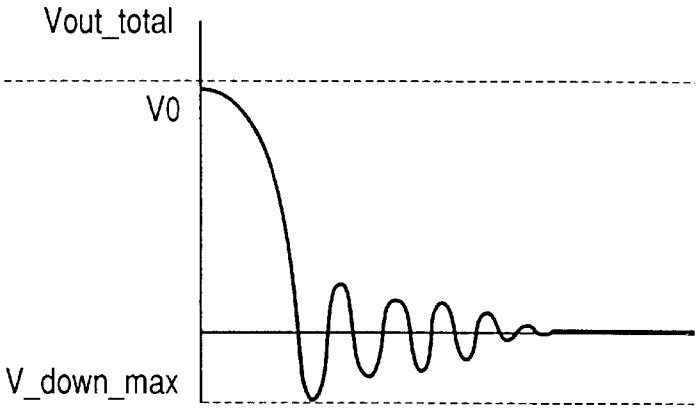
Figure 8C:
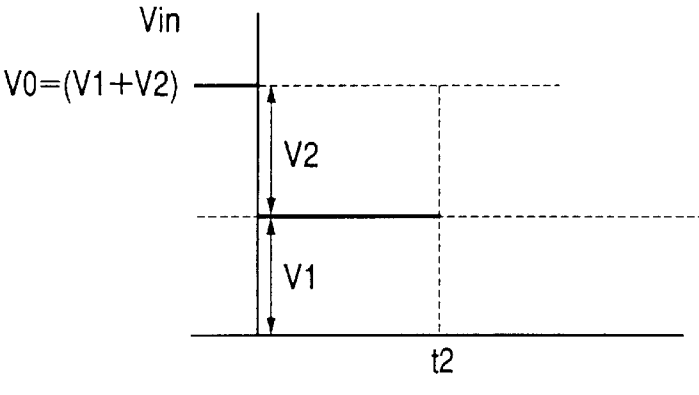
Figure 8D:
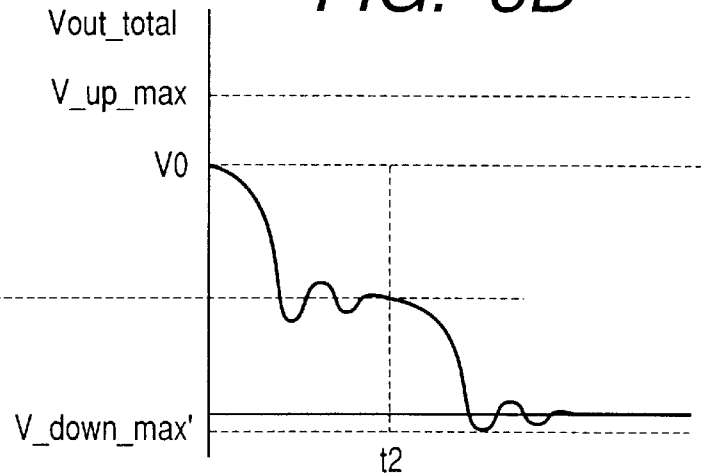

Next, a portion associated with the fall of the voltage output by the power source 102 is described with reference to FIGS. 8A to 8D. FIGS. 8A and 8C show voltage waveforms generated by the power source 102 and FIGS. 8B and 8D show waveforms of voltage effectively applied to the electron source 101. In FIGS. 8A and 8B, a step voltage is applied, and in FIGS. 8C and 8D, a waveform in steps is applied.

In FIGS. 8A and 8B showing a voltage applied in a conventional manner, the ringing occurs. In FIGS. 8C and 8D showing a voltage applying method in accordance with the present invention, the ringing is reduced.

In FIGS. 8C and 8D, given a voltage value required in the energization processes V0, a voltage is set to V0=V1+V2.

An output voltage Vin is defined as;

Expression 14

$$Vin=V0-V2\times U(t)+V1\times U(t-t2),$$

where U(t) is a step function with U(t)=0 (t<0), and u(t)=1 (t>0).

Here, the minimum value of a voltage to be applied to the electron source is indicated V_down_max', and the voltage V1, V2 and the fall delay time t2 must be set so that this voltage V_down_max' may be reduced not larger than a "falling voltage error threshold voltage" V_down_th.

In this connection, V_down_max' is 10% or less of this value V0 (=V1+V2), preferably 5% or less, more preferably 1 or less. In other words, the present invention is preferred to reduce a voltage (Vin) to be effectively applied to the pair of electroconductive films to 10% or less of a pulse voltage (V0) to be outputted from a power source, preferably 5% or less, more preferably 1% or less. Setting applied voltage V1, V2, and a "rise shifting time" t1

Next, a method of setting a condition to suppress occurrence of an abnormal voltage is described.

In the respective energization processes, impedance of an energization circuit system including an electroconductive thin film or a surface conduction electron-emitting device fluctuates as time elapses. Therefore, there is a need to set a condition according to the impedance fluctuation.

As a condition setting method are employed (A) a method of fixing and setting applied voltage V1, V2, and a "shifting time" Δt at optimal values in each process, and (B) a method of modifying applied voltage V1, V2, and a "shifting time" Δt to optimal values in accordance with the impedance fluctuation in each process.

The structure and operational effect will now be described.

Fixing and setting at optimal values

A description will be first made of "fixing and setting applied voltage V1, V2, and a "shifting time" t1 at optimal values in each process".

The main component of the impedance fluctuation in each process results from a change in resistance of an electroconductive thin film or a surface conduction electron-emitting device. A pre-evaluation of the change in resistance of a surface conduction electron-emitting device makes it possible to evaluate a voltage actually applied to an electron source made up of one or a plurality of electron-emitting device(s) and wires.

A voltage applied to an electron source

A frequency characteristic of an energization circuit including the device is determined with respect to the circuit diagram of FIG. 40A.

If an applied voltage Vin is set a superposition of the step function defined as Vin=V1×U(t)+V2×U(t−t1), a voltage Vout effectively applied to the device is given as follows:

Expression 15

$$Vout=[\exp(p\times t)\times\{-\cos(q\times t)+p/q\times\sin(q\times t)\}+1]\times V1+[\exp(p\times(t-t1))\times\{-\cos(q\times(t-t1))+p/q\times\sin(q\times t-t1))\}+1]\times V2\times U(t-t1) \quad \text{Eq. (5)}$$

where R, C, and L meet

Expression 16

$$(1/R/C)^2-4\times(1/L/C)<0$$

and p and q is the real part and the imaginary part of root x=α, β in

Expression 17

$$X^2+1/(R\times C)\times x+1/(L\times C)=0,$$

respectively (namely, α=p+jq), β=p−jq) A method of setting an applied voltage Vin and a "rise delay time" t1

In order to set a rise voltage not larger than an error threshold voltage V_up_th, applied voltage V1, V2, and the rise shifting time t1 must be set so as to meet Expression 18

$$V_up_th>Vout_total=[\exp(p\times t)\times\{-\cos(q\times t)+p/q\times\sin(q\times t)\}+1]\times V1+[\exp(p\times(t-t1))\times\{-\cos(q\times(t-t1))+p/q\times\sin(q\times(t-t1))\}+1]\times V2\times U(t-t1) \text{ with } t>0. \quad \text{Eq. (6)}$$

While the rise of a voltage pulse has been described, the fall of the voltage pulse will be the same.

Taking FIGS. 8C and 8D into account, there is a need to set applied voltage V1, V2, and the fall shifting time t2 meeting Expression 19

$$Vdown_th<Vout_total=-[\exp(p\times(t-t2)\times\{-\cos(q\times(t-t2))+p/q\times\sin(q\times(t-t2))\}+1]\times V1\times U(t-t2)-[\exp(p\times t)\times\{-\cos(q\times t)+p/q\times\sin(q\times t)\}+1]\times V2+V1+V2. \quad \text{Eq. (7)}$$

Accordingly, the applied voltage V1, V2, and the rise shifting time t1 and the fall shifting time t2 must be set so as to meet Equations (6) and (7) in order to control an abnormal voltage at the rise or fall of a pulse waveform.

In this specification which follows, the following four parameters are referred to as "ringing control parameters": the applied voltage V1, V2, and the rise shifting time t1 and the fall shifting time t2.

Re: A setting method of ringing control parameters

A setting of ringing control parameters is now described in detail.

A method of setting values of the applied voltage V1, V2 depends upon a parameter C in its following conditions:

(1) ζ>1;

(2) 0.05<ζ<1; and (3) ζ<0.05, where ζ represents a value to be calculated by

Expression 20

$$\zeta=1/R\times SQRT(L/C)$$

In case of (1), no ringing occurs, and the applied voltage V1, V2, and the shifting time t1, t2 may be set to arbitrary values.

In case of (2), a pulse large in applied voltage is at least introduced prior to a pulse small in applied voltage, thus making it possible to reduce an abnormal voltage.

Figure 9:
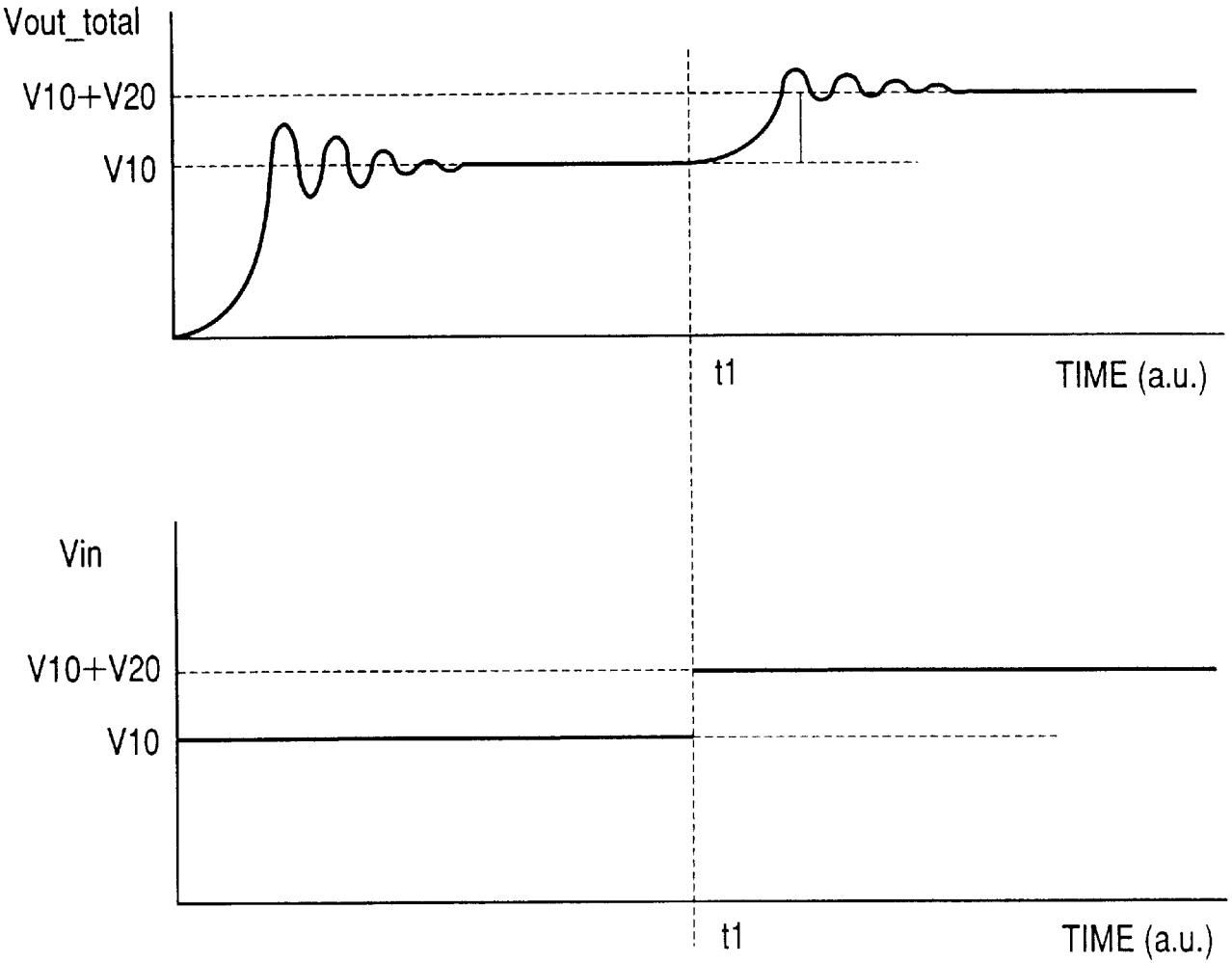
FIG. 9 is a view for explaining an applied voltage used for energization.

More specifically, in case of |V10|>|V20| as shown in FIG. 9, V20 is applied after a time period t1 elapses starting from applying V10, thus enabling the ringing to be reduced.

A method of setting Δt_up (rise shifting time) involves:

(1) adjusting a phase in a ringing waveform, and (2) waiting to sufficiently attenuate a ringing waveform.

(1) In the first place, adjusting a phase in a ringing waveform will be illustrated.

Δt_up is set π/q×k [sec] (where k is an integer not less than 1), thus resulting in reduced ringing.

(2) In the second place, waiting to sufficiently attenuate a ringing waveform will be illustrated.

V20 is introduced after the ringing in pulse is sufficiently attenuated by V10, thus resulting in reduced ringing.

This situation is illustrated in FIG. 9. In FIG. 9, after the time period t1 elapses after a pulse with the peak value V1is applied, a pulse with the peak value V2 is applied.

Preferably, the time period t1 is chosen so that a component exp(p×t) indicative of an attenuation in the ringing waveform may become 0.01 (1%) or less. In other words, exp(p×t1)=0.01 results in t1=−0.7433/p[sec].

A time period Δt_up larger than this period t1 enables an abnormal voltage value at an output Vout_total (=Vout_x+Vout_y) to be reduced.

The applied voltage V1, V2, and Δt_down(t2), which are parameters involved in the fall of pulse, can be obtained in the same manner.

In case of (3), with |V10|=|V20|, Δt_up is set (π/q)×k [sec] (where k is an integer not less than 1), thus resulting in reduced ringing.

The applied voltage V1, V2, and Δt_down(t2), which are parameters involved in the fall of pulse, can be obtained in the same manner.

Further, a vibrating voltage value should be taken into account if the ringing attenuation coefficient p of a waveform to be substantially applied to the electron source is small enough to continue to vibrate beyond a pulse width, or to continue to vibrate beyond a pulse period.

Figure 10:
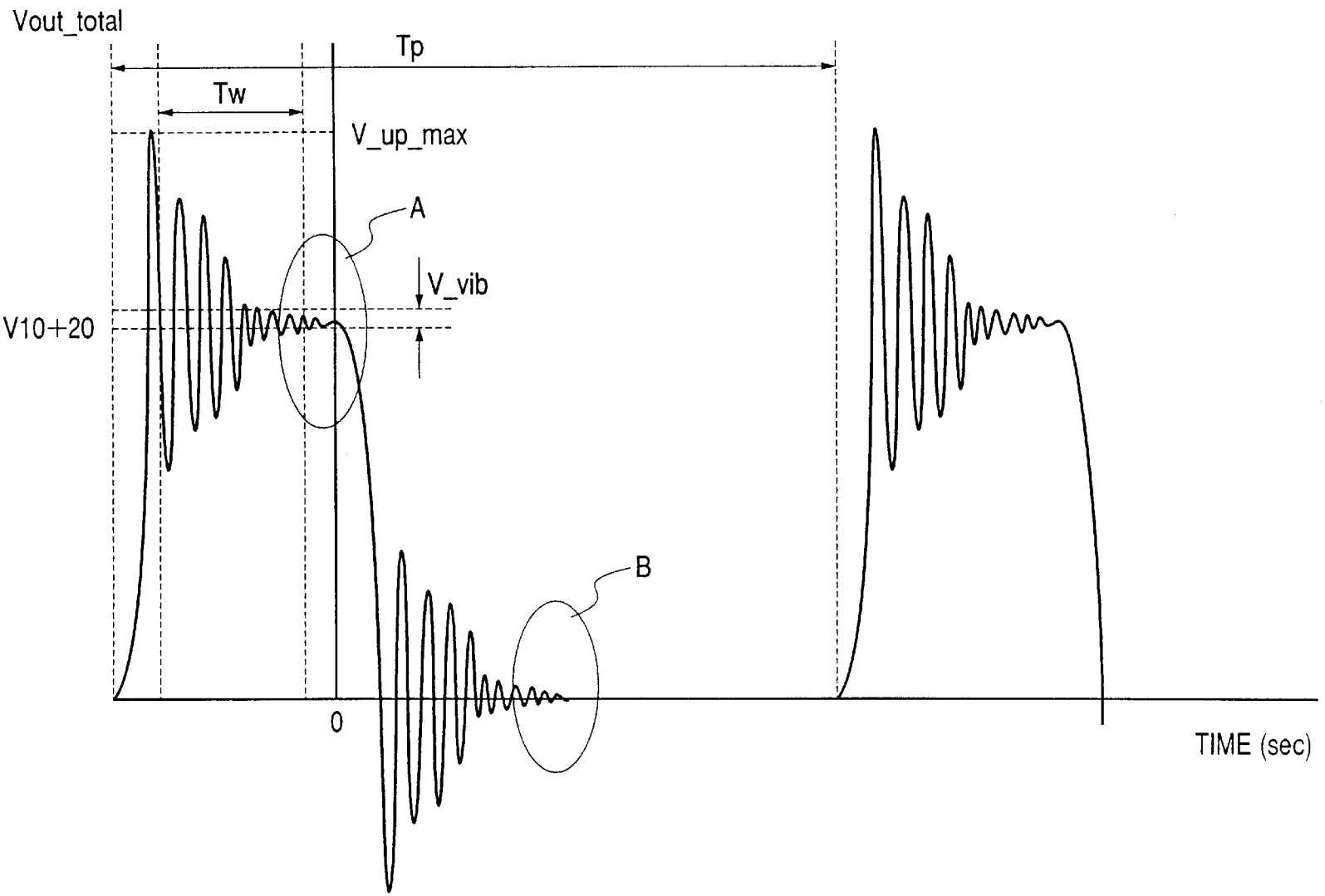
FIG. 10 is a ringing waveform diagram.

FIG. 10 shows that the ringing attenuation coefficient p is small enough to vibrate beyond a pulse width (Tw), as indicated by a portion A in this figure. In this case, a vibrating voltage V_vib must be taken into account to calculate the applied voltage V1, V2, and the fall shifting time t2. More specifically, the parameters must be selected so as to meet Expression 21

$$Vdown_th<Vout_total=-[\exp(p\times(t-t2)\times\{-\cos(q\times(t-t2))+p/q\times\sin(q\times(t-t2))\}+1]\times V1\times U(t-t2)-[\exp(p\times t)\times\{-\cos(q\times t)+p/q\times\sin(q\times t)\}+1]\times V2+V1+V2+V_vib. \quad \text{Eq. (8)}$$

The same consideration must further be taken if the ringing attenuation coefficient p is small enough to vibrate beyond a pulse period (Tp).

Employment of this method makes it possible to apply a voltage with a reduced abnormal voltage caused by the ringing. A setting condition is made variable A description will now be made of modulating and setting ringing control parameters of a voltage pulse in each process.

In order to perform an optimal voltage application in each process, a change in resistance of a surface conduction electron-emitting device is advantageously measured at any time to determine ringing control parameters according to the measured value since impedance fluctuates as time elapses during the process.

Figure 11:
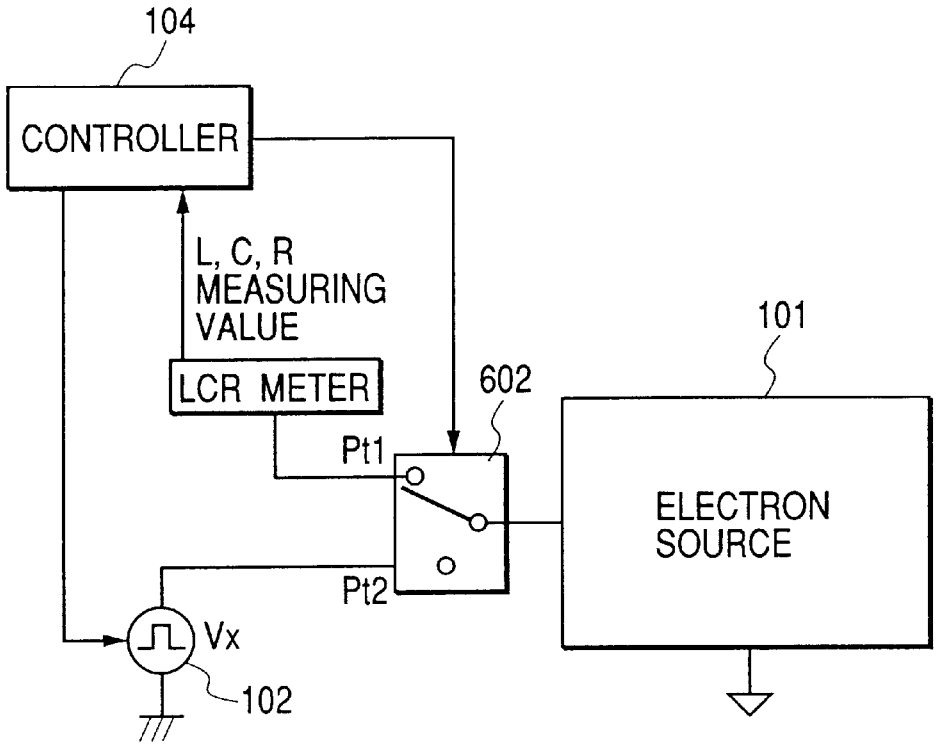
FIG. 11 is a schematic view showing an energization apparatus capable of inhibiting a ringing according to an impedance fluctuation during the energization process.

FIG. 11 shows a measurement system implemented by an LCR measurement system. FIG. 11 is such that an LCR measurement apparatus is inserted into the system shown in FIG. 6. The applied voltage V1, V2, and the shifting time t1, t2 meeting the above equations (6) and (7) are set according to the value measured by the LCR measurement apparatus.

The switch 602 is connected to the PT1 side for the LCR measurement to measure impedance. The switch 602 is connected to the PT2 side for the energization processes.

Employment of this method makes it possible to optimally apply a voltage even though a capacitance component or an inductance component of the device part changes. Applying voltages different in polarity from both electrodes FIG. 12 shows an electric connection view in which different voltages are applied to the electron source 101 from two electrodes to energize.

Figure 12:
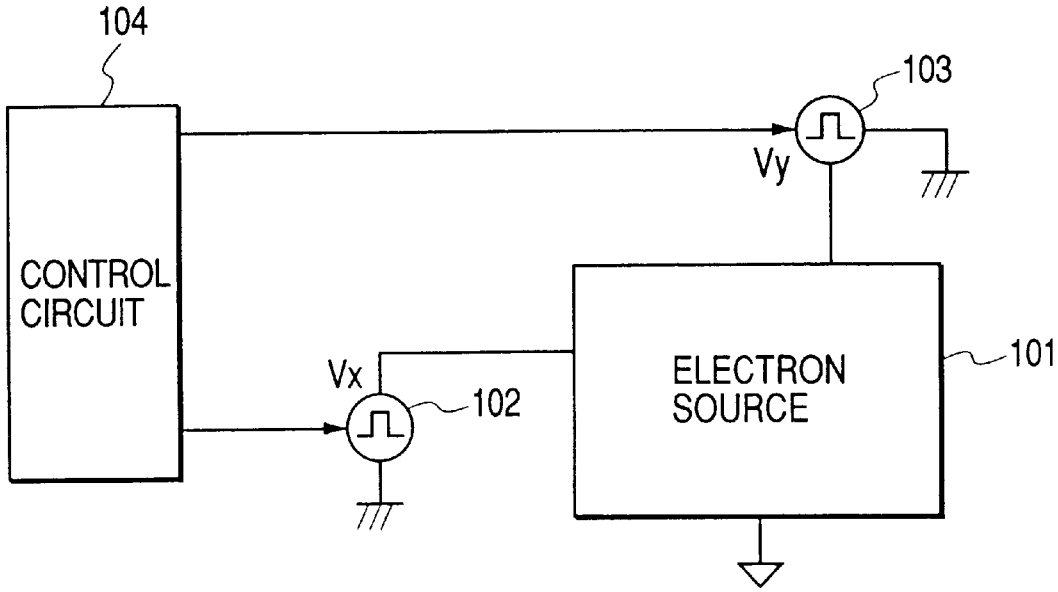
FIG. 12 is a schematic view showing an energization apparatus capable of inhibiting a ringing.
Figure 13B:
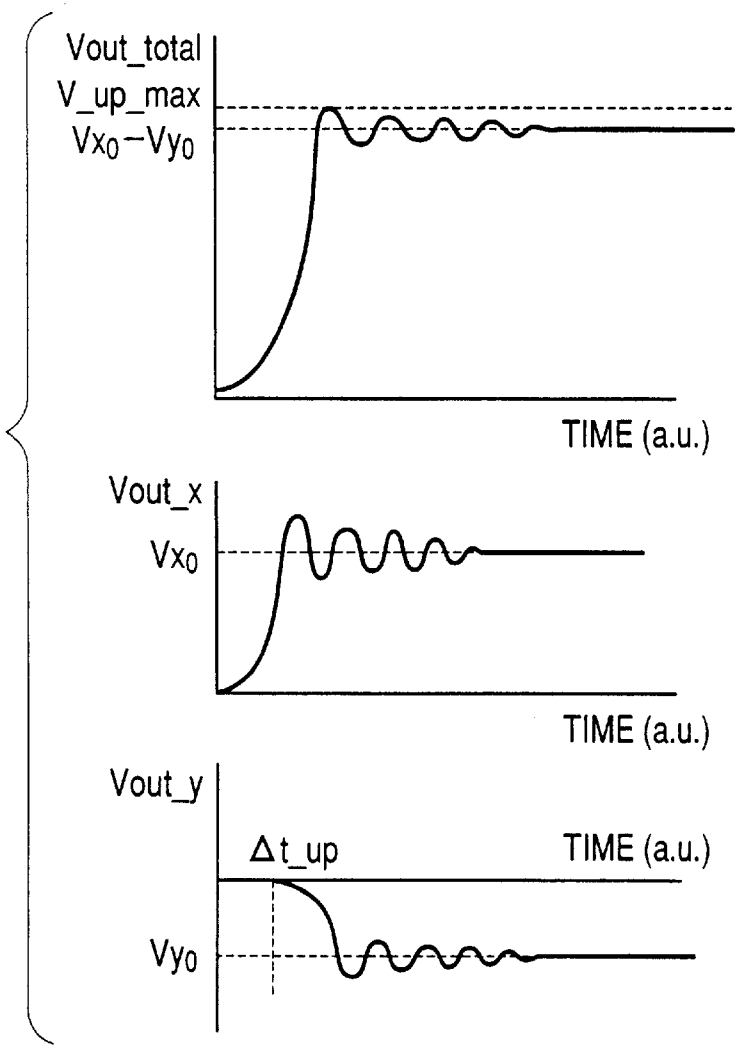
FIGS. 13A and 13B are views for explaining an applied voltage used for energization.
Figure 13A:
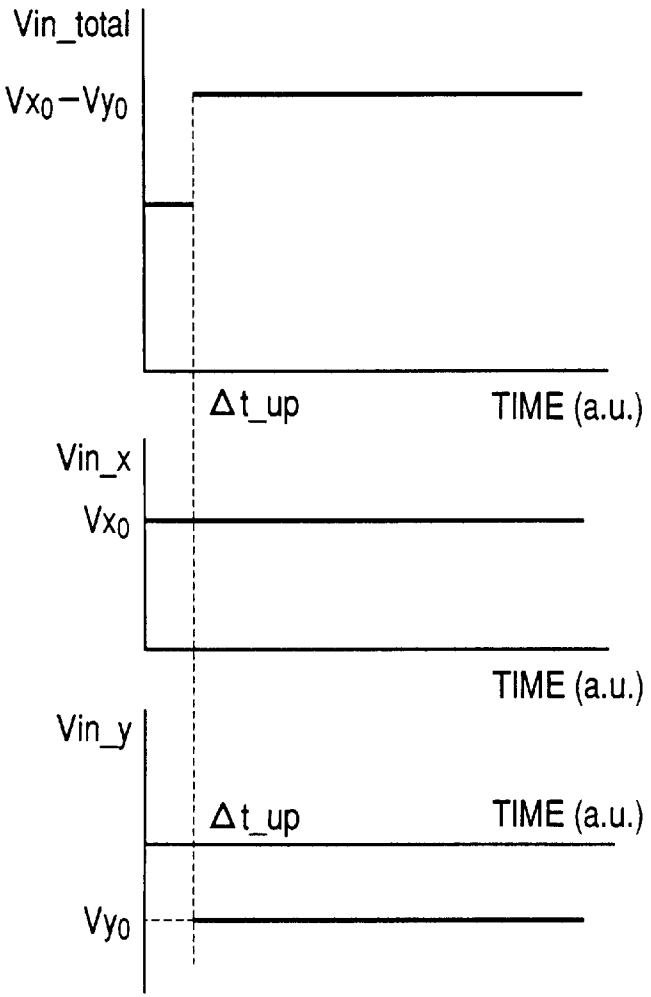

FIG. 13A shows a voltage waveform generated by the pulse power supplies 102 and 103 of FIG. 12, and FIG. 13B shows a voltage waveform to be effectively applied to the electron source (device) 101. FIGS. 13A and 13B show a portion associated with the rise of the voltage output by the power sources 102 and 103.

Here, an output voltage value of a row side power supply 102 is set Vx0 (>0) and an output voltage value of a column side power supply 103 is set Vy0 (<0). Given a voltage value required in the energization processes Vin_total0, a voltage is set so that Vin_total0=Vx0−Vy0 can be established.

An output voltage Vin_x and an output Vin_y are step functions defined as

Expression 22

$$Vin_x = Vx0 \times U(t)$$

$$Vin_y = Vy0 \times U(t - \Delta t_up)$$

where $U(t)=0(t<0)$ $U(t)=1(t>0)$, respectively.

FIG. 13B shows a voltage waveform to be effectively applied to the electron source (device) corresponding to the input voltage shown in FIG. 13A. Vout_x and Vout_y correspond to Vin_x and Vin_y, respectively.

Therefore, a voltage Vout_total to be substantially applied to the electron source becomes Vout_total=Vout_x Vout_y.

Here, the maximum value of a voltage to be applied to the electron source is indicated V_up_max, and the voltage Vx0, Vy0, and the rise delay time Δt_up must be set so that this voltage V_up_max may be reduced not larger than a "rise voltage error threshold voltage" V_up_th.

Figure 14B:
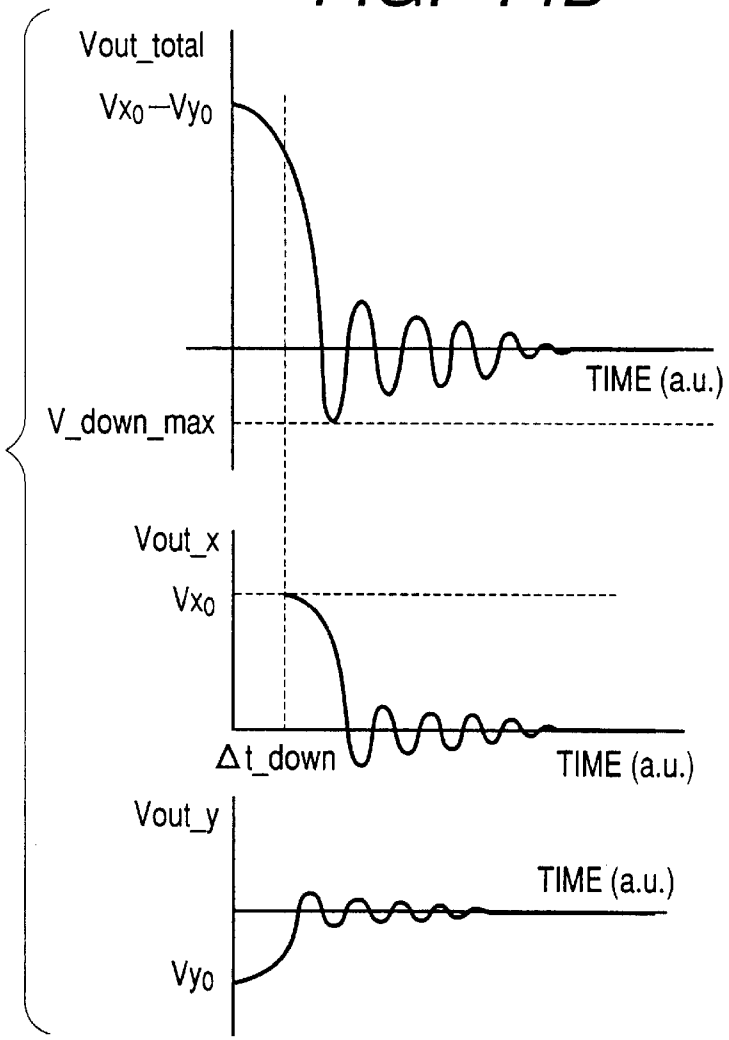
FIGS. 14A and 14B are views for explaining an applied voltage used for energization.
Figure 14A:
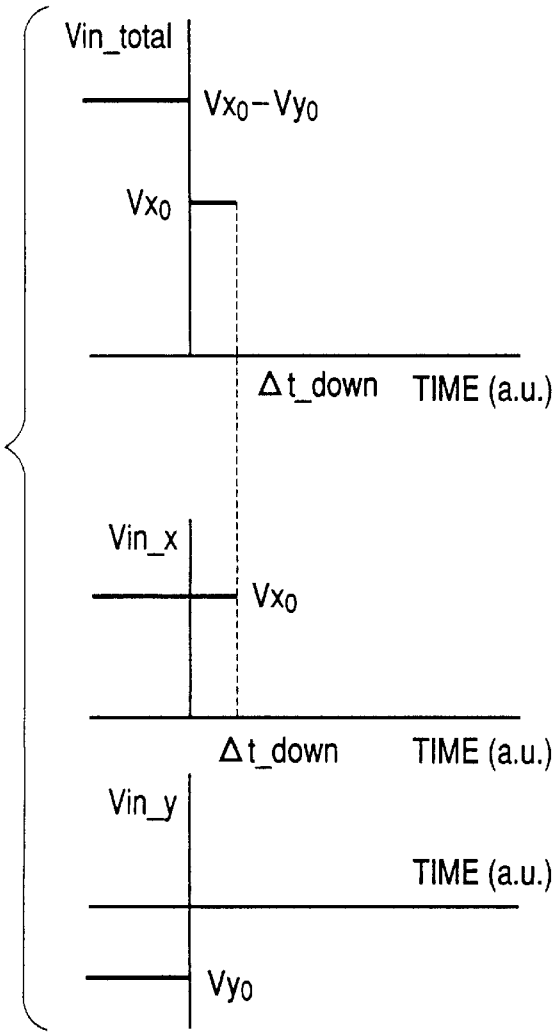

Then, a portion associated with the fall of the voltage output by the power sources 102 and 103 will be described with reference to FIGS. 14A. and 14B. FIG. 14A shows a voltage waveform generated by the power sources 102 and 103 of FIG. 12, and FIG. 14B shows a voltage waveform to be effectively applied to the electron source (device).

Here, an output voltage value of a row side power supply 102 is set Vx0 (>0) and an output voltage value of a column side power supply 103 is set Vy0 (<0). Given a voltage value required in the energization processes Vin total0, a voltage is set so that Vin_total0=Vx0−Vy0 can be established.

An output voltage Vin_x and an output Vin_y are step functions defined as

Expression 23

$$Vin_x = Vx0 \times U(-t + \Delta t_down)$$

$$Vin_y = Vy0 \times U(-t)$$

Where $U(t)=0(t<0)$ $U(t)=1(t \geqq 0)$, respectively.

FIG. 14B shows a voltage waveform to be actually applied to the electron source (device) corresponding to the input voltage shown in FIG. 14A. Vout_x and Vout_y correspond to Vin_x and Vin_y, respectively.

Therefore, a voltage Vout_total to be substantially applied to the electron source becomes Vout_total=Vout_x−Vout_y.

Here, the minimum value of a voltage to be applied to the electron source is indicated V_down_max, and the voltage Vx0, Vy0, and the fall delay time Δt_down must be set so that this voltage V_down_max may be reduced not larger than a "falling voltage error threshold voltage" V_down_th. Setting an applied voltages Vx and Vy, and a "rise shifting time" Δt A method of setting a condition to suppress occurrence of an abnormal voltage is described.

In the respective energization processes, impedance of a simple matrix circuit including an electroconductive thin film or a surface conduction electron-emitting device fluctuates as time elapses. Therefore, there is a need to set a condition according to the impedance fluctuation.

As a condition setting method are employed (1) a method of fixing and setting applied voltage Vx0, Vy0, and a "shifting time" Δt at optimal values in each process, and (2) a method of modifying applied voltage Vx0, Vy0, and a "shifting time" Δt to optimal values in accordance with the impedance fluctuation in each process.

The structure and operational effect will now be described.

Fixing and setting at optimal values

First, the case where applied voltages Vx0 and Vy0, and the rise shifting time Δt_up are fixed and set at optimal values in each process is described.

The main component of the impedance fluctuation in each process results from a change in resistance of an electroconductive thin film or a surface conduction electron-emitting device. A pre-evaluation of the change in resistance of a surface conduction electron-emitting device makes it possible to evaluate a voltage actually applied to an electron source.

A voltage to be applied to an electron source

A frequency characteristic of an energization circuit including the devices is determined with respect to the circuit diagram of FIG. 40A (for a single device) and FIG. 50A (for simple matrix wiring).

Given that the applied voltage Vin_x outputted from a pulse power supply be a step function, a voltage Vout_x effectively applied to the electron source is defined as below, where R=R1//R2//R3// . . . //Rn for the circuit diagram shown in FIG. 50A.

Expression 24

$$Vout_x = [esp(p \times t) \times \{-\cos(q \times t) + p/q \times \sin(q \times t)\} + 1 \times Vin_x \quad \text{Eq. (9)}$$

where T, C, and L meet

Expression 25

$(1/R/C)2-4\times(1/L/C)$ and p and q is the real part and the imaginary part of root $x=\alpha, \beta$ in Expression 26

$x^2+1/(R\times C\times x+1/(L\times C)=0$, respectively (namely, $\alpha=p+jq$), $\beta=p-jq$)

Also, in the same way, given that the applied voltage Vin__y be a step function, a voltage Vout__y to be effectively applied to the electron source is defined as below.

Expression 27

$$Vout__y=[\exp(p\times t)\times\{-\cos(q\times t)+p/q\times\sin(q\times t)\}+1]\times Vin__y \quad \text{Eq. (10)}$$

If an applied voltage Vin__y at the row side is applied with a delay of Δt__up from the column side, a waveform is defined as below, as shown in FIGS. 13A and 13B.

Expression 28

$$Vout__y'=[\exp(p\times(t-\Delta t__up))\times\{-\cos(q\times(t-\Delta t__up))+p/q\times\sin(q\times(t-\Delta t__up))\}+1]\times Vin__y\times U(t-\Delta t__up) \quad \text{Eq. (11)}$$

where $U(t)=(t<0)$ $U(t)=(t\geqq 0)$

Therefore, the output voltage Vout__total shown in FIGS. 13A and 13B becomes Expression 29

$$Vout__total=Vout__x-Vout__y=[\exp(p\times t)\times\{-\cos(q\times t)\}+1]\times Vin__x-[\exp(p\times(t-\Delta t__up))\times\{-\cos(q\times(t-\Delta t__up))+p/q\times\sin(q\times(t-\Delta t__up))\}+1]\times Vin__y\times U(t-\Delta t__up). \quad \text{Eq.(12)}$$

A method of setting applied voltages Vin__x and Vin__y, and a "rise delay time" Δt__up In order to set a rise voltage not larger than an error threshold voltage V__up__th, applied voltage Vin__x, Vin__y, and the rise shifting time Δt__up must be set so as to meet Expression 30

$$V__up__th>Vout__total=[\exp(p\times t)\times\{-\cos(q\times t)+p/q\times\sin(q\times t)\}+1]\times Vin__x-[\exp(p\times(t-\Delta t__up))\times\{-\cos(q\times(t-\Delta t__up))+p/q\times\sin(q\times(t-\Delta t__up))\}+1]\times Vin__y\times U(t-\Delta t__up). \quad \text{Ep. (13)}$$

While the rise of a voltage pulse has been described, the fall of the voltage pulse will be the same. As shown in FIGS. 14A and 14B, in which the rise shifting time Δt__down is employed for Vin__x, there is a need to set applied voltage Vin__x, Vin__y, and the fall shifting time Δt__down meeting Expression 31

$$V__down__th<Vout__total=-[\exp(p\times(t-\Delta t__down))\times\{-\cos(q\times(t-\Delta t__down))+p/q\times\sin(q\times(t-\Delta t__down))\}+1]Vin__x\times U(-t+\Delta t__down)+[\exp(p\times t)\times\{-\cos(q\times t)+p/q\times\sin(q\times t)\}+1]\times vin__y+(Vin__x-Vin__y). \quad \text{Eq. (14)}$$

Accordingly, the applied voltage Vin__x, Vin__y, and the rise shifting time Δt__up and the fall shifting time Δt__down must be set so as to meet Equations (13) and (14) in order to control an abnormal voltage at the rise or fall of a pulse waveform.

In this specification which follows, the following four parameters are referred to as "ringing control parameters": the applied voltages Vin__x and Vin__y, and the rise shifting time Δt__up and the fall shifting time Δt__down. Re: A setting method of ringing control parameters A method of setting ringing control parameters will now be described in more detail.

A method of setting values of the applied voltage Vin__x, Vin__y depends upon a parameter ζ in its following conditions:

(1) $\zeta>1$;

(2) $0.05\leqq\zeta<1$; and (3) $\zeta<0.05$, where ζ represents a value to be calculated by Expression 32

$\zeta=1/R\times SQRT\ (L/C)$.

In case of (1), no ringing occurs, and the applied voltage Vin__x, Vin__y, and the shifting time Δt__up, Δt__down may be set to arbitrary values.

In case of (2), a pulse large in an applied voltage is at least introduced prior to a pulse small in an applied voltage, thus making it possible to achieve a reduced abnormal voltage.

Figure 15A:
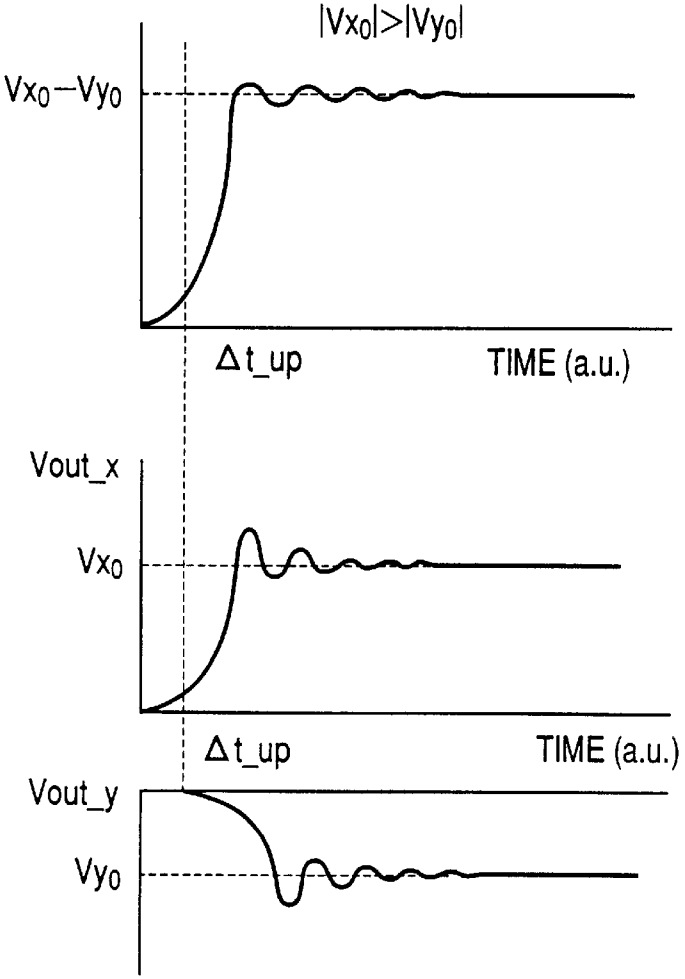
FIGS. 15A and 15B are views for explaining an applied voltage used for energization.

More specifically, in case of $|Vx0|>|Vy0|$ as shown in FIG. 15A, Vin__y is applied after Δt__up elapses starting from applying Vin__x, thus enabling the ringing to be reduced.

A method of setting Δt__up involves:

(1) adjusting a phase in a ringing waveform, and (2) waiting to sufficiently attenuate a ringing waveform.

(1) In the first place, adjusting a phase in a ringing waveform will be illustrated.

Δt__up is set $(\pi/q)\times k$ [sec] (where k is an integer not less than 1), thus resulting in reduced ringing as shown in FIG. 15A.

(2) In the second place, waiting to sufficiently attenuate a ringing waveform will be illustrated.

Also, Vy0 is introduced after the ringing in pulse is sufficiently attenuated by Vx0, thus resulting in reduced ringing.

Figure 16:
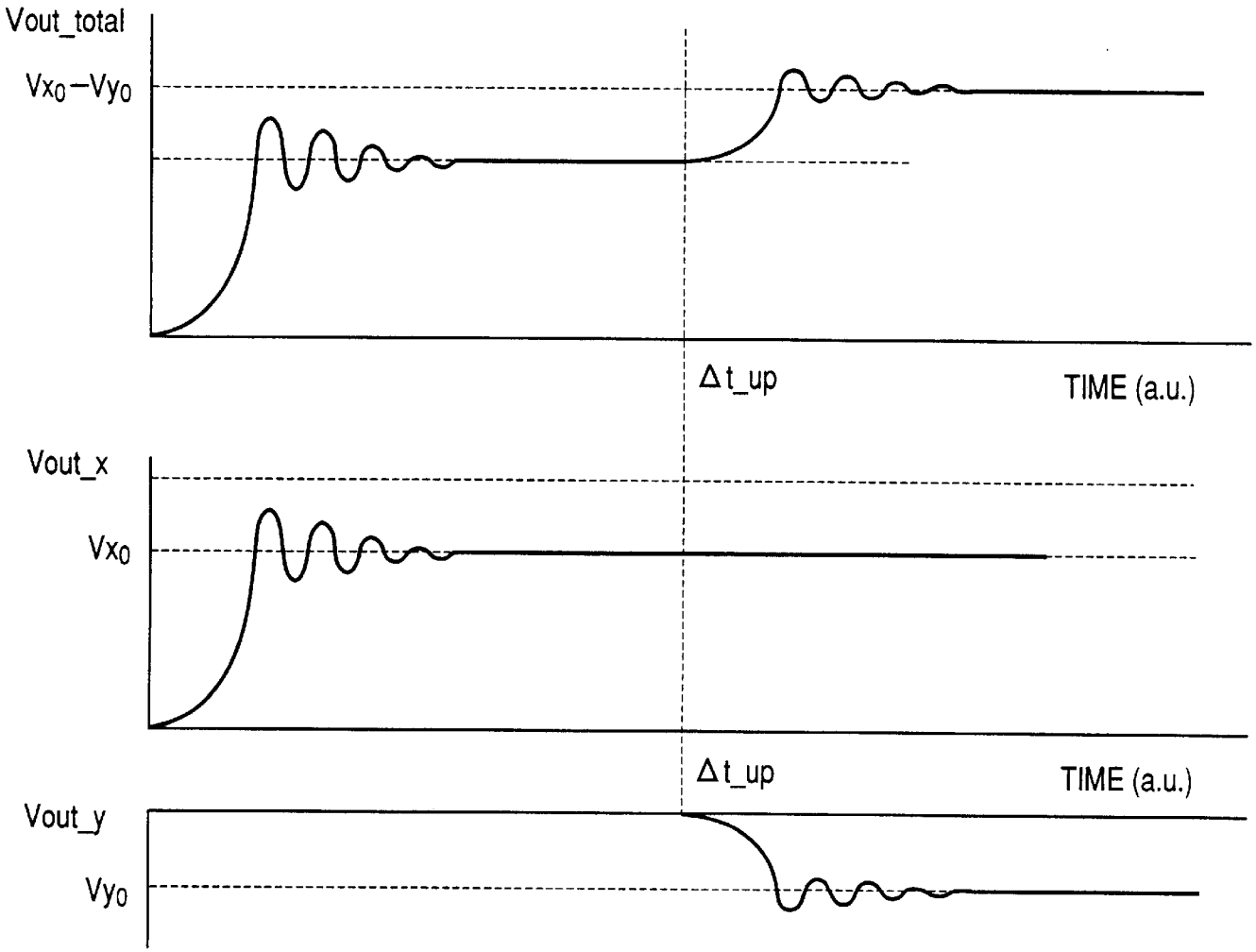
FIG. 16 is a view for explaining an applied voltage used for energization.

This situation is illustrated in FIG. 16. In FIG. 16, after a time period Δt__up elapses after a pulse with the peak value Vx0 is applied, a pulse with the peak value Vy0 is applied.

Advantageously, the time period t1 is chosen so that a component $\exp(p\times t)$ indicative of an attenuation in the ringing waveform may become on the order of 0.01 (1%). In other words, $\exp(p\times t)=0.01$ results in $t1=-0.733/p$[sec]. A time period Δt__up larger than this t1 is chosen to reduce an abnormal voltage value of the output voltage Vout__total (=Vout__x+Vout__y).

The applied voltage Vin__x, Vin__y, and Δt__down, which are parameters involved in the fall of pulse, can be obtained in the same manner.

Figure 15B:
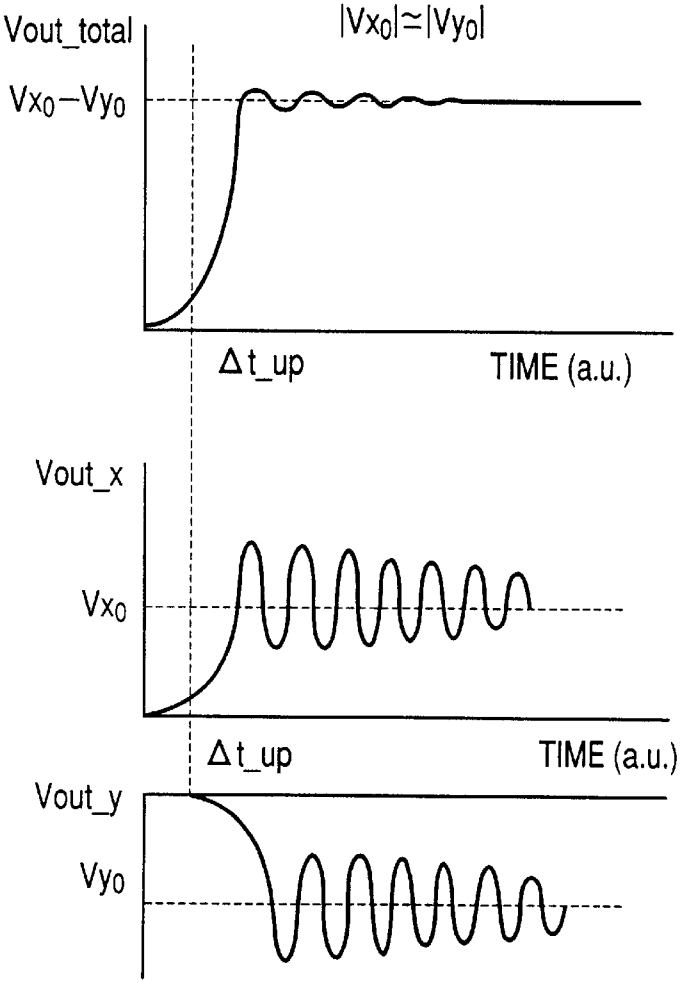

In case of (3), with $|Vx0|=|Vy0|$, Δt__up is set to $\pi/q\times k$ [sec] (where k is an integer not less than 1), thus resulting in reduced ringing (see FIG. 15B).

The applied voltages Vin__x and Vin__y, and Δt__down, which are parameters involved in the fall of pulse, can be obtained in the same manner.

In the foregoing description, the rise shifting time Δt__up is implemented in the row side output voltage Vin__x, which is not restrictive. Also, the fall shifting time Δt__down is implemented in the column side output voltage Vout__x, which is not restrictive.

Further, a vibrating voltage value should be taken into account if the ringing attenuation coefficient p of a waveform to be substantially applied to the electron source is small enough to continue to vibrate beyond a pulse width, or to continue to vibrate beyond a pulse period.

FIG. 10 shows that the ringing attenuation coefficient p is small enough to vibrate exceeding a pulse width (Tw), as indicated by a portion A in this figure. In this case, a vibrating voltage V_vib should be taken into account to calculate the applied voltages Vin_x and Vin_y, and the fall shifting time Δt_down. More specifically, the parameters must be selected so as to meet Expression 33

$$V_down_th < Vout_total = -[\exp(p\times(t-\Delta t_down))\times\{-\cos(q\times(t-\Delta t_down))+p/q\times\sin(q\times(t-\Delta t_down))\}+1]\times Vin_x\times U(-t+\Delta t_down)+[\exp(p\times t)\times\{-\cos(q\times t)+p/q\times\sin(q\times t)\}+1]\times Vin_y+(Vin_x-Vin_y)V_vib. \quad \text{Eq. (15)}$$

The same consideration must further be taken if the ringing attenuation coefficient p is small enough to vibrate exceeding a pulse period (Tp).

Employment of the foregoing method makes it possible to apply a voltage with a reduced abnormal voltage caused by the ringing.

A setting condition is made variable

Next, a description is made of modulating and setting ringing control parameters of a voltage pulse in each process.

In order to perform an optimal voltage application in each process, a change in resistance of a surface conduction electron-emitting device is advantageously measured at any time to determine the ringing control parameters according to the measured value since impedance fluctuates as time elapses during the process.

Figure 17:
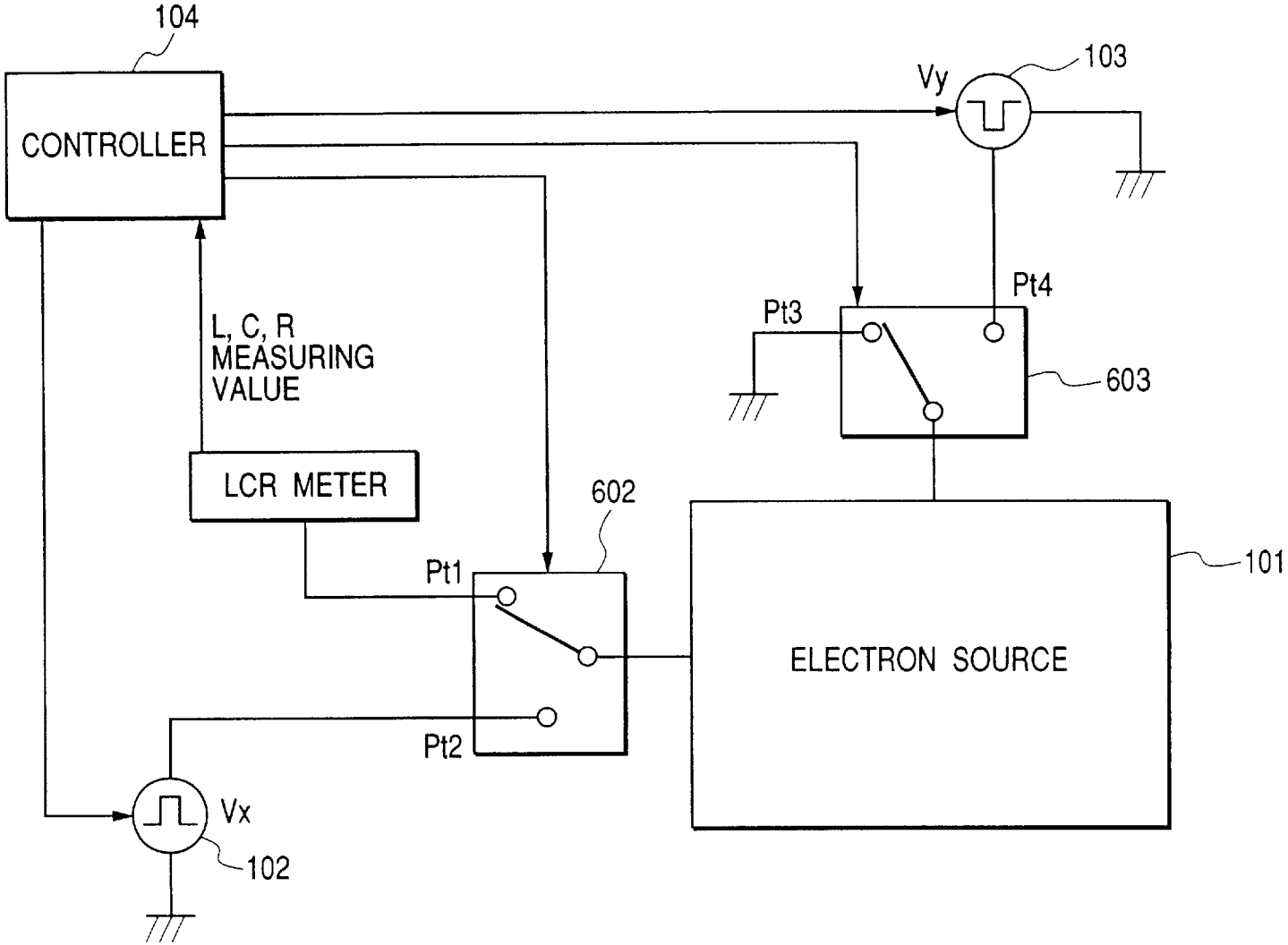
FIG. 17 is a schematic view showing an energization apparatus capable of inhibiting a ringing according to an impedance fluctuation during the energization process.

FIG. 17 shows a measurement system implemented by an LCR measurement system. FIG. 17 is such that an LCR measurement apparatus is inserted into the system shown in FIG. 12. The applied voltage Vin_x, Vin_y, and the delay time Δt meeting the above equations (13) and (14) are set according to the value measured by the LCR measurement apparatus.

The switches 602 and 603 are respectively connected to the PT1 side and PT3 side for the LCR measurement to measure impedance. The switches 602 and 603 are respectively connected to the PT2 side and PT4 side for the energization processes.

Employment of this method makes it possible to optimally apply a voltage even though a capacitance component or an inductance component of the device part changes.

It will be noted that the present invention that has been described may be preferably applied not only to a surface conduction electron-emitting device but also to the previously stated field emission type electron-emitting device or an (a two-terminal type) electron-emitting device having a pair of electroconductive members such as a MIN type electron-emitting device, in particular a cold cathode device. Further, if the present invention is applied to devices other than such a surface conduction electron-emitting device, the energization operations other than the forming operation are preferably applicable.

Prior to the preferred embodiments to which the present invention is applied, a brief description is made hereinafter of the structure of an image-forming apparatus used in the following embodiments to which an electron source of a surface conduction electron-emitting device is applied and a method of manufacturing the same.

(The structure of an image-forming apparatus and a method of manufacturing the same).

The structure of an exemplified image-forming apparatus to which the present invention is applied and a method of manufacturing the same will be specifically described by way of example.

Figure 42:
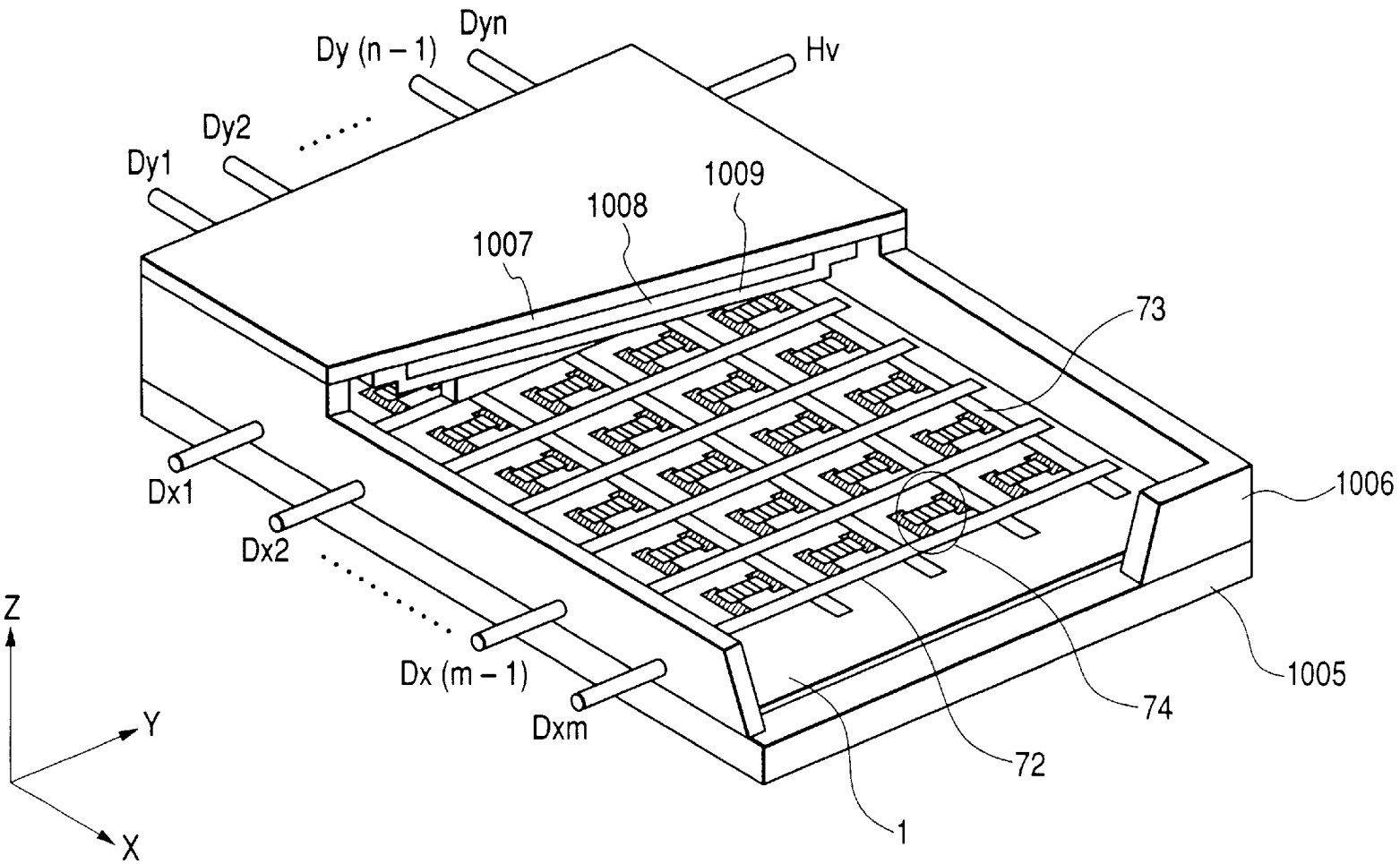
FIG. 42 is a perspective view showing an image display device a portion of which is cut away.

FIG. 42 is a perspective view showing a display panel used in the present embodiment, with a portion of the panel cut away for clarifying the internal structure thereof.

In this figure, reference numeral 1005 denotes a rear plate; 1006, a side wall; and 1007, a face plate. The components designated by reference numerals 1005 to 1007 constitute an airtight container with which the internal is kept in vacuum. The airtight container must be sealed for assembly to maintain sufficient strength and airtight characteristic at the joints of the respective members. The sealing is achieved, for example, by coating the joints with frit glass and burning it at 400° C. to 500° C. in an atmosphere or in a nitrogen atmosphere for 10 minutes or more. A method of evacuating the airtight container will be described later.

A substrate 1 is fixed to the rear plate 1005, on which m by n surface conduction electron-emitting devices 74 are formed. The surface conduction electron-emitting devices are arranged in so-called simple matrix wiring by row-directional wiring 72 and column-directional wiring 73. A part constituted by the substrate 1, the electron-emitting devices 72, the wirings 73, 74 is called an electron source substrate. A method of manufacturing the electron source substrate or the structure thereof will be described later in detail.

In the present embodiment, the substrate 1 of the electron source substrate is fixed to the rear plate 1005 of the airtight container. However, the substrate 1 of the electron source substrate may be used as a rear plate of the airtight container so long as the substrate 1 of the electron source substrate has a sufficient strength.

A fluorescent film 1008 that is an image-forming member is formed on the lower surface of the face plate 1007. In the present embodiment, a red phosphor is used.

A metal pack 1009 commonly known in the field of CRT is formed on the surface of the rear plate side of the fluorescent film 1008. The metal pack 1009 is intended to specularly reflect a portion of light emitted from the fluorescent film 1008 to enhance an optical utilization factor, to protect the fluorescent film 1008 from impingement of negative ions, to serve as an electrode for applying an electron acceleration voltage, or to serve as an electroconductive passage of the electron that excites the fluorescent film 1008. The metal pack 1009 is formed by forming the fluorescent film 1008 on the face place substrate 1007, where the surface of the fluorescent film is then smoothed, and vacuum evaporating Al. The metal pack 1009 is not used if a low voltage phosphor material is used for the fluorescent film 1008.

Although not used herein, transparent electrodes, for example, made of an ITO may be formed between the face plate substrate 1007 and the fluorescent film 1008 for the purpose of applying an acceleration voltage or of an improvement of electroconductivity of the fluorescent film.

Designated by Dx1 to Dxm, Dy1 to Dyn, and Hv are electric connection terminals in the airtight structure to electrically connect the present image-forming apparatus and not-shown electric circuits. The terminals Dx1 to Dxm, Dy1 to Dyn, and Hv are electrically connected to the row-directional wiring 72 on the electron source substrate, the column-directional wiring 73 on the electron source substrate, and the metal pack 1009 of the face plate, respectively.

In order to evacuate the airtight container, the airtight container is assembled in a vacuum atmosphere. Alternatively, after the airtight container has been assembled, an exhaust tube and a vacuum pump (not shown) are connected to each other, an air is exhausted in the airtight container up to a vacuum of about $10^{-7}$ [Torr], and afterward the exhaust tube is sealed to evacuate the airtight container. Furthermore, a getter film (not shown) may be formed in position on the interior of the airtight container just before or after the sealing to maintain a vacuum in the airtight container. The getter film used herein is a film formed by heating and evaporating a getter material mainly containing, for example, Ba by a heater or a high frequency heating. The absorption effect of the getter film allows the airtight container to be kept at a vacuum of $1\times10^{-5}$ to $1\times10^{-7}$ [Torr].

The basic structure of an image-forming apparatus and a production process thereof in accordance with one embodiment of the present invention ha, been described.

Next, a manufacture method of the electron source substrate is described.

The basic structure, a production process and a characteristic of a surface conduction electron-emitting device, which are advantageously implemented in the present invention, are first described.

A typical surface conduction electron-emitting device includes those of a planar type and a step type. The specification which follows only refers to that of a planar type.

Figure 43A:
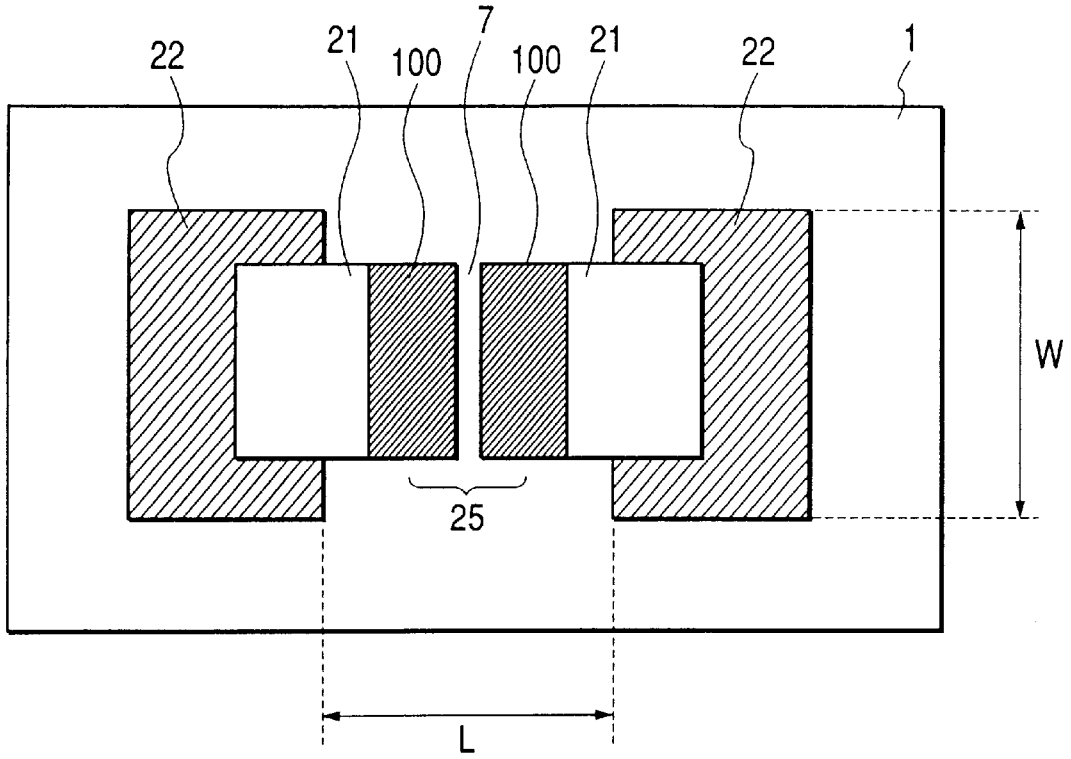
FIGS. 43A and 43B are a plan view and a sectional view, respectively, showing a surface conduction electron-emitting device of a planar type which is implemented in the embodiment of the present invention.
Figure 43B:
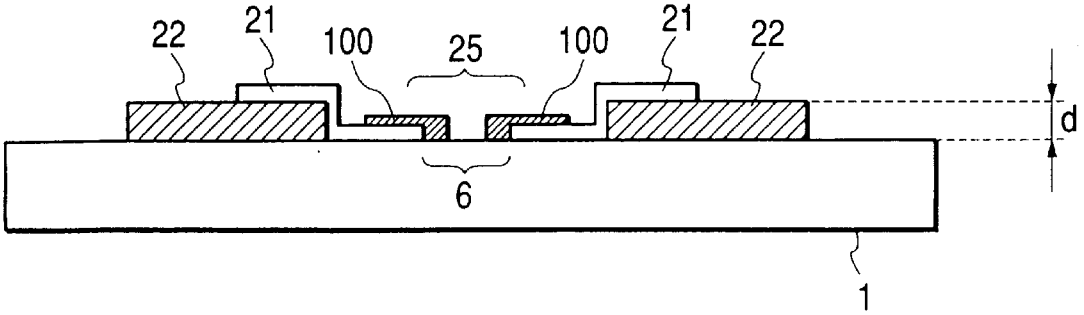

A device structure of a planar type surface conduction electron-emitting device and a production process thereof are described. FIGS. 43A and 43B respectively show a plan view and a sectional view for explaining the structure of a planar type surface conduction electron-emitting device. In these figures, reference numeral 1 denotes a substrate; 22, an electrode; 21, an electroconductive thin film; 25, an electron-emitting region; 6, a second gap formed through the energization forming operation; 100, a thin film formed by the energizing activation operation; and 7, a first gap formed through the activation operation.

As the substrate 1 may be employed, for example, various glass substrates made of quartz glass or soda lime glass, various ceramic substrates, or a substrate formed by laminating an insulating layer made of, e.g., $SiO_2$ on these various substrates.

The device electrodes 22 formed on the substrate 1 so as to face the substrate surface in parallel are each made of a material with electroconductivity. The material including metals such as Ni, Cr, Au, Mo, W, Pt, Ti, Cu, Pd, or Ag, or alloy thereof, a metallic oxide such as $In_2O_3$—$SnO_2$, or a semiconductor such as polysilicon may be suitably selected. A formation of the electrodes may be easily performed by a combination of film forming techniques such as vacuum evaporation and patterning such as photolithography or etching, but any other technique (e.g., a printing) may also be used.

The configuration of each device electrode 22 is appropriately designed for the purpose of applying the electron-emitting device. Typically, an interval L between the electrodes is suitably selected in a range from hundreds of Å to hundreds of micrometers, and preferably, a range from several micrometers to tens of micrometers in particular to apply it to a display device. Also, a thickness d of each electrode is suitably selected in a range from hundreds of Å to several micrometers.

A molecular film may be used for the electroconductive thin film 21. The molecular film used herein indicates a film including a number of molecules as constituent elements (also including an island-like collection). Microscopically inspecting the molecular film, it is typically observed that individual molecules are spacedly arranged, individual molecules are adjacent to one another, or individual molecules are superposed onto one another. Each molecule used for the molecular film has a grain diameter within a range from several Å to thousands of Å, preferably within a range from 10 Å to 200 Å in particular.

The film thickness of the electroconductive thin film 21 is suitably set taking such conditions as below into account: a condition necessary to succeed in electrically connection with the device electrodes 22, a condition necessary to succeed in the energization forming as will be described later, a connection necessary to set electric resistance of the electroconductive thin film at a suitable value as will be described later, and so on.

More specifically, the film thickness of the electroconductive thin film 21 is set within a range from several Å to thousands of Å, preferably within a range from 10 Å to 500 Å in particular.

Possible materials to form the electroconductive thin film 21 include metal such as Pd, Pt, Ru, Ag, Au, Ti, In, Cu, Cr, Fe, Zn, Sn, Ta, W, or Pb, oxide such as PdO, $SnO_2$, $In_2O_2$, PbO, or $Sb_2O_2$, boride such as $HfB_2$, $ZrB_2$, $LaB_6$, $CeB_6$, $YB_4$, or $GdB_4$, carbide such as TiC, ZrC, HfC, TaC, SiC, or WC, nitride such as TiN, ZrN, or HfN, a semiconductor such as Si or Ge, or a carbon, which are suitably selected.

A sheet resistance value of the electroconductive thin film 21 is preferably set to fall within a range from $10^3$ to $10^7$ [Ω/sq].

Since the electroconductive thin film 21 and the device electrodes 22 are desired to succeed in an electrically connection with each other, these are partially superposed. The superposition is exemplified in FIG. 43B in which the substrate, the device electrodes and the electroconductive thin film are laminated in the order named from below. In some cases, the substrate, the electroconductive thin film, and the device electrodes may be laminated in the order named from below.

While the electron-emitting device adopts the device electrodes 22 in this embodiment, the electrodes 22 are not necessarily required. Therefore, the electron-emitting device advantageously implemented in the present invention may be constituted by the electroconductive film 21, the carbon film 100, the first gap 7, and the second gap 6.

The electron-emitting region 25 indicates the vicinity of the first gap 7 and/or the second gap 6.

The gap 6 may contain molecules each having a grain diameter of several Å to hundreds of Å.

It is difficult to exactly or precisely depict the position or configuration of the actual electron-emitting region, which are schematically depicted in FIGS. 43A and 43B.

The thin film 100 is preferably a carbon film made of a carbon or carbon compound, and covers the second gap 6 and the vicinity thereof. In FIGS. 43A and 43B, the carbon film 100 is shown as a pair of carbon films defined by the first gap 7 as a boundary. This results from a pulse with both polarities which is used in the activation operation for a voltage pulse to be applied to the electroconductive film 21. However, if a voltage pulse having either polarity is applied in the activation operation, a different form from that shown in FIGS. 43A and 43B is obtained in which the carbon film 100 is formed only at either side relative to the gap 7.

The thin film 100 is made of any of monocrystal graphite, polycrystalline graphite, and amorphous carbon, or a mixture thereof, with a film thickness of 500 [Å] or less, preferably 300 [Å] or lees.

While the basic structure of a preferred device has been described, devices as below are used in the present embodiment.

That is, soda lime glass is used for the substrate 1, a Ni thin film is used for the device electrodes 22. The thickness d of each of the device electrodes is 1000 [Å], and an interval L between the electrodes is 2 [micrometer].

The electroconductive thin film is mainly made of Pd or PdO, with a thickness of about 100 [Å] and a width of 100 [micrometer].

Now, a production method of an electron-emitting device advantageously implemented in the present invention is described.

FIGS. 44A to 44F are sectional views for explaining a production process of the electron-emitting device, in which the same members are designated by the same reference numerals of FIGS. 43A and 43B.

1) First, a pair of device electrodes 22 is formed on a substrate 1 as shown in FIG. 44A.

Prior to a formation, the substrate 1 is sufficiently cleansed in advance by using detergent, pure water, or organic solvent, and then the materials of the device electrodes are deposited thereon. The materials are advantageously deposited by vacuum deposition such as evaporation or sputtering. Afterward, the deposited electrode materials are patterned by photolithography/etching to form the pair of device electrodes 22 shown in FIG. 44A.

2) Then, the electroconductive thin film 21 is formed as shown in FIG. 44B.

Prior to a formation, an organic metal solution is coated to the substrate 1 of FIG. 44A, which is then dried, heated/burned to deposit an electroconductive thin film thereon, and thereafter patterned into a desired configuration by photolithography/etching. The organic metal solution herein is a solution of an organic metal compound containing the materials used for the electroconductive thin film as main elements. More specifically, Pd is used as a main element in the Present embodiment. In the present embodiment, dipping is used as a coating technique. However, any other technique such as spinning or spraying may also be employed.

As deposition of an electroconductive thin film, vacuum evaporation, sputtering, or chemical vapor phase deposition may be employed other than a technique of coating an organic metal solution used in the present embodiment.

3) Then, as shown in FIG. 44C, an appropriate pulse voltage is applied between the pair of device electrodes 22 from a forming power supply 24 to perform an energization forming operation to form a second gap 6 (an electron-emitting region 25).

The energization forming operation is an operation of making a current flow to the electroconductive thin film 21 a portion of which a second gap 6 is formed in. The electric resistance measured between the pair of device electrodes 22 significantly increases after the second gap 6 is formed, as compared to before it is formed.

Figure 45:
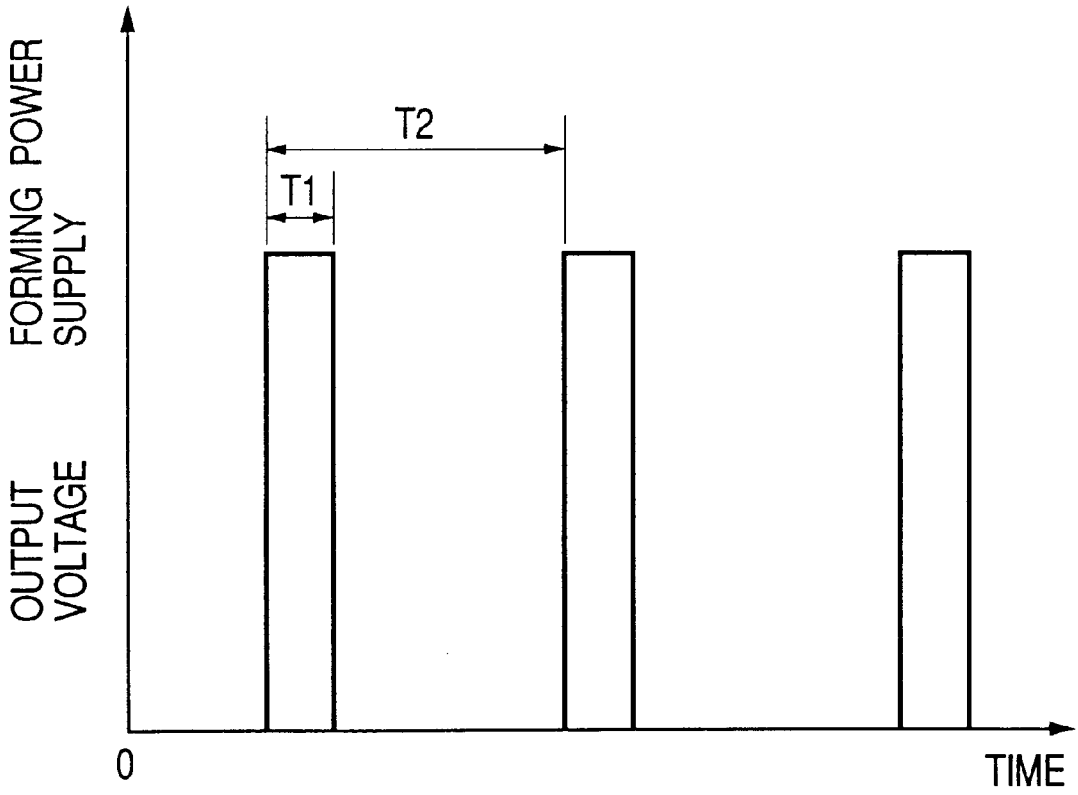
FIG. 45 is a view showing an applied voltage waveform during the energization forming operation.

For more clarity of the energization step, FIG. 45 shows an example of a waveform of an appropriate pulse voltage to be applied from the forming power supply 24. In the present embodiment, as apparent from FIG. 45, a rectangular pulse of a pulse width T1 is sequentially applied at a pulse interval T2. In this connection, the rectangular pulse has a constant peak value Vpf. A formation of the gap 6 (electron-emitting region 25) is measured by an ammeter 23.

For example, in a vacuum atmosphere on the order of $10^{-5}$ [Torr], the pulse width T1 is set 1 [msec], the pulse interval T2 is set 10 [msec], and the peak value Vpf is set 10 [V], for instance. At the moment when the electric resistance between the pair of device electrodes 22 reaches $1\times10^{6}$ [Ω], i.e., at the moment when a current reaches $1\times10^{-5}$ [Å] or less, the forming operation is terminated. An example of a device current If measured by the ammeter 23 is shown in FIG. 37.

Also in the present embodiment, the forming operation is performed in a vacuum atmosphere on the order of $10^{-5}$ [Torr].

The foregoing technique is preferable for the electron-emitting device in the present embodiment. In the case where some modification is made on the design of the electron-emitting device such as the materials, film thickness of the electroconductive film 21 or the interval L between the device electrodes, the energization condition is preferably modified in an appropriate manner accordingly.

4) Then, as shown in FIG. 44D, an appropriate pulse voltage is applied between the pair of device electrodes 22 from the activation power supply 24, and a current is made to flow to the electroconductive film 21, thus improving an electron-emitting characteristic.

More specifically, the energizing activation operation is a process in which a voltage pulse is repeatedly applied in a carbon compound gas content atmosphere to form a carbon film made of a carbon or carbon compound originated from an organic compound, thereby improving an electron-emitting characteristic.

Suitable carbon compounds used herein include aliphatic hydrocarbons such as alkane, alkene or alkyne, aromatic hydrocarbons, alcohol, aldehyde, ketones, amines, and organic acids such as phenol, carvone, or sulfonic acid. More specifically, saturated hydrocarbon expressed by CnH2n+2 such as methane, ethane or propane, unsaturated hydrocarbon expressed by composition formula such as CnH2n, including ethylene and propylene, benzene, toluene, benzonitrile, methanol, ethanol, formaldehyde, acetaldehyde, acetone, methylethylketone, methylamine, ethylamine, phenol, formic acid, acetic acid, propionic acid, etc. may be employed.

Figure 46A:
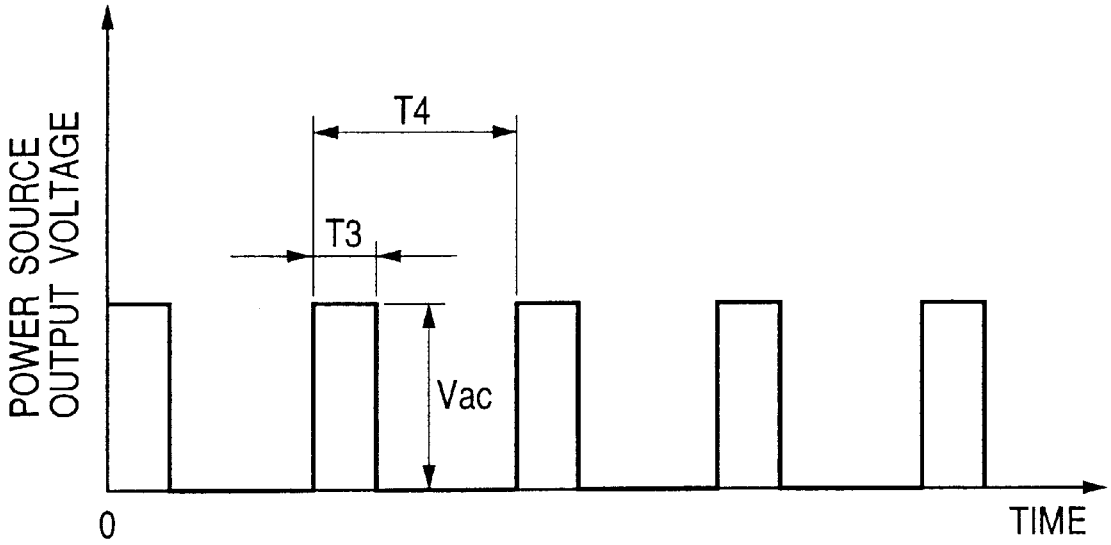
FIGS. 46A and 46B are views respectively showing an applied voltage waveform and showing fluctuation of the emission current Ie during the energization operation.
Figure 51A:
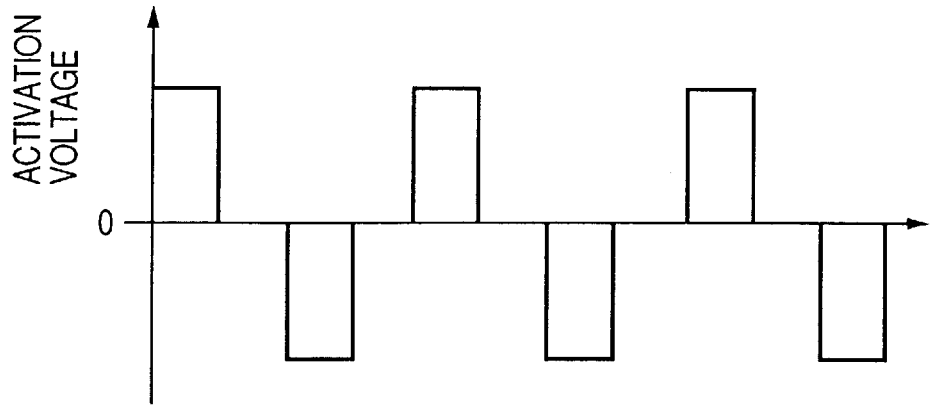
FIGS. 51A, 51B, 51C and 51D show pulse waveforms applicable in the activation process.
Figure 51B:
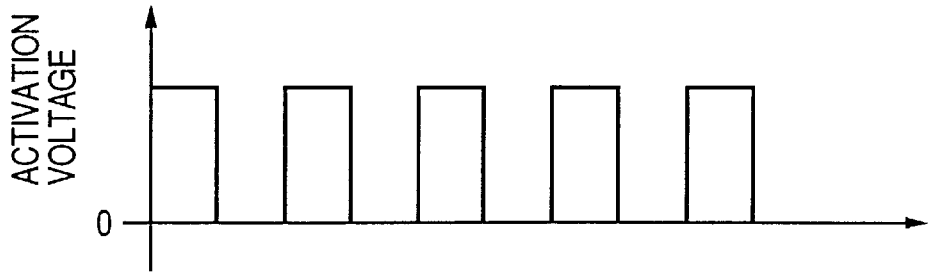
Figure 51C:
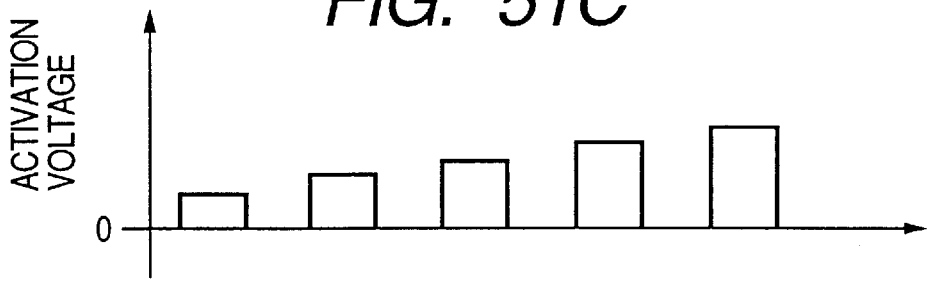
Figure 51D:
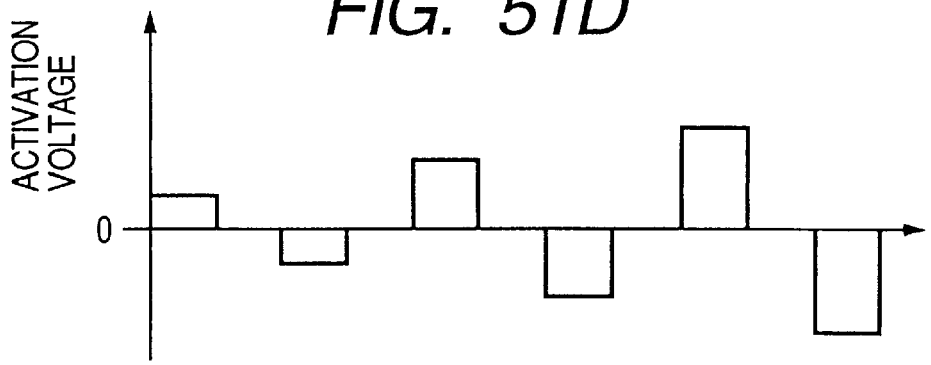

For more clarity of the energization step in the activation operation, FIG. 46A shows an example of a waveform of an appropriate pulse voltage to be applied from an activation power supply 1112. In the present embodiment, a rectangular wave of a constant voltage is regularly applied to perform the energizing activation operation. In concrete, the rectangular wave has a voltage Vact of 14 [V], a pulse width T3 of 1 [msec], and a pulse interval T14 of 10 [msec]. While a constant voltage rectangular pulse is applied here, a pulse voltage with different polarities may be applied or a pulse peak value may be incremental as shown in FIGS. 51A to 51D. In the present invention, a pulse with both polarities is preferably applied as shown in FIGS. 51A and 51B.

This activation operation is performed in a vacuum atmosphere with partial pressure of a carbon compound ranging from $10^{-5}$ to $10^{-7}$ [Pa]. It will be noted that the foregoing energization condition or organic substance partial pressure condition is preferable for the electron-emitting device in the present embodiment. In the case where some modification is made on the design of the electron-emitting device, the condition is preferably modified in an appropriate manner accordingly.

Figure 46B:
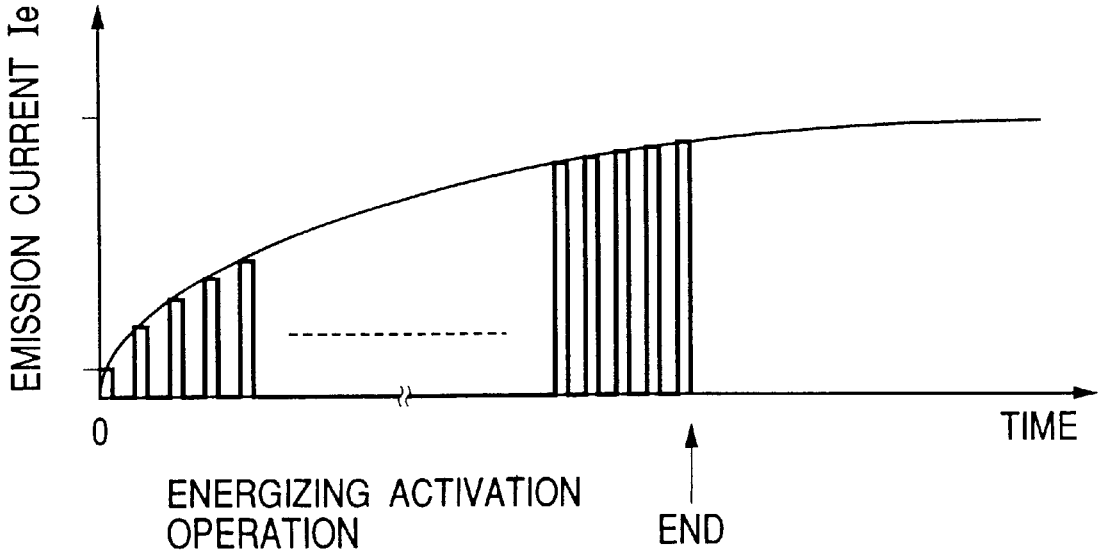

While a voltage is applied from the activation power supply 24, the ammeter 23 measures a device current If to monitor the state of the energizing activation operation to control the operation of the activation power supply 24. An example of the device current If measured by the ammeter 23 is shown in FIG. 46B (corresponding to FIG. 38). Once a pulse voltage starts to be applied from the activation power supply 24, the device current If and the emission current Ie increase as time elapses. When the device current If achieves a preset current value, application of voltage from the activation power supply 24 is stopped to end the energizing activation operation.

5) Subsequently, preferably, a stabilizing process is performed.

This process is a process to exhaust an organic substance contained in a vacuum container. An evacuating apparatus for evacuating a vacuum container which does not employ oil is preferable to prevent organic substance such as oil generated from the apparatus from influencing a characteristic of the device. More specifically, the evacuating apparatus include a magnetic floating type turbomolecular pump, a cryopump, a sorption pump, and an ion pump. Preferably, the organic component in the vacuum container has a partial pressure not greater than $1\times10^{-8}$ [Torr], more preferably not greater than $1\times10^{-10}$ [Torr], so that the carbon and carbon compound as stated in the above are prevented from newly depositing. Further, when to evacuate the vacuum container, the whole vacuum container is preferably heated to facilitate to exhaust organic substance molecules absorbed on the inner wall of the vacuum container or on the electron-emitting device.

Figure 44E:
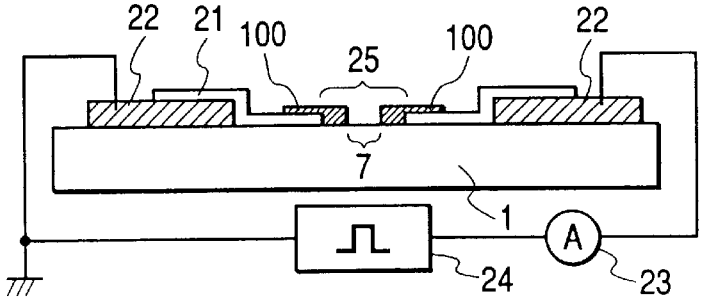

6) Then, as shown in FIG. 44E, preferably, an appropriate pulse voltage is applied between the pair of device electrodes 22 from the power supply 24 to perform the preliminary driving operation named in the above, thus improving an stability in electron-emitting characteristic.

The preliminary driving operation is an energization operation to be performed in an atmosphere where the partial pressure of organic substance in a vacuum atmosphere is reduced (the atmosphere equivalent to that in the stabilizing process) prior to the normal driving operation.

The preliminary driving is to apply a pulse voltage with a peak value of Vpre for a certain time period to a surface conduction electron-emitting device subjected to the stabilizing process, and thereafter to measure the electric field strength in the vicinity of the electron-emitting region in the device when it is driven with a Vpre voltage. Afterward, the device is normally driven with a driving voltage of Vdrv so that the electric field strength can be reduced. The driving operation is previously performed on the electron-emitting region in the device by applying the voltage Vpre with a large electric field strength. Therefore, a change in structural members which may lead to instability in the characteristic with time passage can be intensively developed in a short time period, thus making it possible to reduce fluctuation factor.

Next, the preliminary driving operation is described.

As described above, since a surface conduction electron-emitting device has an extremely large electric field strength in the vicinity of the electron-emitting region which is being driven, a problem has arisen in that the amount of emitted electron which is driven for a long time period with the same driving voltage is gradually reduced. The change with time passage in the vicinity of the electron-emitting region which results from a high electric field strength will be viewed as reduction in the amount of emitted electron.

This point will now be described. According to Fowler and Nordheim et al., a relation between a current I emitted from an FE type electron-emitting device and a voltage V to be applied between the cathode and the gate is given as Expression 34

$$I=A(\beta\times V)^2\times\exp\{-B/(\beta\times V)\} \quad \text{Eq. (16)}$$

where A and B are constants depending upon the material and an emission area in the vicinity of the electron-emitting region, respectively, and β is a parameter depending upon the configuration in the vicinity of the electron-emitting region, with an electric field strength obtained by multiplying the voltage V by β. The FE type electron-emitting device is described by way of example because it has been found that the surface conduction electron-emitting device may also be expressed by applying the above equation in such a manner that the voltage V applied between the pair of electrodes is merely replaced for the device current or emission current I.

Figure 30:
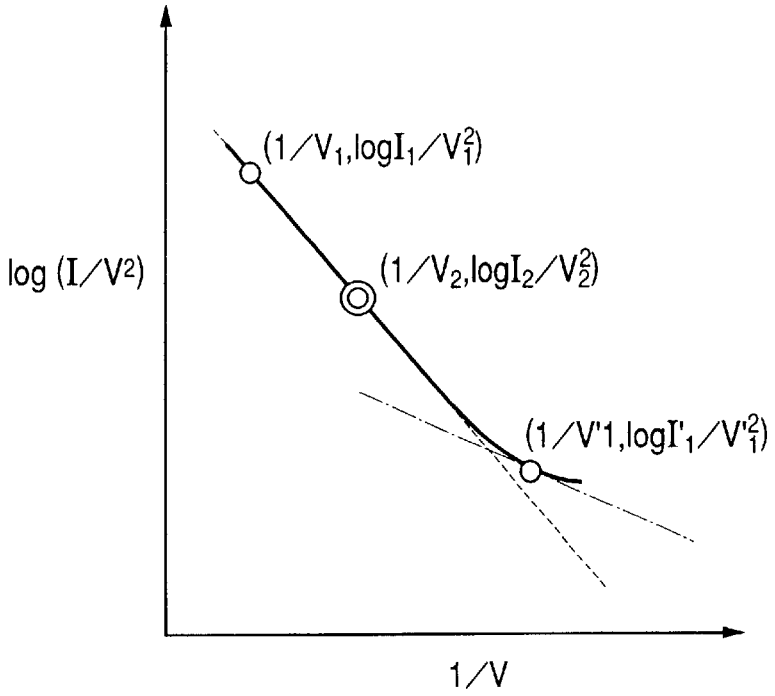
FIG. 30 is a graph showing an example of electric characteristics of an electron-emitting device to which the present invention can be applied.

If the electric characteristic plotted in a graph of FIG. 30 is made to approximate linearly (indicated by a broken line in FIG. 30), it is found that an inverse of a value obtained by dividing an applied voltage V by a gradient S in an approximate straight line, as defined as Expression 35

$$-V/S, \quad \text{Eq. (17)}$$

is proportional to a strength of electric field formed between the cathode 23 and the gate 24.

Furthermore, generalizing the above relation equation in more detail, it is found that a relation between the emission current I and the voltage V is expressed as Expression 36

$$I=f(V). \quad \text{Eq. (18)}$$

If f'(V) is a differential coefficient of f(V) with respect to the voltage V, an electric field strength is expressed as Expression 37

$$F=\beta\times V=B\times f(V)/\{V\times f'(V)-2f(V)\} \quad \text{Eq. (19)}$$

from Eq. (16), which is proportional to

Expression 38

$$f(V)/\{V\times f'(V)-2f(V)\} \quad \text{Eq. (20)}$$

A typical value of the electric strength of the FE type electron-emitting device is a significantly high value on the order of about 107 V/cm. This point is also applied to the pair of electrodes in a surface conduction electron-emitting device.

As a long term driving operation continues in a normal manner under such a high electric strength, a change in structural members under a high electric strength may irregularly occur, leading to instability in the emission current value.

The change which irreversibly occurs often involves reduction in the emission current, resulting in reduction in brightness as viewed on an image display device.

Such instability in current during the driving operation can be reduced by the preliminary driving operation performed prior to the normal driving operation.

The preliminary driving operation according to the present invention is implemented as the following procedure in one example.

Figure 31:
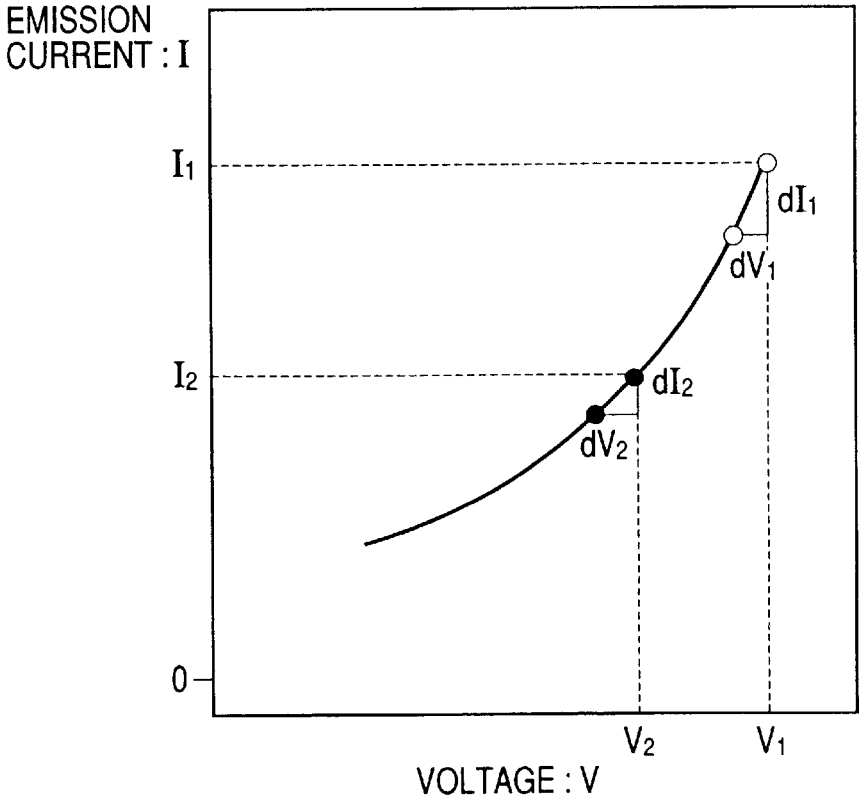
FIG. 31 is an electric characteristic diagram in FIG. 30, which is scaled.

First, with respect to an electron-emitting device on which the preliminary driving operation is to be performed, applied voltages and emission currents for at least two sets of different driving voltages, and differential coefficients of the emission currents at the applied voltages are determined. As illustrated in FIG. 31, for example, an emission current value I1 corresponding to an applied voltage of V1, and a variant dI1 of the emission current with V1 minutely varied by dV1are determined, and then a differential coefficient I'1 of the emission current is calculated from I'1=dI1/dV1. Subsequently, an emission current value I2 corresponding to an applied voltage of V2, and a differential coefficient I'2 are determined in the same manner.

Then, f(V) in Eq. (20) corresponding to the applied voltage V1, V2 is replaced with I1 and I2, and f'(V) is replaced with I'1 and I'2, and the values obtained from Eq. (20) are compared.

If such a relation is thus obtained as

Expression 39

$$I1/(V1\times I'1-2\times I1)>I2/(V2\times I'2-2\times I2), \quad \text{Eq. (21)}$$

V1 is taken as a preliminary driving voltage Vpre and V2 is taken as a normal driving voltage Vdrv. On the other hand, if such a relation is thus obtained as Expression 40

$$I1/(V1\times I'1-2\times I1)<I2/(V2\times I'2-2\times I2), \quad \text{Eq. (22)}$$

V2 is taken as a preliminary driving voltage Vpre and V1 is taken as a normal driving voltage Vdrv.

In the foregoing description, the preliminary driving operation is desirably performed until the electric field strength during the driving operation is stabilized. However, it has been found that if the preliminary driving operation continues until the relative variant ratio of the electric field strength during the preliminary driving operation is within 5%, the further driving operation may bring the variant ratio within about 5%, resulting in the sufficient effect of the preliminary driving operation. Therefore, advantageously, the preliminary driving operation may be carried out until the variant ratio of the value obtained from Eq. (20), f(V1)/[V·f'(V)−2f(V1)], is within 5%.

During this preliminary driving operation, desirably, a voltage is applied while the variant ratio of the electric field strength is monitored during the preliminary driving operation. A pulse voltage may be suitably used for a preliminary driving voltage. Advantageously, a voltage is applied while the variant ratio of the electric field strength is calculated for a pulse-rest period, for example, (a interval starting from application of pulse voltage to application of subsequent pulse voltage), and application of voltage is stopped at the moment when this variant ratio is within 5%.

For example, the variant ratio of the electric field strength can be viewed during the preliminary driving operation in the following manner. A preliminary driving voltage V1and a voltage V12 different from V1by a minute voltage dV1are sequentially applied, and the currents I1 and I12 that flow when the respective voltages are applied, and a difference dI1 between I1 and I12 are determined. Since f'(V1)=dI1/dV1and f(V1)=I1 resulting from Eq. (18) are established here, f(V1)/[V·f'(V)−2f(V1)] named in the above becomes Expression 41

$$Epre=I1/(V1\times dI1/dV1-2I1). \quad \text{Eq. (23)}$$

Therefore, what is required is to view the variant ratio of the value of Epre.

Figure 32A:
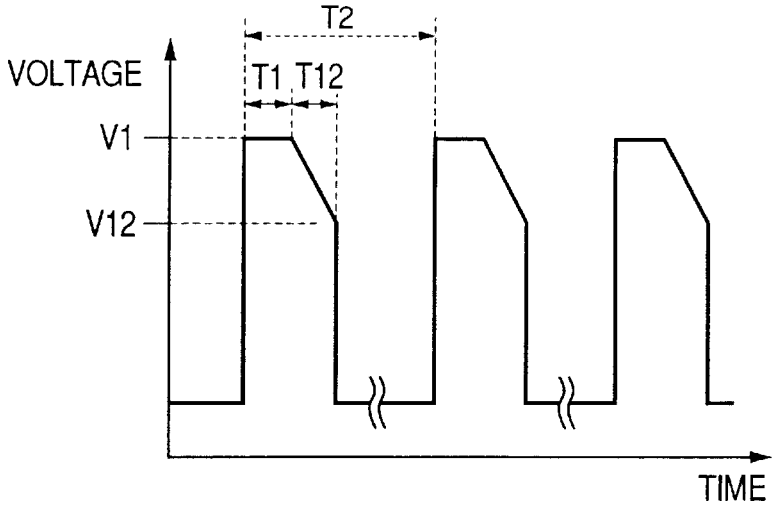
Figure 32B:
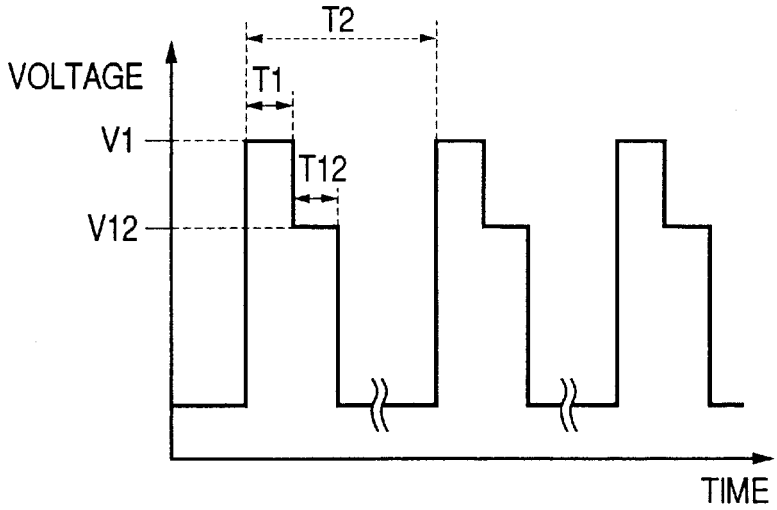
Figure 32C:
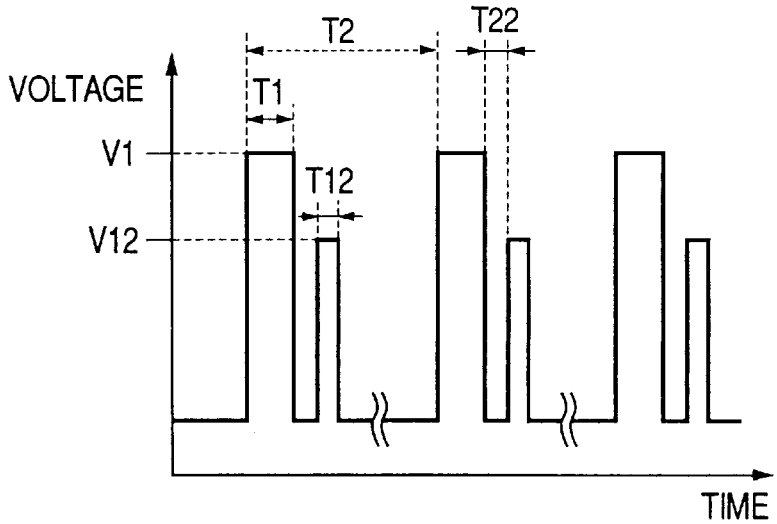

As a voltage waveform in the preliminary driving operation may be used waveforms shown in FIGS. 32A to 32C. FIG. 32A shows a voltage waveform where a voltage changes as a time period of T12 elapses just starting from a point when the preliminary driving voltage V1 has been applied to the voltage V12 for a time period of T1. FIG. 32B shows a voltage waveform where the voltage V12 is applied for a time period of T12 immediately after the preliminary driving voltage V1 has been applied for a time period of T1. FIG. 32C shows a voltage waveform where the preliminary driving voltage V1 is applied for a time period of T1, and afterward the voltage V12 is applied for a time period of T12. The variant ratio of a value of Epre is obtained from the current values at the respectively applied voltages V1 and V12, and the preliminary driving operation is desirably carried out until the variant ratio becomes within 5%.

Furthermore, with respect to an electron-emitting device meeting Eq. (21) which has been undergone the stabilizing process, the device current If and the emission current Ie have an MI characteristic relative to the device voltage Vf, such that the device current If and the emission current Ie can be uniquely defined relative to the device voltage If. At this time, an If–Vf characteristic and an Ie–Vf characteristic depend upon the maximum voltage Vmax to be applied after the stabilizing process.

Figure 33A:
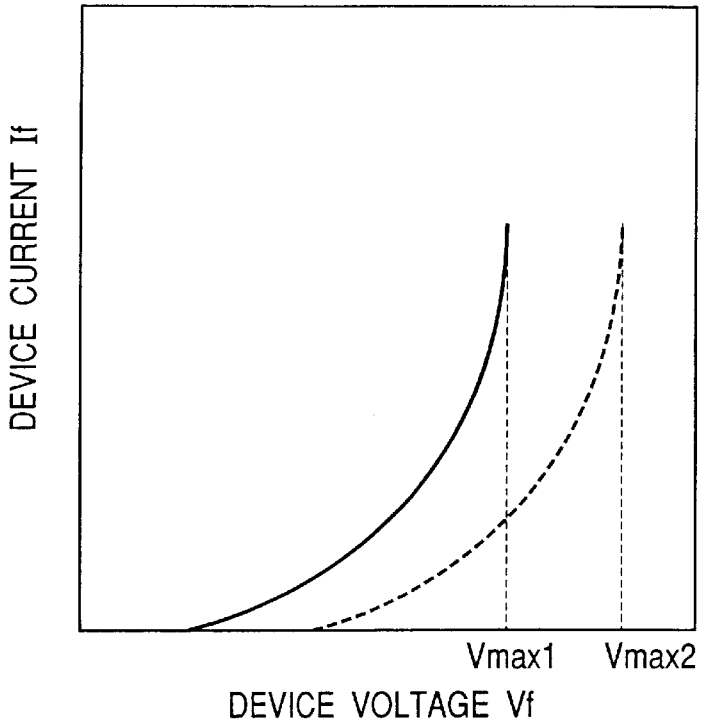
FIGS. 33A and 33B are graphs showing an example of relation between an emission current Ie and a device voltage Vf and relation between an emission current If and the device voltage Vf on an electron-emitting device in accordance with the embodiment of the present invention.

The I–V characteristic of this electron-emitting device is described with reference to FIGS. 33A and 33B. FIG. 33A is a view showing a relation between IF and Vf, and FIG. 33B is a view showing a relation between Ie and Vf.

Figure 33B:
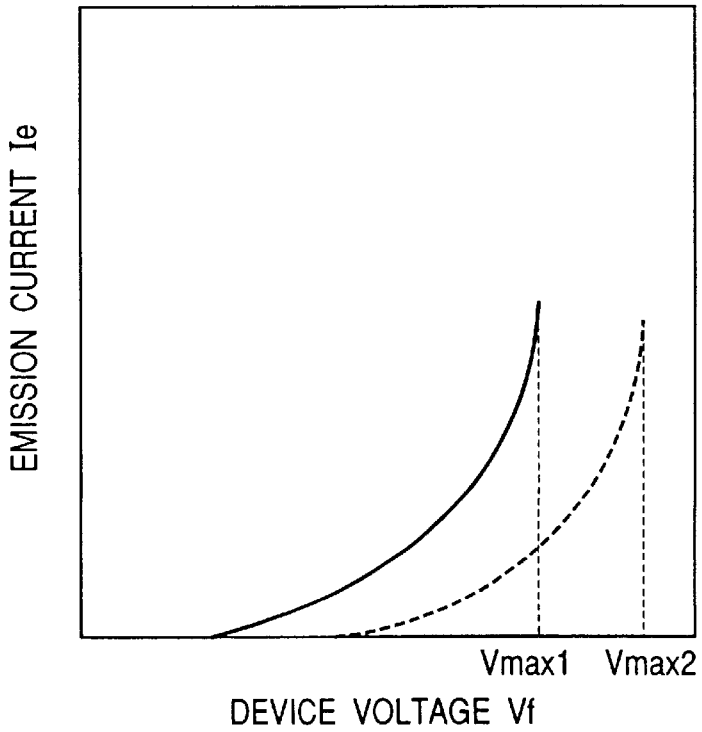

Throughout FIGS. 33A and 33B, indicated by a solid line is the I–V characteristic of the device driven by the maximum voltage Vmax=Vmax 1. When this device is driven with a device voltage not larger than Vmax, the same I–V characteristic as the I–V characteristic indicated by a solid line is exhibited. However, when driven with a voltage of Vmax 2 over Vmax 1, the device exhibits a different I–V characteristic as indicated by a broken line in the figures. When it is driven with a device voltage not larger than Vmax 2, the same I–V characteristic as the I–V characteristic indicated by a broken line in the figures is exhibited. This will be caused by the fact that the configuration, the emitting area, etc. of the electron-emitting region vary depending upon the maximum voltage Vmax applied to the electron-emitting device.

Figure 34:
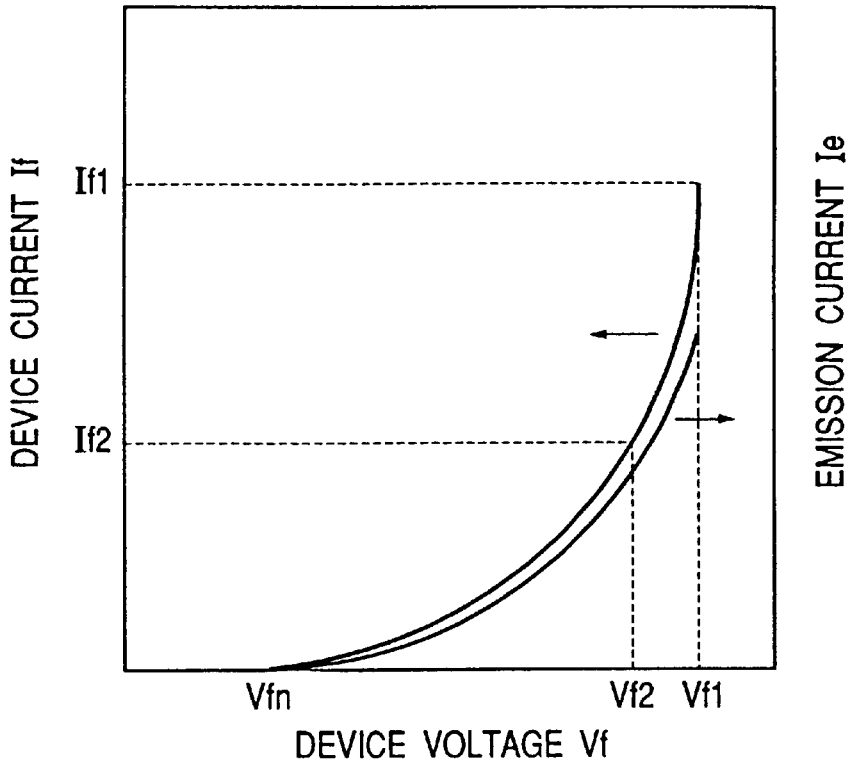
FIG. 34 is a graph showing an example of relation between an emission current Ie and a device current If and a device voltage Vf on an electron-emitting device in accordance with the embodiment of the present invention.
Figure 35:
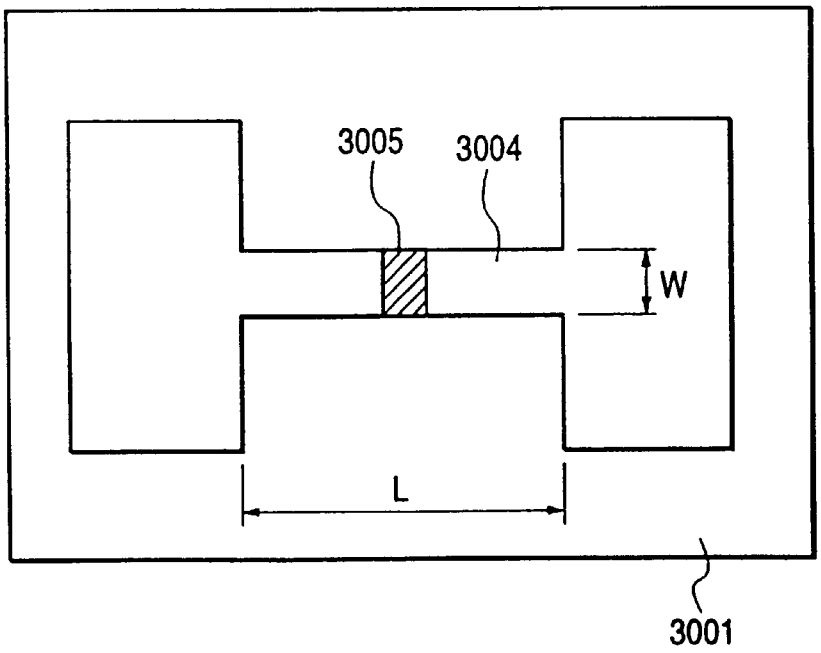
FIG. 35 PRIOR ART
FIG. 35 is a schematic plan view showing a surface conduction electron-emitting device of a planar type.

The device is preliminarily driven with a voltage of the device voltage V1in the preliminary driving process, whereby the electron-emitting device exhibits the If–Vf characteristic and the Ie–Vf characteristic uniquely defined by a voltage of Vmax=V1as shown in FIG. 34.

Next, given that the device current at the device voltage Vf1 when the preliminary driving operation ends be If1, Vf2 meeting If2≦0.7If1 be chosen as the driving voltage (Vf2 in FIG. 34) from the If–Vf characteristic defined by the preliminary driving operation. A driving voltage meeting If2≦0.7If1 permits reduction of the emission current to be suppressed for a long time.

It is considered that the configuration or the emitting area of the electron-emitting region does not substantially vary even if the above driving voltage Vf2 meeting If2≦0.7If1 is applied to the device that has undergone the preliminary driving operation with the device voltage Vf1. Hence, during the driving operation, the device is driven with a reduced device current If as compared to during the preliminary driving operation, with substantially the same electron-emitting area as that during the preliminary driving operation. This will allow reduced density of the device current made to flow to the electron-emitting region during the driving operation, thereby preventing thermal deterioration in the electron-emitting region. In addition, a stable electron-emission will be attained for a long time.

The preliminary driving operation may be performed in a required time period after the preliminary driving operation since the If–Vf characteristic and the Ie–Vf characteristic do not change when the device is driven with a voltage lower than the preliminary driving voltage. The preliminary driving operation can be performed by applying several pulses to tens pulses or larger of a pulse voltage with a pulse width ranging from several μsec to tens msec, preferably from 10 μsec to 10 msec.

Incidentally, if a relation defined by Eq. (22) is established with a voltage of V1>V2, the normal driving voltage Vdrv is higher than the preliminary driving voltage Vpre, an electron-emitting region (called an electron-emitting region A) in which a change is made with the voltage Vpre is affected by a higher electric field strength at the time point when the voltage Vdrv is applied thereto. However, the main electron-emitting source that may influence the electron-emitting amount at this time is turned to another electron-emitting region (called an electron-emitting region B), and the electron-emitting region A less contributes to the entire emitted current. The preliminary driving operation is still effective even in such a relation, and the voltage Vpre is previously applied to previously reduce the significant fluctuation of the electron-emitting region A, whereby a destructive fluctuation in the driving voltage Vdrv afterward can be obviated.

The preliminary driving method that has been described is also effectively applicable to any electron-emitting device other than the FE-type electron-emitting device or the surface conduction electron-emitting device such as the MIN type electron-emitting device.

When an electron source having a plurality of electron-emitting devices such as a multi-electron source with a multiple of electron-emitting devices arranged in simple matrix wiring is manufactured, an electron source having a stable electron-emitting characteristic can also be attained by performing the preliminary driving operation on all the devices constituting the electron source prior to the driving operation.

The energization processes are performed according to the foregoing equations, and the preliminary driving operation terminates.

For more clarity of the energization method, FIG. 46A shows an example of a waveform of an appropriate pulse voltage to be applied from the preliminary driving power supply 1112. In the present embodiment, a rectangular wave of a constant voltage is regularly applied to perform the energization operation. In concrete, the rectangular wave has a voltage Vpre of 13 [V], a pulse width T3 of 1 [msec] and a pulse interval T14 of 10 [msec]. An electric field strength F at the voltage Vpre is determined by Equations (16) and (19), and the driving voltage Vdrv is chosen with electric field strength reduced. An example of the device current If measured by the ammeter 1117 is shown in FIG. 39.

The foregoing energization condition is preferable for the surface conduction electron-emitting device in the present embodiment. In the case where some modification is made on the design of the surface conduction electron-emitting device, the condition is preferably modified in an appropriate manner accordingly.

While the voltage Vpre is applied, the ammeter 1117 measures the device current If to investigate the electric field strength F to determine the driving voltage Vdrv.

Figure 44F:
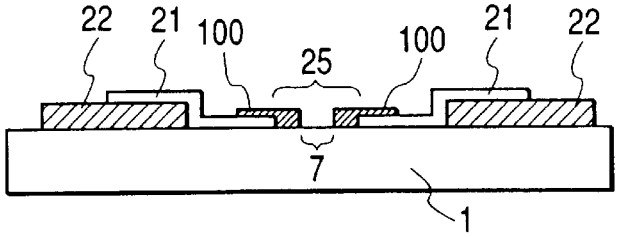

The surface conduction electron-emitting device of planar type shown in FIG. 44F is thus manufactured.

(Property of an electron-emitting device)

While the device structure and production process of the planar type electron-emitting device have been described, an electron-emitting characteristic of this device will now be described.

Figure 47:
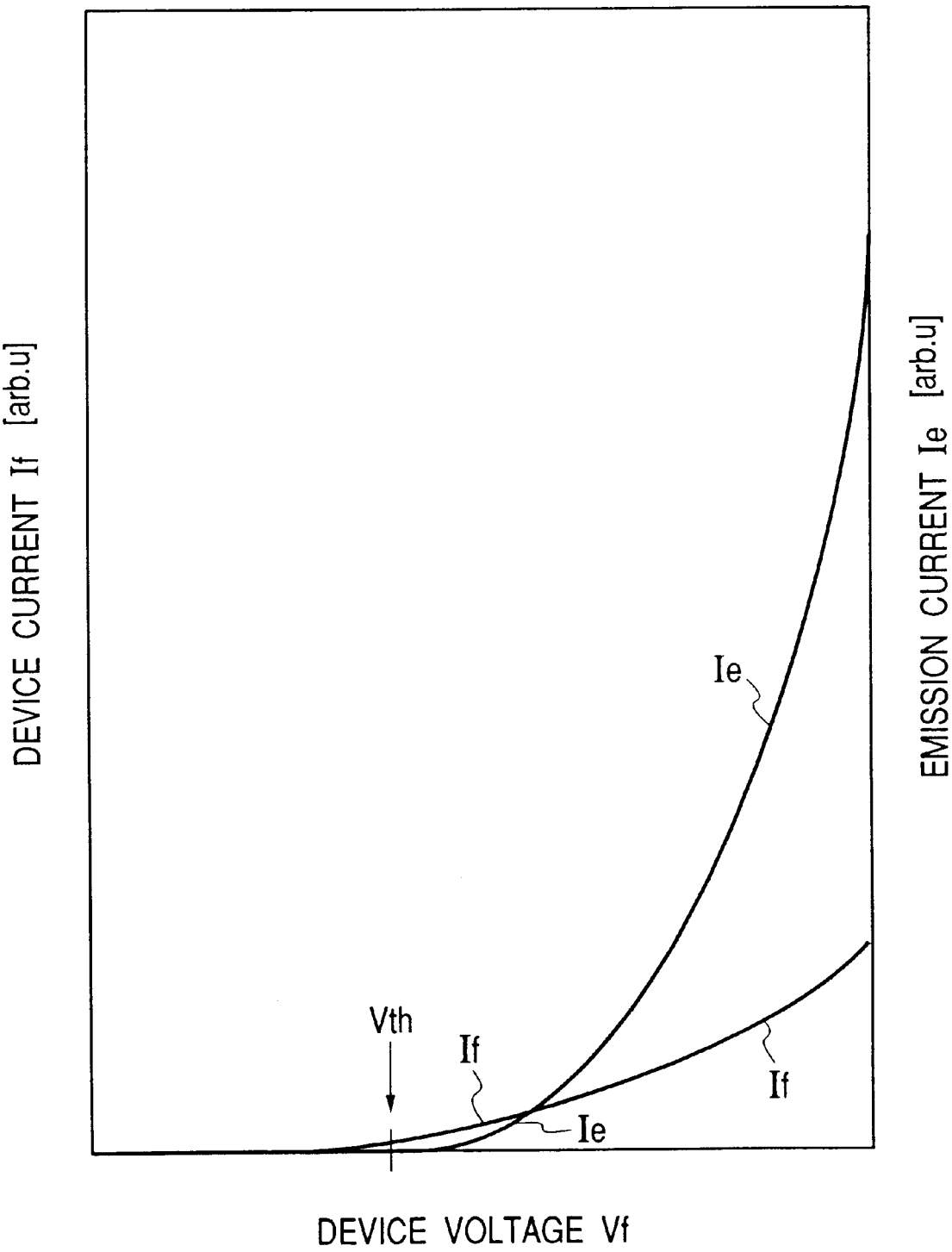
FIG. 47 is a graph showing a typical characteristic of a surface conduction electron-emitting device implemented in an embodiment of the present invention.

FIG. 47A illustrates a typical example of an (emission current Ie)—(applied device voltage Vf) characteristic and a (device current If)—(applied device voltage Vf) characteristic of the above device. It will be noted that since the emission current Ie is significantly lower than the device current If, which is difficult to be depicted on an identical scale, and further these properties may vary as design parameters for the magnitude or configuration of the device are modified, the two graphs depicted in FIG. 47 are illustrated in arbitrary units.

The device of the present invention has three characteristics with respect to the emission current Ie as below.

In the first place, if a voltage with magnitude not less than a certain voltage (this is called a threshold voltage Vth) is applied to the device, the emission current Ie abruptly increases: however, the emission current Ie is little detected if a voltage less than the threshold voltage Vth is applied thereto.

In the second place, since the emission current Ie varies depending upon the voltage Vf to be applied to the device, the magnitude of the emission current Ie can be controlled with the voltage Vf.

In the third place, since the current Ie emitted from the device has a higher response than that of the voltage Vf applied to the device, the charge amount of the electron emitted from the device can be controlled according to the period length of applying the voltage Vf.

A surface conduction electron-emitting device having the foregoing characteristics may be suitably used in an image-forming apparatus. For example, in an image-forming apparatus having a multiple of devices corresponding to pixels of a display screen, the first characteristic can be utilized to scan in turn the display screen for display. That is, a voltage not less than the threshold voltage Vth is suitably applied to the active devices for desired luminance brightness while a voltage less than the threshold voltage Vth is applied to the unselected devices. The active devices can be switched in turn to sequentially scan the display screen for display.

Furthermore, the second or third characteristic can be utilized to control the luminance brightness, thus displaying gradation.

(Operations to drive an image-forming apparatus using a surface conduction electron-emitting device)

Next, the aging operation utilizing the surface conduction electron-emitting device as an electron source for improvement in characteristics of an image-forming apparatus is described. FIG. 42 shows an example of the image-forming apparatus. The image-forming apparatus is comprised of constituent members including an electron source, a phosphor (an image-forming member), and an anode electrode.

The aging operation is a process performed prior to a regular operation for forming images in the image-forming apparatus (namely, an operation required to practically use the image-forming apparatus, such as energization at 60 Hz with the anode voltage on the order of Va=10 kV, which depends upon the purpose of use).

FIG. 36 schematically shows an example of an apparatus for the aging operation.

In FIG. 36, while a voltage is applied from power supplies 24 and 33, ammeters 23 and 32 measure a device current If and an emission current Ie to monitor the state of the energization operation to control the operation of the power supplies 24 and 33.

The energization process in the aging operation is described.

For more clarity of the energization method, FIG. 46A shows an example of a waveform of an appropriate pulse voltage to be applied from the power supply 24. In the present embodiment, a rectangular wave of a constant voltage is regularly applied to perform the energization operation. In concrete, the rectangular wave has a voltage Vac of 14 V.

The rectangular wave has an initial pulse width T3 of 1 [msec] and a pulse interval T14 of 1000 [msec], with an increment of 1 Hz to 60 Hz at 1 Hz/min.

A voltage to be applied from the power supply 33 is initially set 0 V with an increment of 0 V to 8 kV at 100 V/min. After this voltage has been applied, the aging operation terminates.

The foregoing energization condition is preferable for the surface conduction electron-emitting device in the present embodiment. In the case where some modification is made on the design of the surface conduction electron-emitting device, the condition is preferably modified in an appropriate manner accordingly.

The present embodiments of the present invention will now be described in detail.

Embodiment 1

This embodiment is one example of a method of manufacturing a display device having an electron source substrate on which a single electron-emitting device (electroconductive thin film) is formed, in particular, an energization forming process for an electron source.

In the energization forming process to be described below, an electroconductive thin film is energized, and application of voltage is ended when the device current reaches a prescript value. The frequency band of energization pulse is calculated on the basis of a previously measured resistance value in energization forming, and a low-pass filter is used to restrict the frequency band. The allowable range for the applied voltage is set such that the voltage error is contained within 100 mV with respect to the peak value of 10 V for the applied voltage pulse. In other words, the excess voltage threshold value is set to 10 mV.

Employment of this method makes it possible to suppress occurrence of abnormal voltage, as compared to conventional energization methods, thereby obtaining an electron source with unified device current characteristic.

The structure of an energization apparatus implemented in this embodiment is first described.

Now, a description of this embodiment is given with reference to FIGS. 18 to 22.

Figure 18:
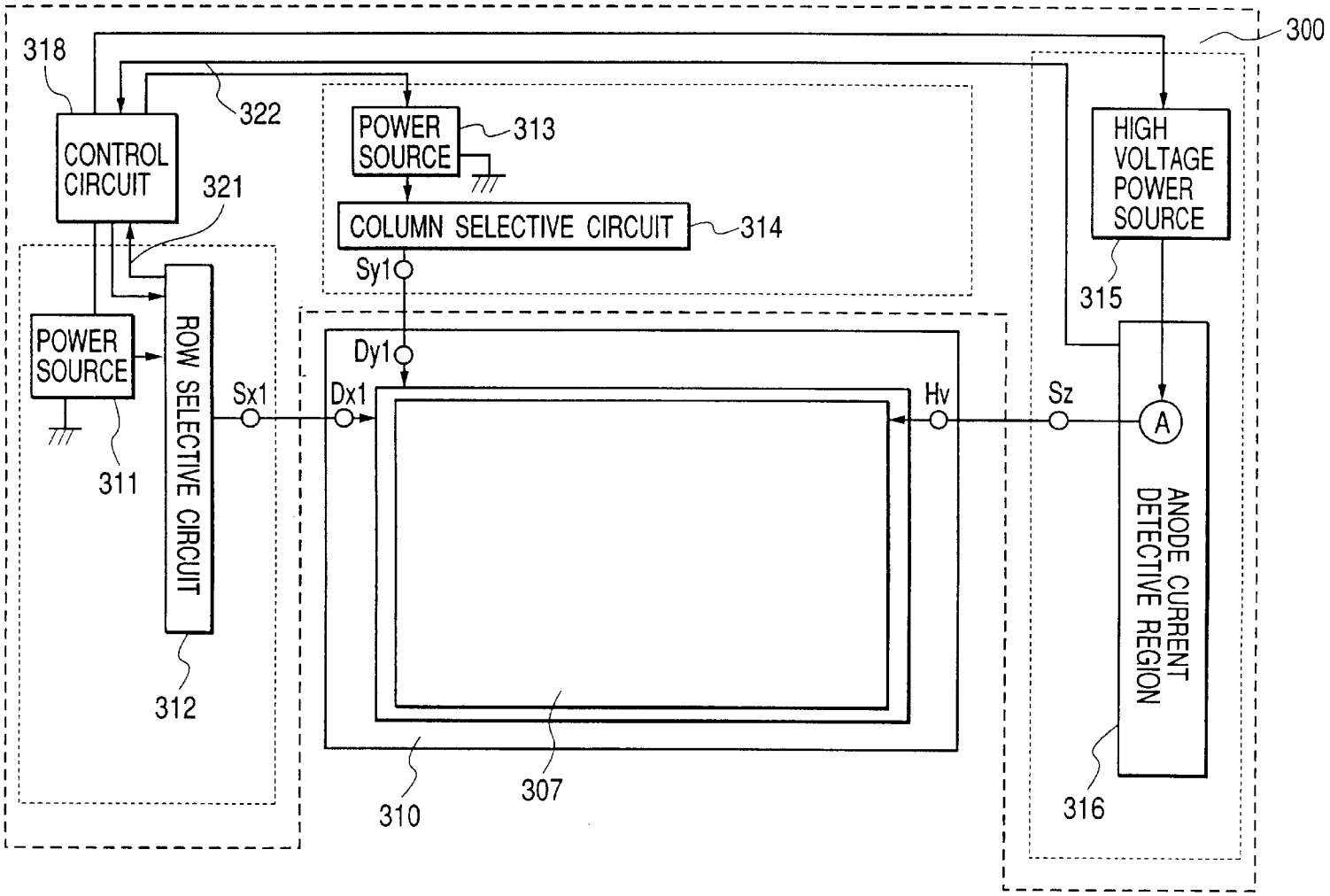
FIG. 18 is a diagram showing the structure of an energization forming apparatus in accordance with Embodiment 1 of the present invention.

FIG. 18 is a block diagram showing the structure of an energization forming apparatus in accordance with this embodiment.

In FIG. 18, reference numeral 310 denotes a display device with electron-emitting devices (electroconductive thin films). The display device is connected to a not-shown evacuating apparatus, and the inside of the apparatus is evacuated to about $10^{-4}$ to $10^{-5}$ [Torr]. On the electron source substrate, row-directional wires Dx are connected to Sx of an energization device 300, and column-directional wires Dy are connected to Sy of the energization device 300.

Further, an anode electrode Hv is connected to Sx of the energization device 300. However, voltage is not applied to the anode electrode HV in this embodiment.

Reference numeral 311 denotes a power supply on the row wire side, for generating the voltage pulse. Denoted by 312 is a row selective circuit including an ammeter. The row selective circuit 312 is comprised of a switch for determining connection or disconnection between the power supply and the electron source substrate, and an ammeter for measuring a current flowing to the row wires. Reference numeral 315 denotes an anode power supply for supplying voltage to an anode electrode 307. Reference numeral 316 denotes a current detective region for measuring emission current led out by the anode electrode. As voltage is not applied to the anode electrode 307 in this embodiment, the measurement of emission current is not carried out.

A control circuit 313 controls a power supplies 311, 319, a row selective circuit 312, and a column selective circuit 314 on the basis of a device current value 321 detected by the row selective circuit 312.

Now, the selective circuits are described with reference to FIGS. 19A and 19B.

Figure 19A:
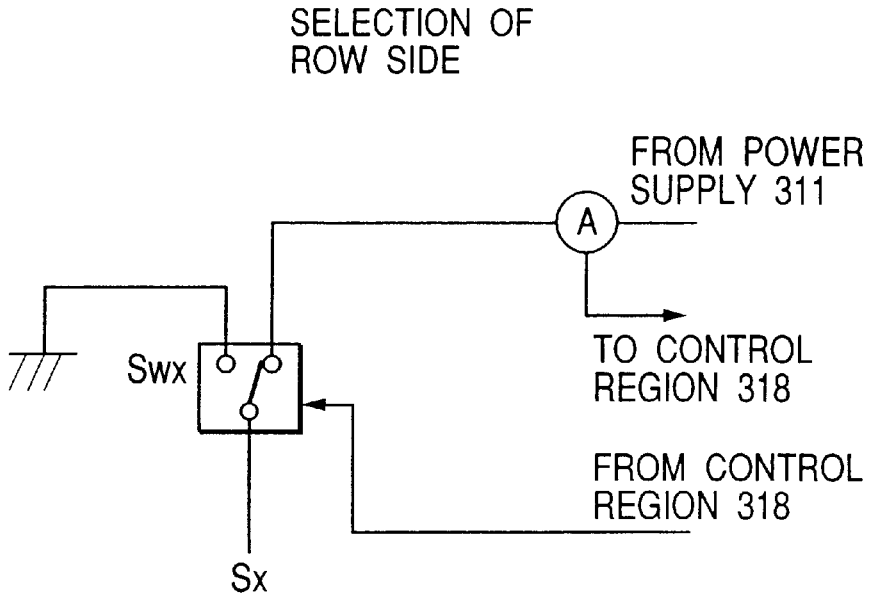
FIGS. 19A and 19B are circuit diagrams showing a row selective circuit and a column selective circuit in the apparatus of FIG. 18.
Figure 19B:
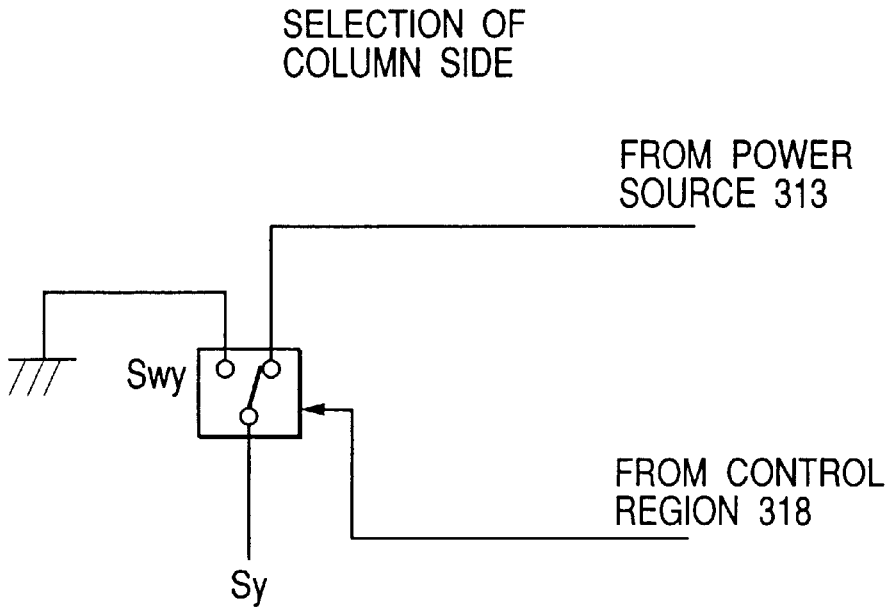

FIGS. 19A and 19B illustrate the row selective circuit 312 and the column selective circuit 314, respectively.

These row selective circuits are comprised of switches Swx such as a relay or an analogue switch, in which an output of the switch is connected to a row-directional wire terminal Dx on the electron source substrate. The ammeter is also connected thereto.

The column selective circuit has the structure similar to that of the row selective circuit.

In FIGS. 19A and 19B, the row side power supply is connected to the electron source substrate, and the row side wires on the electron source substrate are grounded.

Next, the column side power supply 311 is described with reference to FIG. 20.

Figure 20:
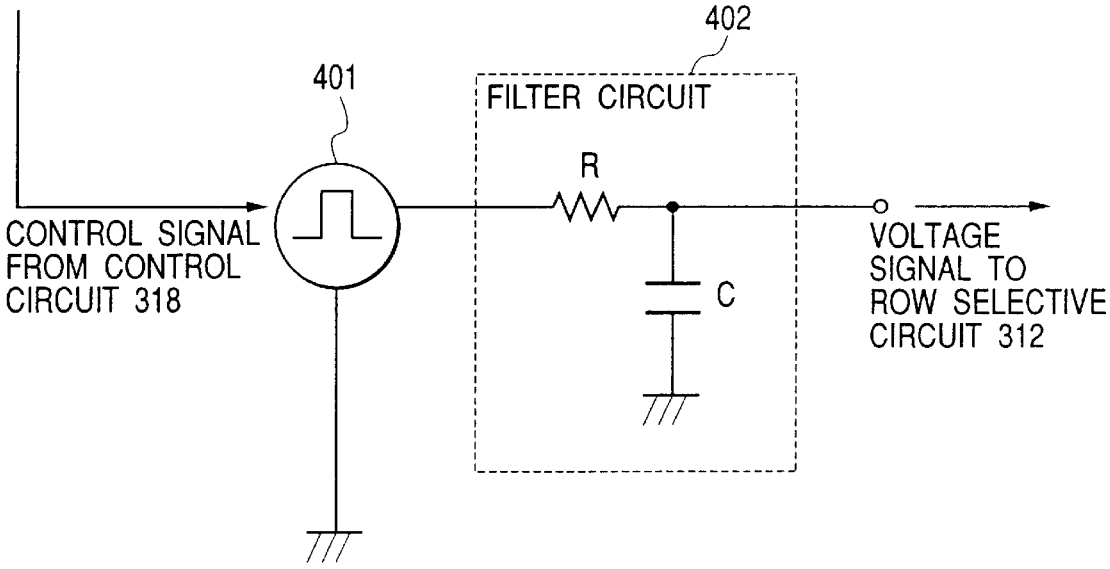
FIG. 20 is a block diagram showing the structure of a row side power supply in the apparatus of FIG. 18.

FIG. 20 is a block diagram showing the structure of the row side power supply 311. The row side power supply comprises a power supply and a filter circuit in accordance with this embodiment.

Specifically, the row side power supply comprises a power supply 401 for generating a pulse, and a low-pass filter 402 for cutting off high frequency component of the output pulse. The power supply 401 generates a pulse waveform in response to a signal from the control circuit 318.

The output in this embodiment only comes from the row wires, so that the column side power supply 311 does not include any filter circuit.

Subsequently, a description is given on a procedure for carrying out the energization forming of the electron source, using the apparatus of this embodiment.

In this process, the energization forming process is ended when a device current reaches 1 $\mu$A.

An electric circuit connection diagram of the electron source substrate is the same as that shown in FIG. 36.

First, a vacuum container having the electron source substrate on which the above-stated electroconductive thin film is formed is vacuum-sucked to $1\times10^{-5}$ [Torr].

Next, in order to perform the energization process on the devices, switches of the row selective circuit 312 and the column selective circuit 314 are switched over as shown in FIGS. 19A and 19B, and the voltage is then applied from the power supply 311.

Figure 21:
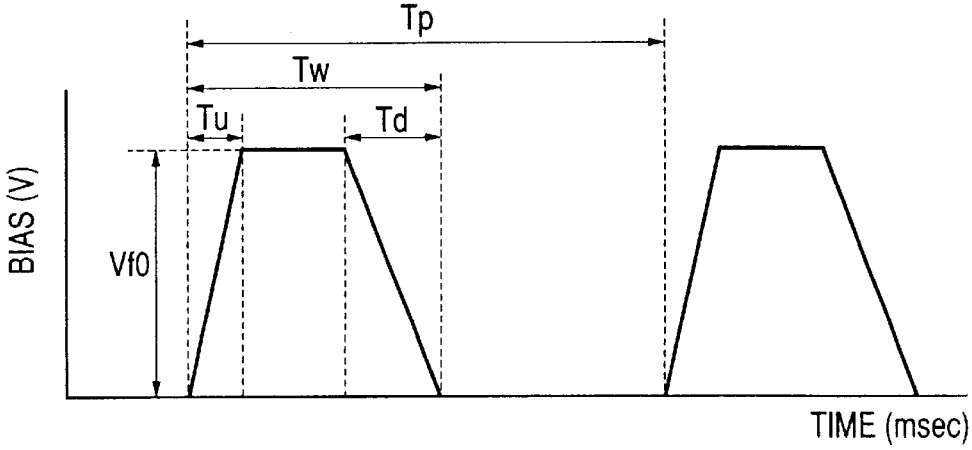
FIG. 21 is a view showing an applied voltage waveform of the apparatus of FIG. 18.

The waveform of voltage applied at this time is shown in FIG. 21.

The waveform of the voltage applied from the row side power supply has a pulse width (Tw) of 1 msec and a pulse period (Tp) of 10 msec. The pulse rise time Tu is set to about 0 nsec, and the pulse fall time Td is set to about 0 nsec. Vf0 is set to 10 V so that the voltage applied to the device is 10 V.

The output voltage of the high-voltage power supply 315 is set to 0 [V], for the emission current is not measured as mentioned above.

A description is next given on the design of the low-pass filter.

The impedance fluctuation during the process in an electron source substrate 310 equivalent to the electron source substrate 310 (a matrix wiring including the surface conduction electron-emitting device) that is used in this embodiment is measured in advance using the energization apparatus 300 from which the low-pass filter is taken out. As a result, only the resistance component fluctuates while the inductance (L) component and capacitance (C) component are constant.

At this time, the inductance component L of 1 nH, the volume component is 40 pF, and the resistance component fluctuates from 30 KΩ to 30 MΩ (FIG. 37 shows the resistance change during the energization forming).

The low-pass filter is designed using those values.

These values are put into the equation (1) to obtain gain function |Vout/Vin|, calculating a frequency band with which gain Ap is equal to or less than 1.01 (the excess voltage threshold value is equal to or less than 100 mV). The result of the calculation tells that the frequency in a band of $8\times10^6$ Hz or less does not cause output of excess voltage.

To cut off a frequency over than $8\times10^6$ Hz, R, C of the low-pass filter circuit in FIG. 20 are set to 2 mΩ and 11 μF, respectively.

The filter circuit of the row wire power supply is formed using those values.

Applying the voltage and conducting the energization forming with voltage application based on the above conditions result in completion of the process without applying abnormal voltage to the electroconductive thin film.

Employment of this method makes it possible to suppress occurrence of excess voltage, as compared to conventional forming methods, thereby obtaining an electron source with the desired device current excellent in reproductivity.

Next, operation of a controller 104 in the energization forming of this embodiment is described with reference to a flow chart of FIG. 22.

Conditions required for the energization forming are set in STEP (INT).

First, the electron source substrate is brought into a highly vacuumed state. Next, the device on which the energization forming process is to be performed is chosen by controlling the row selective circuit and the column selective circuit. The initial voltage application conditions are set and so do R and C for use in the filter circuit.

STEP (A) is regular sequence for applying voltage.

The voltage pulse to be used for energization is outputted at set voltage Vif, period Tw and pulse width TP.

STEP (B) is measurement sequence for the device current and the emission current.

In this embodiment, the device current is measured using the pulse voltage that is used in the forming process. The device current If is measured with the use of this pulse voltage. Here, only the device current If is measured and measurement of the emission current Ie is not carried out.

STEP (C) is judgement sequence for continuation of the forming process.

Judgement is made whether or not the value of the device current If measured at STEP (B) is smaller than the preset value 1 μL. When the If has smaller value than 1 μA, the process proceeds to completion sequence [STEP (END)]. On the other hand, the If value larger than 1 μA brings the process to applied voltage changing sequence [STEP (D)].

STEP (END) is completion sequence.

Application of voltage from both the row side and column side is stopped to end the energization forming process.

Though shown in this embodiment is the case where the energization forming process is conducted from the row wires, the process may be carried out from the column wires.

According to the method used herein, the voltage pulse Vf used in the regular sequence serves also as the measurement pulse to constantly detect the device current.

The device current If is constantly detected here, but the regular sequence may be stopped to put in sequence for measurement.

Employment of this method makes it possible to suppress occurrence of excess voltage, as compared to conventional forming methods, thereby obtaining an electron source with the desired device current: excellent in reproductivity.

Embodiment 2

This embodiment employs a voltage applying method in the energization forming process, which is different from the one in Embodiment 1. A method of a ringing control also differs in this embodiment.

This embodiment is to show that the application voltage method different from the method in Embodiment 1 also can suppress occurrence of abnormal voltage.

The description here relates to the difference between this embodiment and Embodiment 1.

First, the structure of an energization forming apparatus used in this embodiment is described, The structure of the energization forming apparatus in this embodiment is similar to that of the apparatus in Embodiment 1. However, difference is the "structure and operation of the row side power supply".

Figure 23:
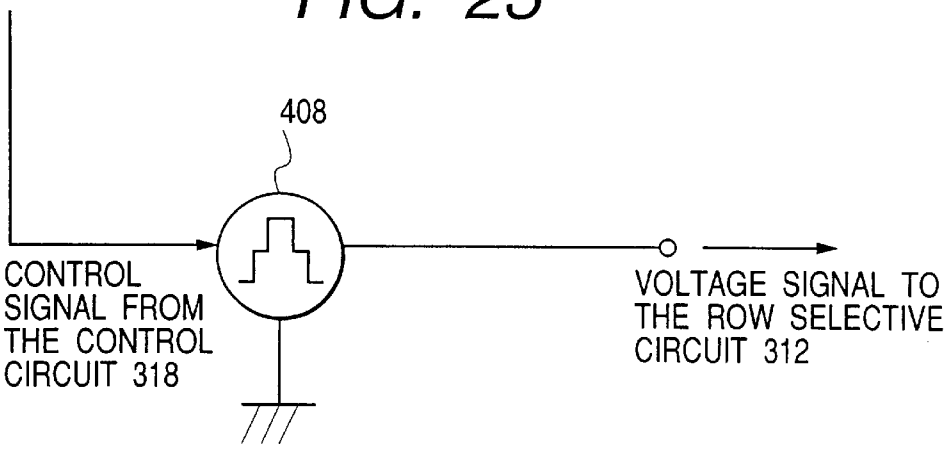
FIG. 23 is a block diagram showing the structure of a row side power supply in accordance with Embodiment 2 of the present invention.

First, the power supply circuit is described with reference to FIG. 23.

As opposed to Embodiment 1, the power supply does not include any filter circuit. Furthermore, the voltage pulse to be outputted may output a waveform in steps.

According to this embodiment, such a waveform in steps is inputted to suppress a maximum value of the ringing voltage, whereby the ringing control can be achieved.

Subsequently, a procedure for the energization forming of an electron source, which is performed by using the apparatus of this embodiment, will be described.

In this process, when a device current reaches 1 VIA, the energization forming process ends.

An electric circuit connection diagram of the electron source substrate is the same as that shown in FIG. 36.

First, a vacuum container having the electron source substrate on which the above-stated electroconductive thin film is formed is vacuum-sucked to $1\times10^{-5}$ [Torr].

Figure 24:
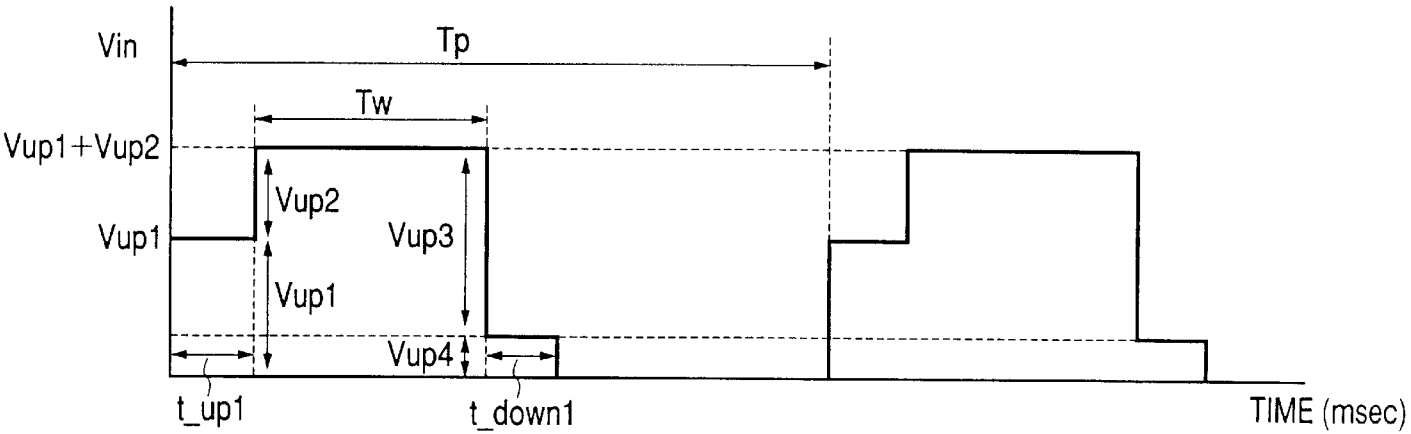
FIG. 24 is a view showing an applied voltage waveform of the apparatus of FIG. 22.

Next, in order to perform the energization process on the devices, switches of the row selective circuit 312 and the column selective circuit 314 are switched over as shown in FIGS. 19A and 19B, and the voltage is then applied from the power supply 311. The waveform of voltage applied at this time is shown in FIG. 24.

The waveform of the voltage applied from the row side power supply has a pulse width (Tw) of 1 msec and a pulse period (Tp) of 10 msec. V up 1, V up 2, V up 3, and V up 4 are set, respectively, so that a voltage to be applied to the device is 10 V. A way to set these values will be described later. The output voltage of the high voltage power supply 315 is set to 0 V, for the emission current is not measured as mentioned above. The energization forming process will be described as below. In this process, the energization forming process is ended when the device current in each row reaches 1 $\mu$A.

First, a vacuum container having the electron source substrate on which the above-stated electroconductive thin film is formed is vacuum-sucked to $1\times10^{-5}$ [Torr].

Next, in order to perform the activation process on the devices in the second row, switches of the row selective circuit 312 and the column selective circuit 314 are switched over as shown in FIGS. 19A and 19B, and the voltage is then applied from the power supplies 311, 313.

The waveform of the voltage applied at this time is shown in FIG. 24.

The impedance fluctuation during the process in an electron source substrate 310 equivalent to the electron source substrate 310 (a matrix wiring including a surface conduction electron-emitting device) that is used in this embodiment is measured in advance using the energization apparatus 300. As a result, only the resistance component fluctuates while the inductance (L) component and the capacitance (C) component are constant.

At this time, the inductance component L is 0.1 uH, the volume component is 0.4 nF, and the resistance component fluctuates from 3 Ω to 30 MΩ (FIG. 37 shows the resistance change during the energization forming).

The ringing parameters are designed using those values.

According to this embodiment, since ζ named in the above meets

Expression 42,

<IMG SRC="/IMAGE10/3936034@@0042.jpg">, t_up1=π/q=3.1 nsec, t down1=π/q=3.1 nsec, and V up 1=V up 2=V down 1=V down 2=5 V are set.

Applying the voltage and conducting the energization forming based on the above conditions result in completion of the process without applying abnormal voltage to the electroconductive thin film.

Employment of this method makes it possible to suppress occurrence of excess voltage, as compared to conventional forming methods, thereby obtaining an electron source with the desired device current excellent in reproductivity.

Next, operation of a controller 104 in the energization forming of this embodiment: is described with reference to a flow chart in FIG. 22.

Conditions required for the energization forming are set in STEP (INT).

First, the electron source substrate is brought into a highly vacuumed state. Next, the device on which the energization forming process is to be performed is chosen by controlling the row selective circuit and the column selective circuit. The applied voltage values V up 1, V up 2, V_down 3, and V_down 4, the rise delay time t_up 1, and the fall delay time t-down 1 are set, respectively.

STEP (A) is regular sequence for applying voltage.

The voltage pulse to be used for energization is outputted at set voltage Vf, period Tw, and pulse width TP.

STEP (B) is measurement sequence for the device current and the emission current.

In this embodiment, the device current is measured using the pulse voltage used in the forming process. The device current If is measured with the use of this pulse voltage. Here, only the device current If is measured and measurement of the emission current Ie is not carried out.

STEP (C) is judgement sequence for continuation of the forming process.

Judgement is made whether or not the value of the device current If measured at STEP (B) is smaller than the preset value 1 $\mu$A. When the If has smaller value than 1 $\mu$A, the operation proceeds to completion sequence [STEP (END)]. On the other hand, the If value larger than 1 $\mu$A brings the process to applied voltage changing sequence [STEP (D)].

STEP (END) is completion sequence.

Application of voltage from both the row side and the column side is stopped to end the energization forming process.

Though shown in this embodiment is the case where the energization forming process is conducted from the row wires, the process may be carried out from the column wires.

According to the method used herein, the voltage pulse Vf used in the regular sequence serves also as the measurement pulse to constantly detect a device current.

The device current If is constantly detected herein, but the regular sequence may be stopped to put in sequence for measurement.

Employment of this method makes it possible to suppress occurrence of excess voltage, as compared to conventional forming methods, thereby obtaining an electron source with the desired device current excellent in reproductivity.

Embodiment 3

This embodiment employs a setting method of ringing parameters, which is different from Embodiments 1 and 2.

The ringing parameters are set by measuring in real time the impedance fluctuation during the process to control the ringing according to the measured impedance value.

As similar to the case of Embodiment 1, if a filter circuit is used, R and C values are changed according to the impedance fluctuation. Further, as similar to the case of Embodiment 2, for the control under voltage pulse conditions, the pulse conditions (voltages V up 1, V up 2, V down 1, V down 2, rise/fall delay times t_up1, and t_down1) is adjusted in real time and calculated so that an abnormal voltage becomes minimum.

Here, the use of a filter circuit is described likewise in Embodiment 1.

First, the structure of an energization forming apparatus used in this embodiment is described, The structure of the energization forming apparatus in this embodiment is similar to that of Embodiment 1. However, difference is the "circuitry operation of the row side power supply circuit and the column side power supply".

The row side power supply 311 will be described.

What is different from Embodiment 1 is that the row side power supply 313 is equipped with a mechanism to adjust ringing parameters according to the impedance value measured by an impedance measurement system. The description is given with reference to FIG. 25.

The mechanism comprises a power supply 401 for generating pulse, an LCR meter 413 for measuring the impedance of an electron source substrate, and a switch 414 for switching an LCR measurement system and an energization system. In response to a signal from a control circuit 318, a pulse waveform is genera ed. Also, in response to a signal from the control circuit 318, the switch 414 is switched. The control signal from the control circuit 318 makes R and C values or a filter circuit 412 variable.

The LCR meter sends the measured impedance data to the control circuit and changes the values of R, C constituting the filter circuit 412 based on this signal.

A description is next given on the design of the low-pass filter.

These impedance values measured during the energization process are introduced into the equation (1) to obtain gain Ap, calculating a frequency band with which gain Ap is equal to or less than 1.01 (the excess voltage threshold value is equal to or less than 100 mV). The R and C values of the low-pass filter are adjusted so that a signal in this frequency band may be applicable.

According to this embodiment, the resistance component R is constant set to 2 mΩ, so that the ringing is controlled by making the capacitance component C variable.

Applying the voltage and conducting the energization forming based on the above conditions results in completion of the process without applying abnormal voltage to the electroconductive thin film.

Figure 26:
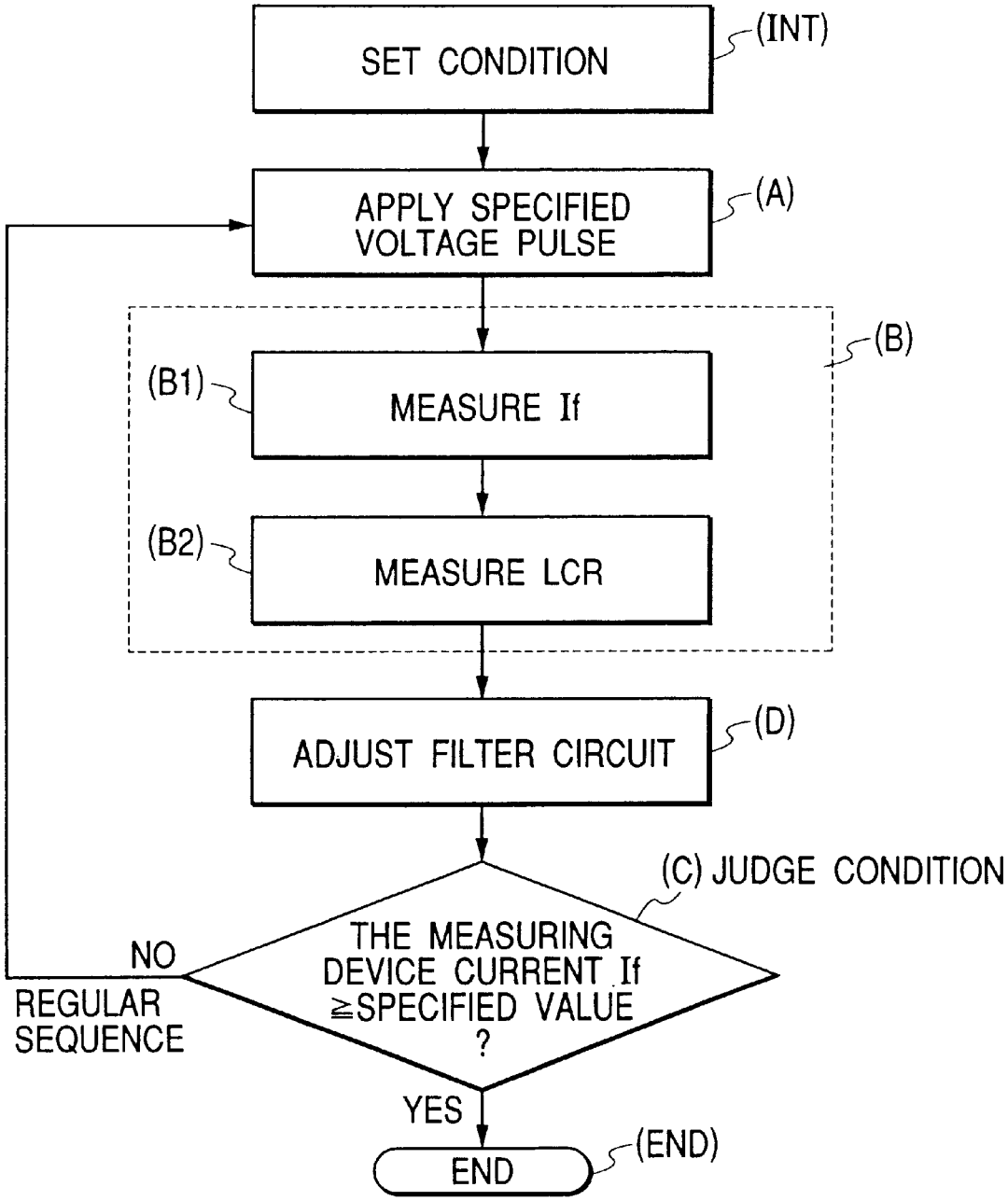
FIG. 26 is a flow chart showing an energization forming process of the apparatus of FIG. 25.

Next, operation of a controller 104 in the energization forming of this embodiment is described with reference to a flow chart in FIG. 26.

Conditions required for the energization forming are set in STEP (INT).

The electron source substrate is brought into a highly vacuumed state and the device on which the energization forming process is to be performed is chosen by controlling the row selective circuit and the column selective circuit. The initial voltage application conditions are set.

STEP (A) is regular sequence for applying voltage.

The voltage pulse to be used for the energization is outputted at set voltage Vf, period Tw, and pulse width TP.

STEP (B1) is measurement sequence for the device current and the emission current.

In this embodiment, the device current is measured using the pulse voltage that is used in the forming process. The device current If is measured with the use of this pulse voltage. Here, only the device current If is measured and measurement of the emission current Ie is not carried out.

STEP (B2) is LCR measurement sequence with the LCR meter.

The application of voltage is stopped and the circuit is switched to the LCR measurement system to measure the impedance. In this embodiment, the impedance measurement is conducted at any time.

STEP (C) is judging sequence for continuation of the forming process.

Judgement is made whether or not the value of the device current If measured in STEP (B1) is smaller than the preset value 1 $\mu$A. When the If has smaller value than 1 $\mu$A, the process proceeds to completion sequence [STEP (END)]. On the other hand, the If value larger than 1 $\mu$A brings the process to regular sequence for applying voltage [STEP (A)].

STEP (D) is the LCR variable sequence of the filter circuit.

The ringing control parameters are changed in accordance with the value of LCR measured in STEP (B2).

STEP (END) is completion sequence.

Application of voltage from the row side and the column side is stopped to end the energization forming process.

The description above is about the row wires, but the process may be conducted for every column wire.

According to the method used herein, the voltage pulse Vf used in the regular sequence serves also as the measurement pulse to constantly detect a device current.

The device current If is constantly measured here, but the regular sequence may be stopped to put in sequence for measurement.

Employment of this method makes it possible to suppress occurrence of excess voltage, as compared to conventional forming methods, thereby obtaining an electron source with the desired device current excellent in reproductivity.

Embodiment 4

This embodiment employs a voltage applying method of the energization forming process, which is different from Embodiments 1, 2 and 3. A method of a ringing control also differs in this embodiment.

This embodiment is to show that the application voltage method different from Embodiments 1, 2 and 3 also can suppress occurrence of abnormal voltage.

First, the structure of an energization forming apparatus used in this embodiment is described.

The structure of the energization apparatus in this embodiment is similar to that of the apparatus in Embodiment 1. However, "the structure and operation of the row side power supply and of the column side power supply, and operation of the column side selective circuit" is different.

Figure 27:
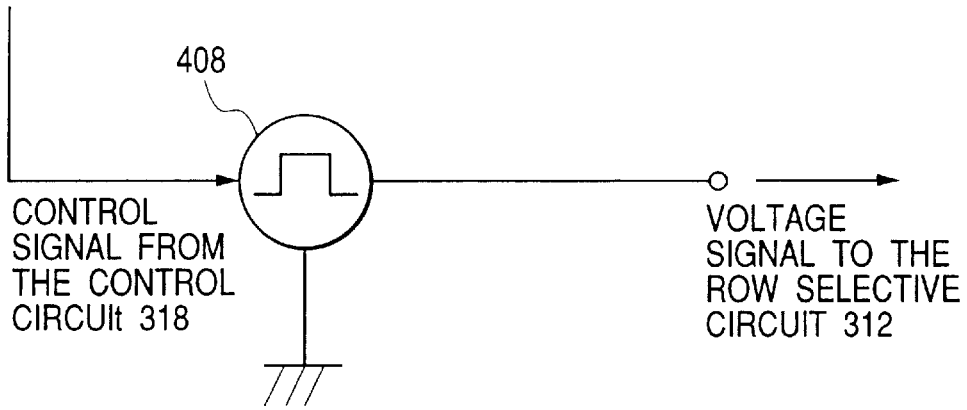
FIG. 27 is a block diagram showing the structure of a row side power supply in accordance with Embodiment 4 of the present invention.

First, the row side power supply circuit is described with reference to FIG. 27.

Unlike Embodiment 1, the power supply circuit of this embodiment has no filter circuit. The voltage pulse to be outputted may have a rectangular pulse waveform.

In this embodiment, the ringing is controlled by inputting the voltage pulse from the row side and from the column side.

The description here handles only the row side. However, the column side power supply circuit has the same structure.

Next, the operation of the column side selective circuit is explained.

Figure 28A:
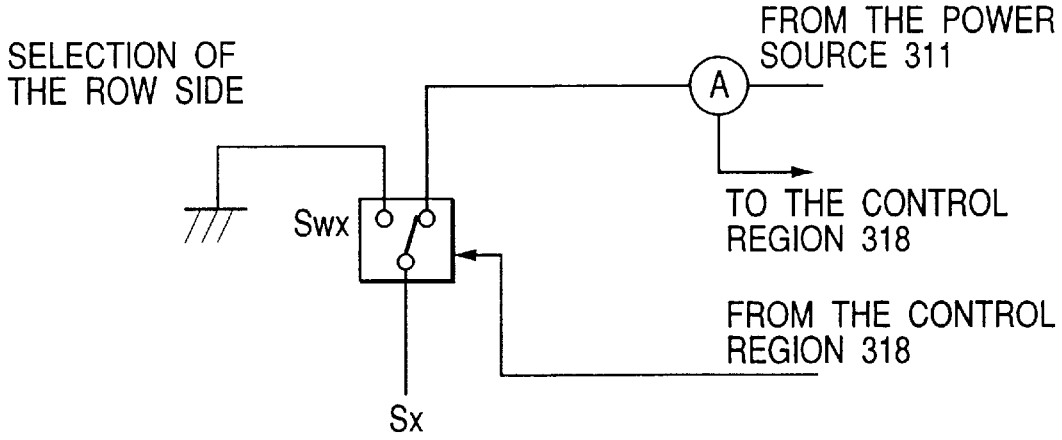
FIGS. 28A and 28B are circuit diagrams each showing a row selective circuit and a column selective circuit in the apparatus of FIG. 27.
Figure 28B:
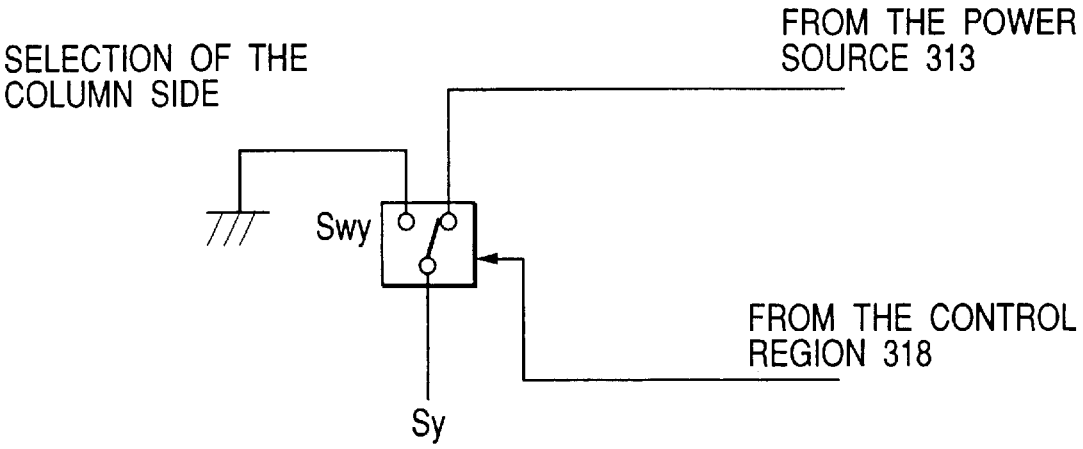

FIG. 28B shows the column side selective circuit. As illustrated in this drawing, the electron source is connected to the column side power supply in the energization process.

Subsequently, a description is given on a procedure for carrying out the energization forming of the electron source using the apparatus of this embodiment.

The following is a description of the forming process.

In this case, the energization forming process is ended when the device current reaches 1 $\mu$A.

The electric circuit connection diagram of the electron source substrate is similar to the diagram shown in FIG. 36.

First, a vacuum container having the electron source substrate on which the electroconductive thin film is formed is vacuum-sucked to $1\times10^{-5}$ [Torr].

Figure 53A:
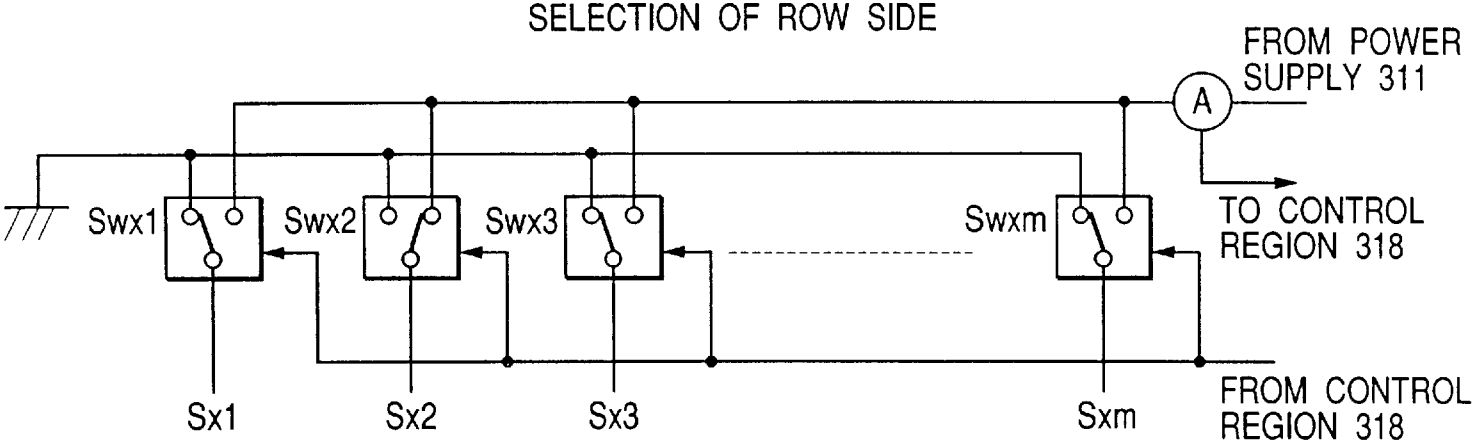
FIGS. 53A and 53B are schematic views showing a structure of a row selective circuit and a column selective circuit in the apparatus of FIG. 52, respectively.
Figure 53B:
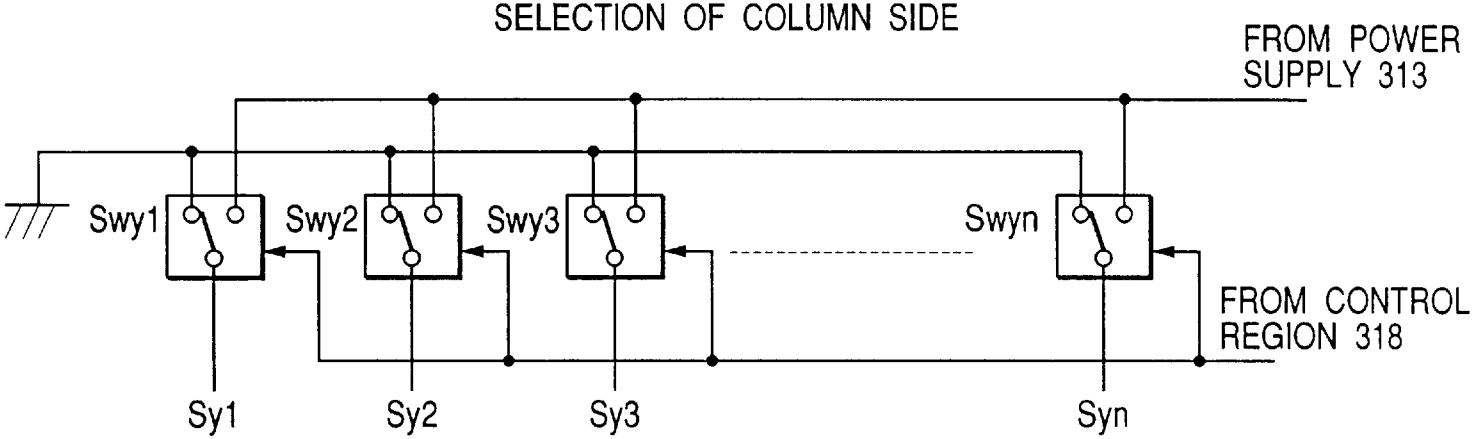

Next, in order to perform the energization process on the devices in the second row, switches of the row selective circuit 312 and the column selective circuit 314 are switched over as shown in FIGS. 53A and 53B, and the voltage is then applied from the power supplies 311, 313.

Figures 29A, 29B, 29C:
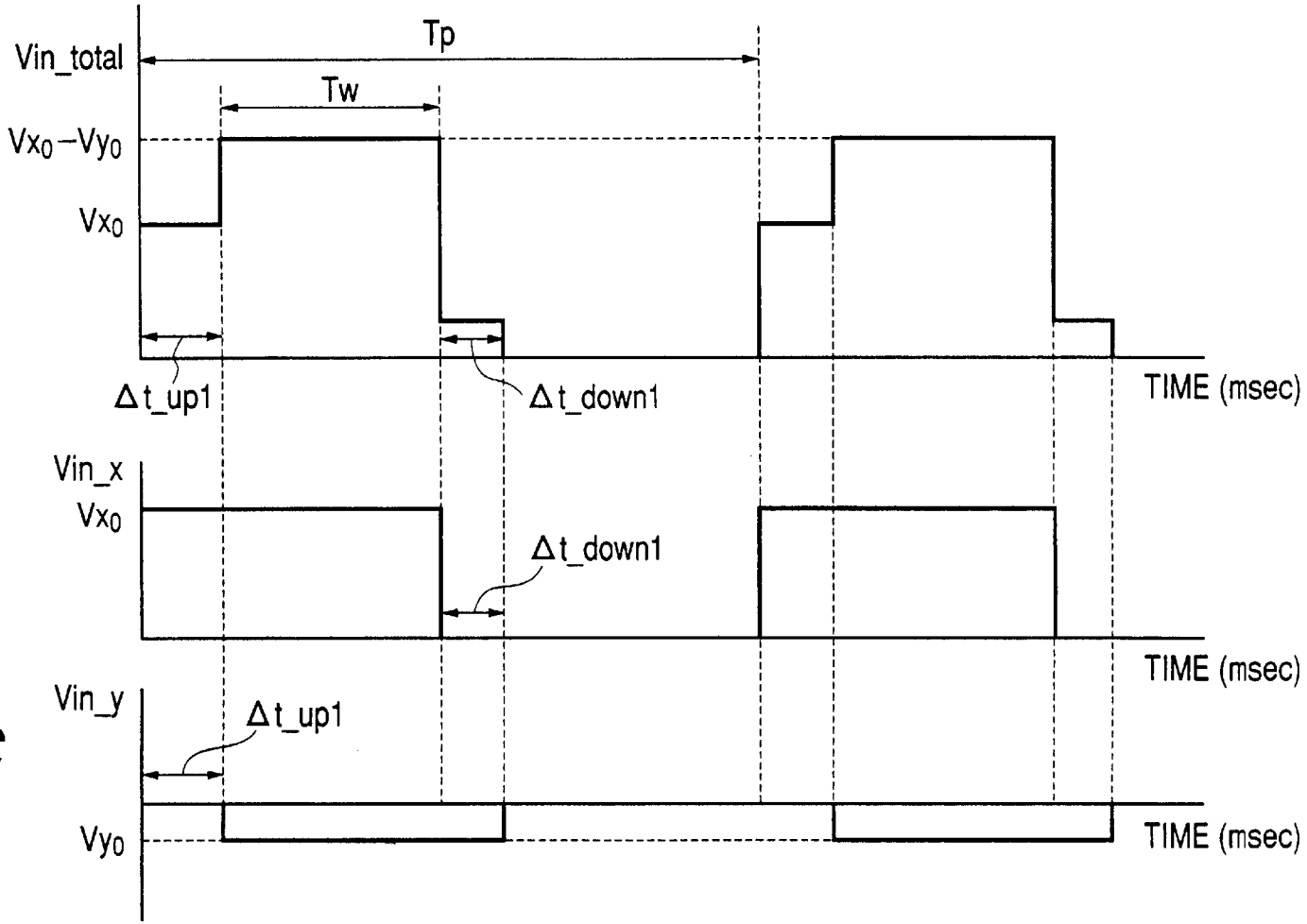
FIGS. 29A, 29B and 29C are views each showing an applied voltage waveform of the apparatus of FIG. 25.

The waveform of the voltage applied at this time is shown in FIGS. 29A to 29C.

FIGS. 29A to 29C show the applied voltage. FIG. 29B shows voltage Vin_x applied from the row side, and FIG. 29C shows voltage Vin_y applied from the column side. FIG. 29A shows voltage (Vin_x−Vin_y) applied to the electron source.

The waveform of the applied voltage has a pulse width of 1 msec (Tw) and a pulse period of 10 msec (Tp). The row directional voltage Vx0 is set to 5 V and the column directional voltage Vy0 is set to −5 V so that the voltage (Vin_x−Vin_y) applied to the electron source is 10 V. The rise delay time on the row side is designed to have a value Δt_up1, and the fall delay time on the column side, Δt_down1.

The output voltage of the high-voltage power supply 315 is set to 0 [V], for the emission current is not measured.

A description is next given on design of the row side applied voltage Vin_x, the column side applied voltage Vin_y, the rise delay time Δt_up and the fall delay time Δt_down.

The impedance fluctuation during the process in an electron source substrate 310 equivalent to the electron source substrate 310 (a matrix wiring including the surface conduction electron-emitting device) that is used in this embodiment is measured in advance using the energization apparatus 300. As a result, only the resistance component fluctuates while the inductance (L) component and the capacitance (C) component are constant.

At this time, the inductance component L is 1 nH, the capacitance component is 40 pF, and the resistance component fluctuates from 3 Ω to 30 MΩ (the resistance change during the energization forming is shown in FIG. 37).

The row side applied voltage Vin_x, the column side applied voltage Vin_y, the rise delay time Δt_up and the fall delay time Δt_down are designed using those values.

For evaluation, the inductance, the capacitance component and the fluctuation in resistance component are put into the equations (13), (14), and the rise voltage error threshold value voltage V_up_th is set to 12 V and the fall voltage error threshold value voltage V_down_th is set to 2 V. As a result of the evaluation, the applied voltage Vin_x, Vin_y are each set to 5 V, and the rise delay time Δt_up1 and the fall delay time Δt_down1 are each set to 3.1 nsec.

Conducting the energization forming with voltage application based on the above conditions results in completion of the process without applying abnormal voltage to the electroconductive thin film.

Employment of this method makes it possible to suppress occurrence of excess voltage, as compared to conventional forming methods, thereby obtaining an electron source having desired device current with good reproductivity.

Figure 22:
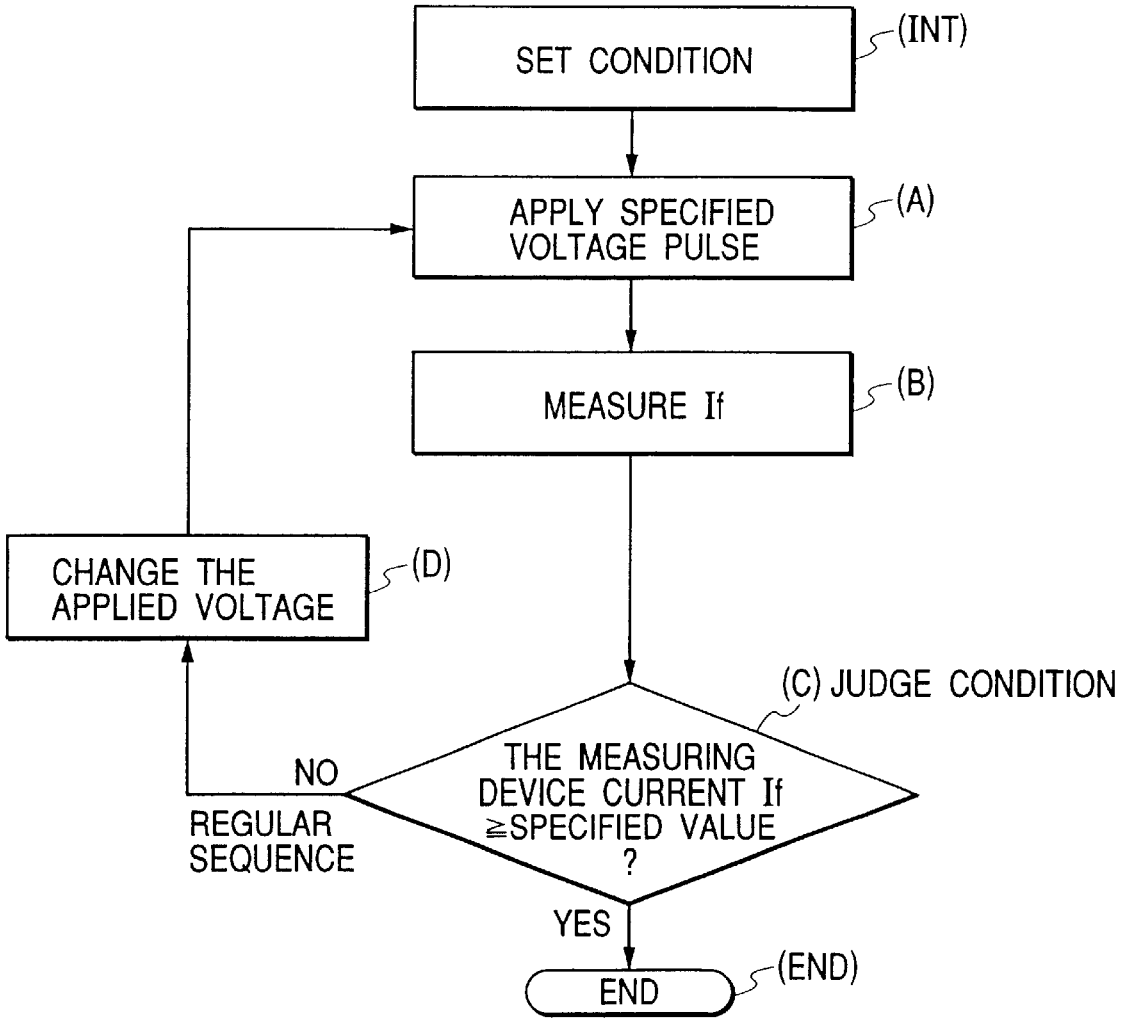
FIG. 22 is a flow chart showing an energization forming process of the apparatus of FIG. 18.

Operation of the controller 104 in the energization forming of this embodiment is the same as in FIG. 22 and its explanation is therefore omitted here.

According to the method used herein, the voltage pulse Vf used in the regular sequence serves also as the measurement pulse to constantly detect the device current.

The device current If is constantly detected here, but the regular sequence may be stopped to put in sequence for measurement.

Employment of this method makes it possible to suppress occurrence of excess voltage, as compared to conventional forming methods, thereby obtaining an electron source having desired device current with good reproductivity.

Embodiment 5

In this embodiment, the frequency band of the applied pulse is restricted by the same method as in Embodiment 1. However, this embodiment is different from the proceeding embodiments in that this method is used in the energizing activation.

As to the impedance fluctuation when energized in the energizing activation process, resistance component is greatly reduced, which differs from Embodiment 1.

In the energizing activation process to be described below, a surface conduction electron-emitting device is energized through row wires, and application of voltage is ended when the device current reaches a prescript value. The frequency band of energization pulse is calculated on the basis of a previously measured resistance value in energizing activation, and a low-pass filter circuit is used to restrict the frequency band. The allowable range for the applied voltage is set such that the voltage error is contained within 160 mV with respect to the peak value of 16 V for the applied voltage pulse. In other words, the excess voltage threshold value is set to 160 mV.

Employment of this method makes it possible to suppress occurrence of abnormal voltage, as compared to conventional energization methods, thereby obtaining an electron source with unified device current characteristic.

Now, a description of this embodiment is given.

The structure of an energization apparatus to be used in this embodiment is the same as that of the apparatus in Embodiment 1.

Subsequently, a description is given on a procedure of performing energizing activation on the electron source with the use of the apparatus of this embodiment.

The following description deals with the activation process. The process is ended when the device current in each row reaches 2 mA.

First, $1\times10^{-5}$ [Torr] of acetone is introduced as activation gas into a vacuum container having the electron source substrate that has undergone the aforementioned forming operation.

Next, in order to perform the activation process on the devices in the second row, switches of a row selective circuit 312 and a column selective circuit 314 are switched over as shown in FIGS. 19A and 19B, and the voltage is then applied from power supplies 311, 313.

Next, in order to perform the energization process on the devices in the second row, switches of a row selective circuit 312 and a column selective circuit 314 are switched over as shown in FIGS. 19A and 19B, and the voltage is then applied from power supplies 311, 313.

The waveform of the voltage applied at this time is shown in FIG. 21. FIG. 21 shows the voltage applied from the row side.

The waveform of the voltage applied from the row side has a pulse width of 1 msec: (Tw) and a pulse period of 10 msec (Tp). The pulse rise time Tu is set to about 0 nsec, and the pulse fall time Td is set to about 0 nsec. Vf0 is set to 16 V so that the voltage applied to the devices is 16 V.

A description is next given on the design value of the low-pass filter.

The impedance fluctuation during the energization forming in an electron source substrate 310 (a matrix wiring including the surface conduction electron-emitting device) and an energization apparatus which are used in this embodiment is measured in advance using another electron source substrate. As a result, only the resistance component fluctuates while the inductance (L) component and the capacitance (C) component are constant. The inductance component L is 1 nH, the capacitance component is 40 pF, and the resistance component fluctuates from 30 MΩ to 8 KΩ (FIG. 38 shows the resistance change during the energizing activation).

The low-pass filter is designed using those values.

Those values are put into the equation (1) to obtain gain function |V out/V in|, calculating a frequency band with which gain Ap is equal to or less than 1.01 (the excess voltage threshold value is equal to or less than 160 mV). The result of the calculation tells that the frequency in a band of $8\times10^6$ Hz or less does not cause abnormal voltage (voltage that does not exceed the gain allowable error).

To cut off the frequency over $8\times10^6$ Hz, R and C of the low-pass filter in the circuit diagram 3 are set to 2 mΩ and 11 μF, respectively.

The filter circuit of the row wire power supply is formed using those values.

Conducting the energizing activation with voltage application based on the above conditions results in completion of the process without applying abnormal voltage to an electroconductive thin film.

The energizing activation of this embodiment is similarly performed on other rows, obtaining electron-emitting characteristic uniform all over the surface.

Next, operation of a controller 104 in the energizing activation in accordance with this embodiment is described with reference to the flow chart of FIG. 22.

Conditions required for the energizing activation are set in STEP (INT).

Activation gas is introduced and the device on which the energizing activation is performed is chosen by controlling the row selective circuit and the column selective circuit. The initial voltage application conditions are set and so do R and C for use in the filter circuit.

STEP (A) is regular sequence for applying voltage.

The voltage pulse to be used for energization is outputted at set voltage Vf, period Tw and pulse width Tp.

STEP (B) is measurement sequence of the device current and the emission current.

In this embodiment, the device current is measured using the pulse voltage that is used in the activation process. The device current If is measured with the use of this pulse voltage. Here, only the device current If is measured and measurement of the emission current Ie is not carried out.

STEP (C) is judgement sequence for continuation of the activation process.

Judgement is made whether or not the value of the device current If measured in STEP (B) is larger than the preset value 2 mA. When the If has larger value than 2 mA, the process proceeds to completion sequence (STEP (END)). On the other hand, the If value smaller than 2 mA brings the process to application volt-age changing sequence (STEP (D)).

STEP (END) is completion sequence.

Application of voltage from both the row side and the column side is stopped to end the energizing activation process.

As described above, it can be understood that the same method as in the energization forming process is effective also in the energizing activation process.

Needless to say, the methods as in Embodiments 2, 3, 4 are also effectively used ,or the energizing activation process.

A similar effect can be obtained in the energization process where the resistance of the surface conduction electron-emitting device fluctuates, such as the preliminary driving process and the panel degassing process. In this embodiment, the inductance component L and the capacitance component C hardly change in the preliminary driving process and the panel degassing process. The main cause of the impedance fluctuation is the resistance component, and the resistance changes in each process "from 8 KΩ to 8.8 KΩ", "from 8.8 Ω to 11 KΩ."

By designing a high frequency filter using those values, the effect can be obtained also in the preliminary driving process and the aging operation process.

It is needless to say that the methods in Embodiments 1, 2, 3 are effective also in the energizing activation process, the preliminary driving process and the aging process.

In the energization forming process, the energizing activation process, the preliminary driving process and the aging process, a method of restricting ringing with the low-pass filter is effective in the case of employing the energization process where voltages different in polarity are applied from the row wires and the column wires.

In the energization forming process, the energizing activation process, the preliminary driving process and the aging process, it is also an effective method to restrict ringing in accordance with the impedance fluctuation during the energization in the case of applying energization process in which voltages different in polarity are applied from the row wires and the column wires.

Embodiment 6

This embodiment is an example of a method of manufacturing an image display device having a substrate on which a multitude of electroconductive thin films are arranged in simple matrix (number of devices: 1024×3072), showing mainly an energization forming process of an electron source.

In the energization forming process of an electron source described below, the energization forming is conducted for every row wire and the application of voltage is ended when the device current reaches a prescript value. The frequency band of energization pulse is calculated on the basis of a previously measured resistance value in the energization forming, and a low-pass filter circuit is used to restrict the frequency band. The allowable range for the applied voltage is set such that the voltage error is contained within 100 [mV] with respect to the peak value of 10 [V] for the applied voltage pulse. In other words, the excess voltage threshold value is set to 100 [mV].

Employment of this method makes it possible to suppress occurrence of abnormal voltage, as compared to conventional energization methods, thereby obtaining an electron source with unified device current characteristic.

First, the structure of an energization apparatus to be used in this embodiment is described.

A specific description of this embodiment is given below with reference to FIG. 52, FIGS. 53A and 53B, FIG. 20, and FIG. 54.

Figure 52:
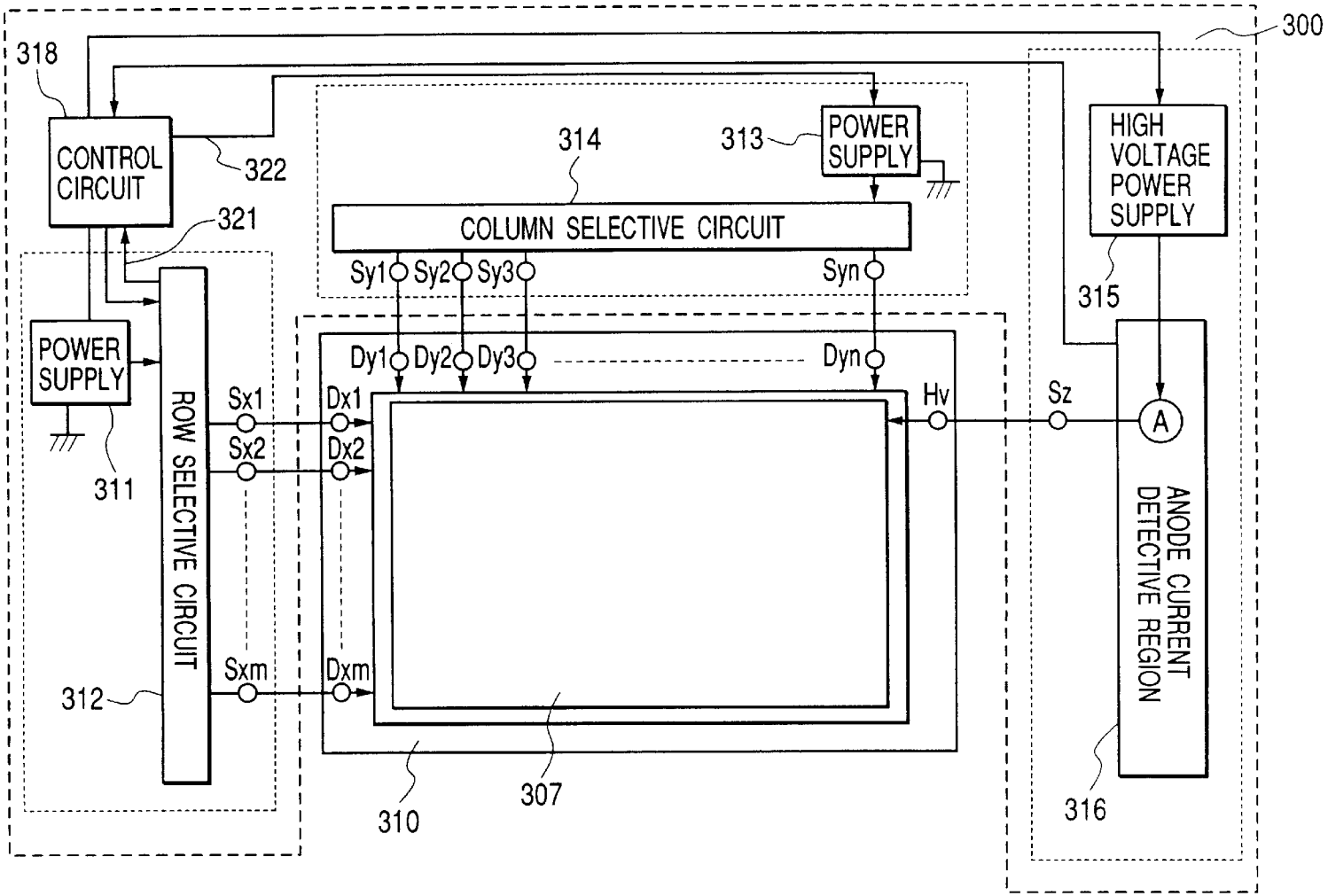
FIG. 52 is a schematic view showing an energization apparatus in accordance with the present invention.

FIG. 52 is a block diagram showing the structure of an energization apparatus in this embodiment. The electron source substrate shown in FIG. 48 is connected as shown in FIG. 52 to conduct the energization forming operation.

Reference numeral 310 denotes an image display device (FIG. 42) with electron-emitting devices 74 (electroconductive thin films) arranged into a simple matrix wiring of m rows×n columns (m=1024, n=3072, in this embodiment). The image display device is connected to a not-shown evacuating apparatus and the inside of the apparatus is evacuated to about $10^{-4}$ to $10^{-5}$ [Torr]. On the electron source substrate, row-directional wires Dx1 to Dxm are connected to Sx1 to Sxm of an energization operation apparatus 300, and column-directional wires Dy1 to Dyn are connected to Sy1 to Syn of the energization operation apparatus 300.

Further, an anode electrode Hv is connected to Sz of the energization operation apparatus 300. However, voltage is not applied to the anode electrode Hv in this embodiment.

Reference numeral 311 denotes a power supply on the row wire side, for generating the voltage pulse. Denoted by 312 is a row wire selective region for selecting an arbitrary row. The row wire selective region has a measurement system for applying the voltage pulse generated in the power supply to an arbitrary row and for measuring current. Reference numeral 313 denotes a power supply on the column wire side, for generating the voltage pulse. Denoted by 314 is a column wire selective region for applying the voltage pulse generated in the power supply to an arbitrary column. Reference numeral 315 denotes an anode power supply for supplying voltage to an anode electrode 307, and 316 denotes a current detecting region for measuring emission current led out by the anode electrode. As voltage is not applied to the anode electrode 307 in this embodiment, the measurement of emission current is not carried out.

A control circuit 318 controls the power supplies 311, 313, the row wire selective region 312 and the column wire selective region 314 on the basis of a device current value 321 detected at the row selective circuit 312.

Next, the selective circuits are described with reference to FIGS. 53A and 53B.

FIGS. 53A and 53B illustrate the row selective circuit 312 and the column selective circuit 314, respectively.

These selective circuits are comprised of switches such as a relay and an analogue switch. In the row selective circuit 312, m pieces of switches Swx1 to Swxm are arranged in parallel and the output of each switch is connected to each of row directional wire terminals Dx1 to Dxm of the electron source substrate. Also, an ammeter is connected.

The column selective circuit has the structure similar to that of the row selective circuit.

In FIGS. 53A and 53B, all the row selective switches except for the one in the second row and all of the column selective switches are grounded, indicating that the second row is selected.

Next, the row side power supply 311 is described with reference to FIG. 52.

FIG. 20 is a diagram showing the power supply and a filter circuit of this embodiment.

The circuit in the drawing comprises a power supply 401 that generates a pulse and a low-pass filter 402 that cuts off high frequency component of the output pulse. The power supply 401 generates a pulse waveform in response to a signal from the control circuit 318.

The output in this embodiment only comes from the row wires, so that the column side power supply 313 does not include any filter circuit. The output of the column side power supply is 0 V.

Subsequently, a description is given on a procedure for carrying out the energization forming of the electron source using the apparatus of this embodiment.

In this embodiment, a process of conducting the energization for every row wire (or column wire) (hereinafter, abbreviated as line forming process) is employed as a method of performing the energization forming on a multitude of devices.

The following is a description of the line forming process performed on the devices in the second row.

In this case, the energization forming process is ended when the device current in each row reaches 10 [mA].

First, a vacuum container having the electron source substrate on which the electroconductive thin film is formed is vacuum-sucked to $1\times10^{-5}$ [Torr].

Next, in order to perform the energization process on the devices in the second row, switches of the row selective circuit 312 and the column selective circuit 314 are switched over as shown in FIGS. 53A and 53B, and the voltage is then applied from the power supplies 311, 313.

The waveform of the voltage applied at this time is shown in FIG. 21.

FIG. 21 shows the voltage applied from the row side.

The waveform of the voltage applied from the row side has a pulse width (Tw) of 1 [msec] and a pulse period (Tp) of 10 [msec]. The pulse rise time Tu is set to about 0 [nsec], and the pulse fall time Td is set to about 0 [nsec]. Vf0 is set to 10 [V] so that the voltage applied to the devices is 10 [V].

The output voltage of the high-voltage power supply 315 is set to 0 [V], for the emission current is not measured as mentioned above.

A description is next given on the design of the low-pass filter.

The impedance fluctuation during the process in an electron source substrate 310 equivalent to the electron source substrate 310 (a matrix wiring including the surface conduction electron-emitting device) that is used in this embodiment is measured in advance using the energization apparatus 300 from which the low-pass filter is taken out. As a result, only the resistance component fluctuates while the inductance (L) component and the capacitance (C) component are constant.

At this time, the inductance component L is 0.1 [AH], the capacitance component is 0.04 [Ω], and the resistance component fluctuates from 3 [Ω] to 30 [MΩ] (FIG. 37 shows the resistance change during the energization forming).

The low-pass filter is designed using those values.

Those values are put into the equation (1) to obtain gain function |V out/V in|, calculating a frequency band with which gain Ap is equal to or less than 1.01 (the excess voltage threshold value is equal to or less than 100 [mV]). The result of the calculation tells that the frequency in a band of 8×106 [Hz] or less does not cause output of excess voltage.

To cut off the frequency over $8\times10^{6}$ Hz, R, C of the low-pass filter in FIG. 20 are set to 2 [mΩ] and 11 [μF], respectively.

The filter circuit of the row wire power supply is formed using those values.

Conducting the energization forming with voltage application based on the above conditions results in completion of the process without applying abnormal voltage to the electroconductive thin film.

The energization forming of this embodiment is similarly performed on other rows to form the electron source, obtaining electron-emitting characteristic uniform all over the surface.

Figure 54:
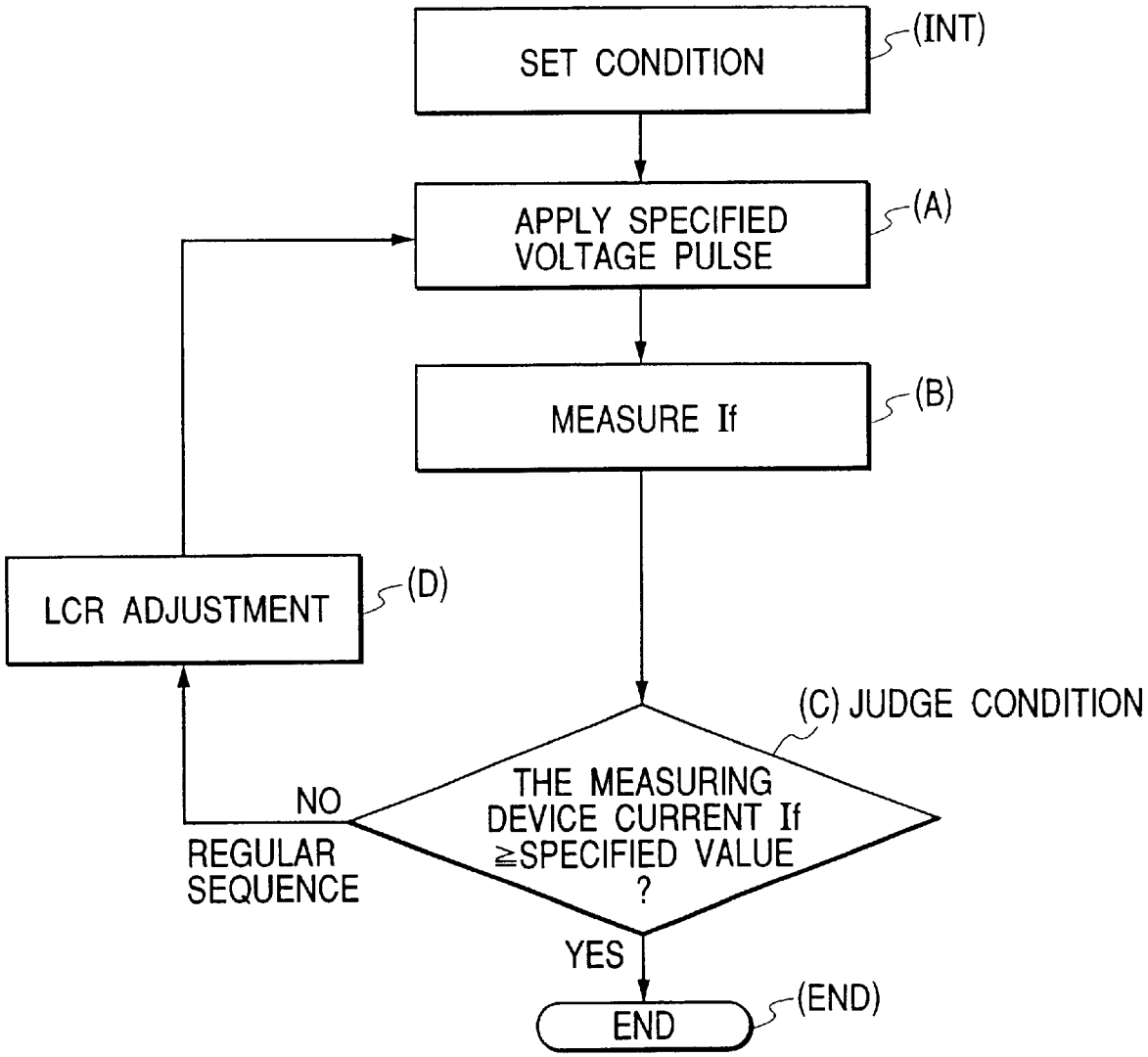
FIG. 54 is an exemplified flow chart showing a process in accordance of the present invention.

Next, operation of a controller 104 in the energization forming of this embodiment is described with reference to the flow chart of FIG. 54.

Conditions required for the energization forming are set in STEP (INT).

First, the electron source substrate is brought into a highly vacuumed state. Next, the device on which the energization forming process is to be performed is chosen by controlling the row selective circuit and the column selective circuit. The initial voltage application conditions are set and so do R and C for use in the filter circuit.

STEP (A) is regular sequence for applying voltage.

The voltage pulse to be used for energization is outputted at set voltage Vf, period Tw and pulse width Tp.

STEP (B) is measurement sequence of the device current and the emission current.

In this embodiment, the device current is measured using the pulse voltage that is used in the forming process. The device current If is measured with the use of this pulse voltage. Here, only the device current If is measured and measurement of the emission current Ie is not carried out.

STEP (C) is judgement sequence for continuation of the forming process.

Judgement is made whether or not the value of the device current If measured in STEP (B) is smaller than the preset value 10 [mA]. When the If has smaller value than 10 [mA], the process proceeds to completion sequence (STEP (END)). On the other hand, the If value larger than 10 [mA] brings the process to LCR adjustment sequence (STEP (D)).

STEP (END) is completion sequence.

Application of voltage from both the row side and the column side is stopped to end the energization forming process.

Though shown in this embodiment is the case where the energization forming process is conducted for every row, the process may be carried out in column unit.

According to the method used herein, the voltage pulse Vf used in the regular sequence serves also as the measurement pulse to constantly detect the device current.

The device current If is constantly detected here, but the regular sequence may be stopped to put in sequence for measurement.

Employment of this method makes it possible to suppress occurrence of excess voltage, as compared to conventional forming methods, thereby obtaining an electron source with more unified device current.

Figure 62:
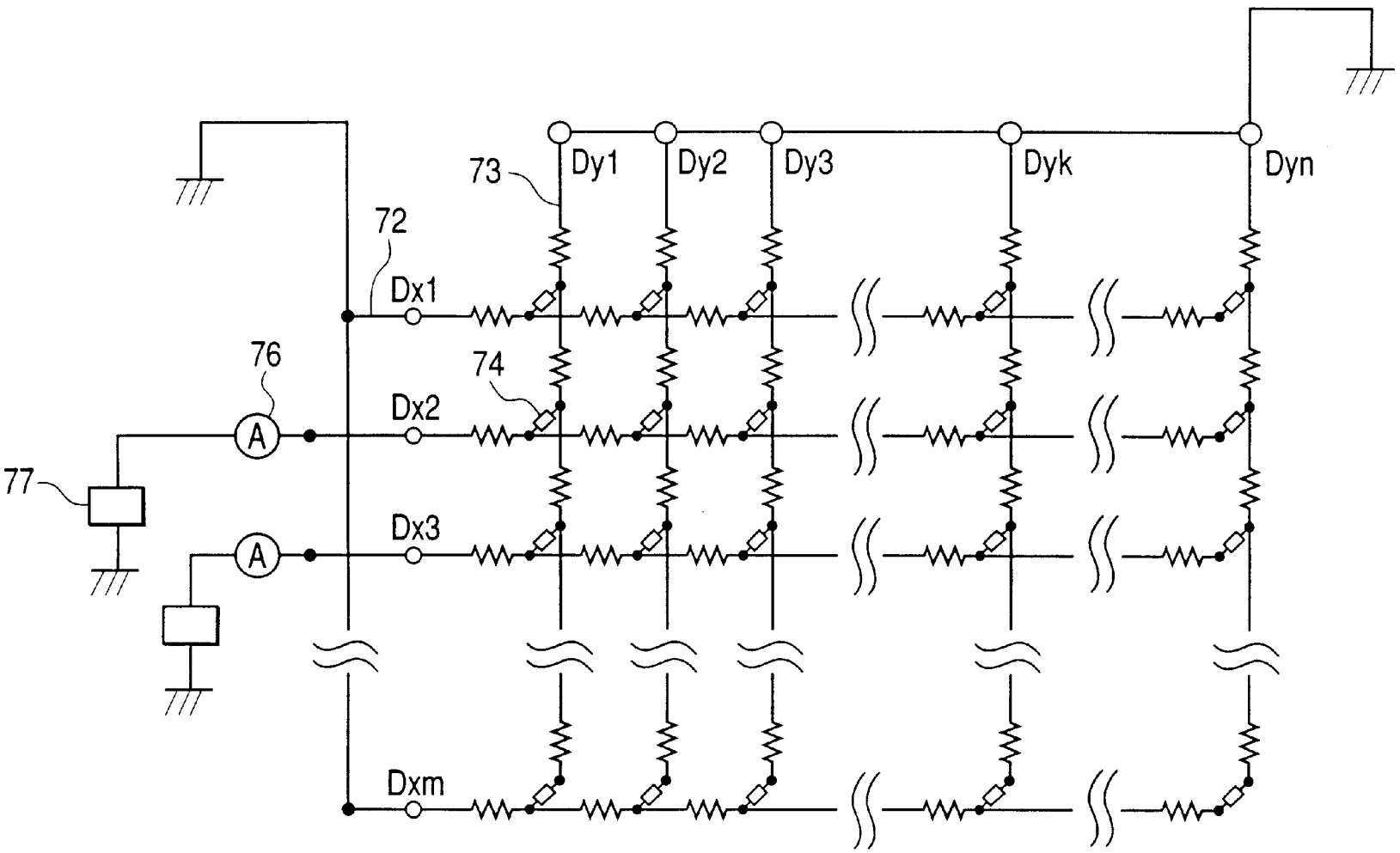
FIG. 62 is a view showing still another energization method of the present invention.

This embodiment shows the case where the energization forming process is conducted row by row. However, the band restriction of the voltage pulse described in this embodiment is effective also when the energization forming process is performed by applying voltage to devices in a plurality of rows at once as shown in FIG. 62. The band is restricted at $8\times10^6$ [Hz] or less, as in the above.

As shown in FIG. 62, in order to apply voltage to the second and the third rows, the Sx2 and Sx3 of the row selective circuit 312 have to be switched over so that the power supply and the electron source are connected to each other. When carrying out the energization forming operation explained above after setting the selective circuit, occurrence of excess voltage can be suppressed, as compared to conventional forming methods, thereby obtaining an electron source with more unified device current.

Embodiment 7

This embodiment employs a voltage application method in the energization forming process, which is different from the one in Embodiment 6. A method of restricting the band of the voltage pulse also differs in this embodiment.

This embodiment is to show that the application voltage method different from the method in Embodiment 6 also can suppress occurrence of abnormal voltage.

According to the voltage application method in this embodiment, voltage is applied from the row wire direction and the column wire direction at the same time. The band of the voltage pulse is restricted with the introduction of low-pass filters that cut of the high frequency component on the row side and on the column side.

The description here relates to the difference between this embodiment and Embodiment 6.

First, the structure of an energization forming apparatus used in this embodiment is described.

The structure of the energization apparatus in this embodiment is similar to that of the apparatus in Embodiment 6. However, different "selective circuits and their operation" and different "row side power supply, column side power supply circuit and their operation" are shown here.

First, the selective circuits are described with reference to FIGS. 55A and 55B.

Figure 55A:
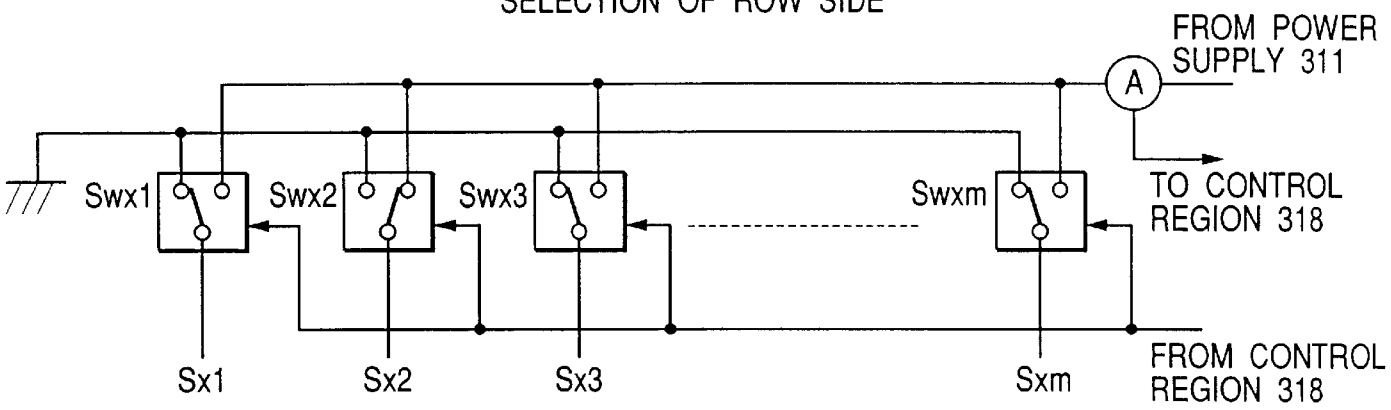
FIGS. 55A and 55B are schematic views showing another structure of a row selective circuit and a column selective circuit in the apparatus of FIG. 52, respectively.
Figure 55B:
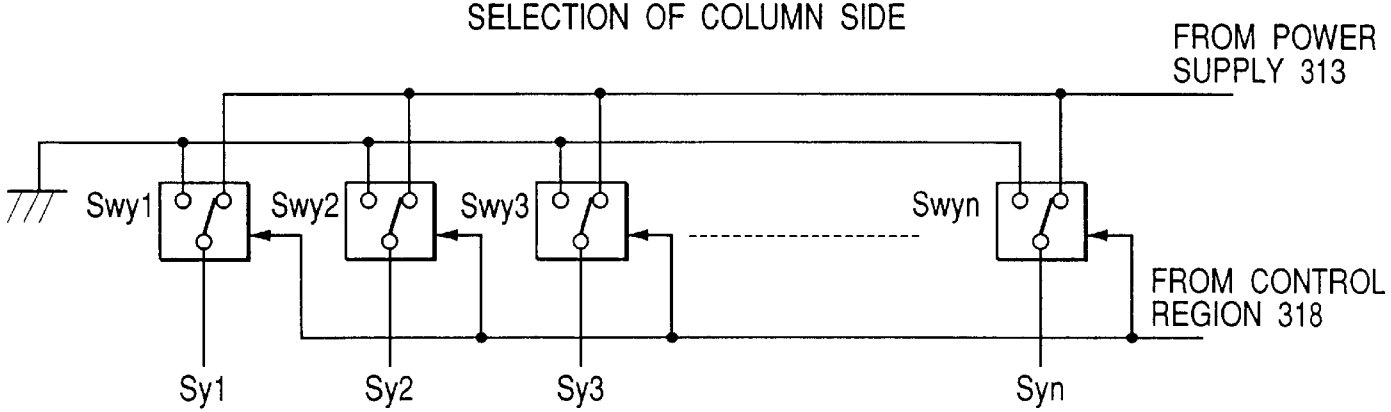

FIGS. 55A and 55B illustrate the row selective circuit 312 and the column selective circuit 314, respectively.

These selective circuits are comprised of switches such as a relay and an analogue switch. In the row direction, m pieces of switches Swx1 to Swxm are arranged in parallel and the output of each switch is connected to each of row directional wire terminals Dx1 to Dxm of the electron source substrate. An ammeter is also connected.

Similarly in the column direction, n pieces of switches Swy1 to Swym are arranged in parallel and the output of each switch is connected to each of column directional wire terminals Dy1 to Dyn of the electron source substrate.

These switches are controlled by the control region 318, and operate so that the voltage waveform from the power supplies 311, 313 is applied to the line on which the energization forming is to be performed.

FIGS. 55A and 55B illustrate the case where the energization forming process is performed on the devices in the second row. In the drawings, only in the second row the power supply and the electron source substrate are connected and the rest of the row side wires are all grounded. The power supply and the electron source are all connected on the column side in order to apply voltage to all of the column side wires.

Next, the row side power supply 311 and the column side power supply 313 are described.

The difference from the ones in Embodiment 6 is that the column side power supply 313 also has a filter circuit.

Subsequently, a description is given on a procedure for carrying out the energization forming of the electron source using the apparatus of this embodiment.

In this embodiment, a process of conducting the energization for every row wire (or column wire) (hereinafter, abbreviated as line forming process) is employed as a method of performing the energization forming on a multitude of devices. A detailed description of the process will be given later.

The following is a description of the line forming process performed on the devices in the second row.

In this case, the energization forming process is ended when the device current in each row reaches 10 [mA].

First, a vacuum container having the electron source substrate that has undergone the aforementioned forming operation is vacuum-sucked to a vacuum atmosphere of $1\times10^{-5}$ [Torr].

Next, in order to perform the activation process on the devices in the second row, switches of the row selective circuit 312 and the column selective circuit 314 are switched over as shown in FIGS. 55A and 55B, and the voltage is then applied from the power supplies 311, 313.

Figure 56:
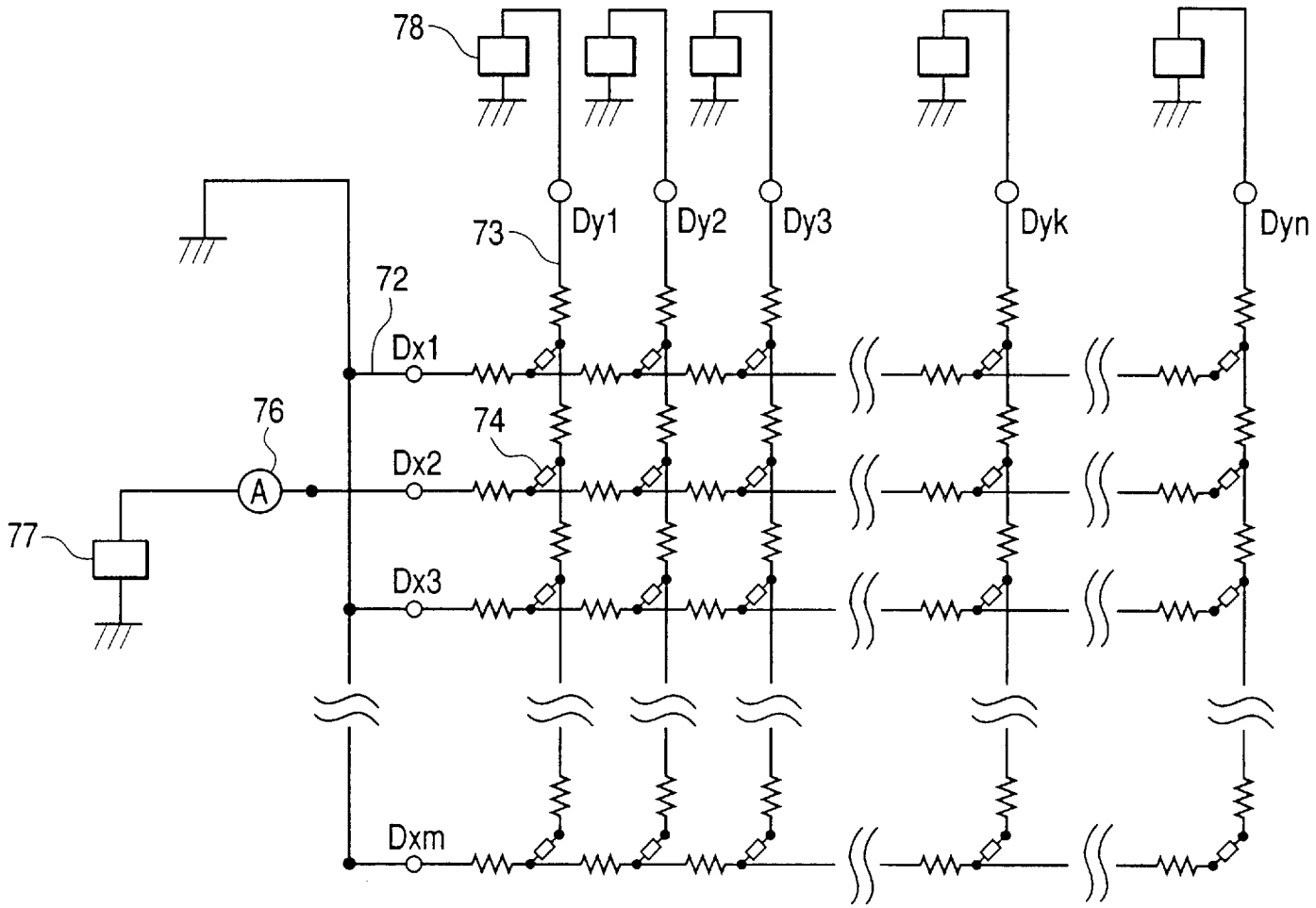
FIG. 56 is a view showing an energization method.

FIG. 56 shows an electric circuit connection diagram of the electron source substrate. The waveform of the voltage applied at this time is shown in FIGS. 57A to 57C.

Figures 57A, 57B, 57C:
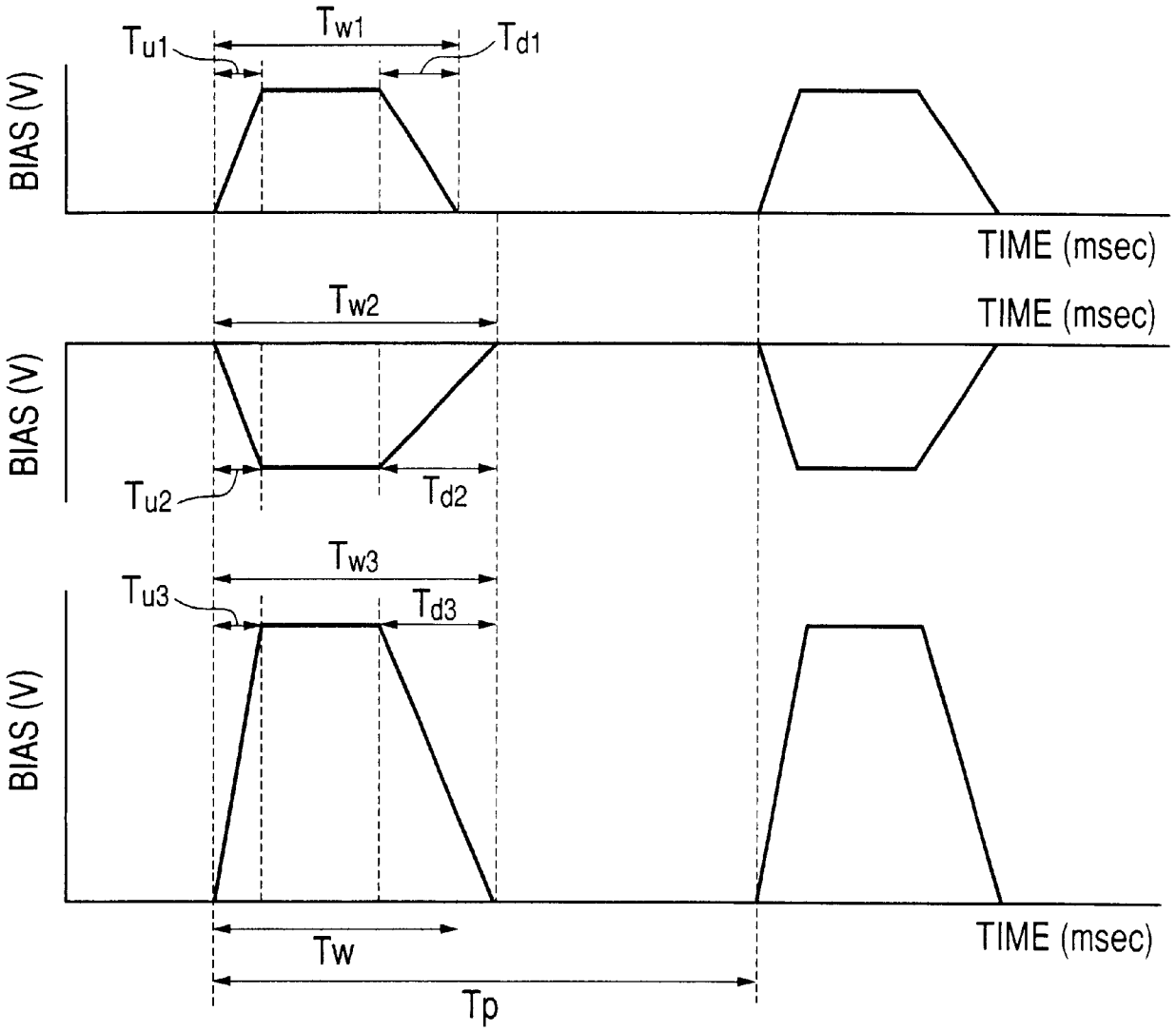
FIGS. 57A, 57B and 57C are views showing an example of a waveform of an applied pulse voltage in accordance with the present invention.

FIGS. 57A and 57B snow the voltage applied to the devices from the row side and from the column side, respectively. FIG. 57C shows the voltage waveform substantially applied to the devices.

The waveform of the voltage applied from the row side and the column side has a pulse width (Tw) of 1 [msec] and a pulse period (Tp) of 10 [msec]. The pulse rise time Tu1, Tu2 are each set to about 0 [nsec], and the pulse fall time Td1, Td2 are each set to about 0 [nsec] (the pulse rise time Tu3 and the pulse fall time Td3 are both set to 0 [nsec]). The initial values Vx, Vy of the voltage are set to 5 [V], 5[V], respectively, so that the voltage applied to the devices is 10 [V].

The output voltage of the high-voltage power supply 315 is set to 0 [V], for the emission current is not measured as mentioned above.

A description is next given on the design value of the low-pass filter.

The impedance fluctuation during the process in an electron source substrate 310 (FIG. 52) equivalent to the electron source substrate 310 (a matrix wiring including the surface conduction electron-emitting device) that is used in this embodiment is measured in advance using the energization apparatus 300 from which the low-pass filter is taken out. As a result, only the resistance component fluctuates while the inductance (L) component and the capacitance (C) component are constant.

At this time, the inductance component L is 0.1 [$\mu$H], the capacitance component is 0.04 [nF], and the resistance component fluctuates from 3 [Ω] to 30 [MΩ] (FIG. 34 shows the resistance change during the energization forming).

The low-pass filter is designed using those values.

Those values are put into the equation (1) to obtain gain function |V out/V in|, calculating a frequency band with which gain Ap is equal to or less than 1.01 (the excess voltage threshold value is equal to or less than 100 [mV]). The result of the calculation tells that the frequency in a band of $8\times10^6$ [Hz] or less does not cause output of excess voltage.

To cut off the frequency over $8\times10^6$ Hz, R, C of the low-pass filter in the circuit diagram (FIG. 20) are set to 2 [mΩ] and 11 [$\mu$F], respectively.

The filter circuit of the row wire power supply is formed using those values.

Conducting the energization forming with voltage application based on the above conditions results in completion of the process without applying abnormal voltage to the electroconductive thin film.

The energization forming of this embodiment is similarly performed on other rows, obtaining electron-emitting characteristic uniform all over the surface.

Operation of the controller 104 in the energization forming of this embodiment is the same as in Embodiment 6 and its explanation is therefore omitted.

The above description is about the row wires, but the process may be conducted for every column wire.

According to the method used herein, the voltage pulse Vf used in the regular sequence serves also as the measurement pulse to constantly detect the device current.

The device current If is constantly detected here, but the regular sequence may be stopped to put in sequence for measurement.

Though shown in this embodiment is the case where the energization forming process is conducted for every row, voltage may be applied for every device to carry out the energization forming process as shown in FIG. 56.

Employment of this method makes it possible to suppress occurrence of abnormal voltage, as compared to conventional forming methods, thereby obtaining an electron source with more unified device current.

Embodiment 8

This embodiment employs a method of restricting the band of the voltage pulse which is different from the one in Embodiment 6.

In the band restriction of the voltage pulse, the impedance fluctuation during the process is measured in real time, and the frequency to be cut off is adjusted in real time in accordance with the measured impedance value.

The description here is made on the part different from Embodiment 6.

First, the structure of an energization forming apparatus used in this embodiment is described.

The structure of the energization apparatus in this embodiment is the same as in Embodiment 6. However, "the row side power supply circuit and its operation" is different.

A row side power supply 311 is described.

Figure 25:
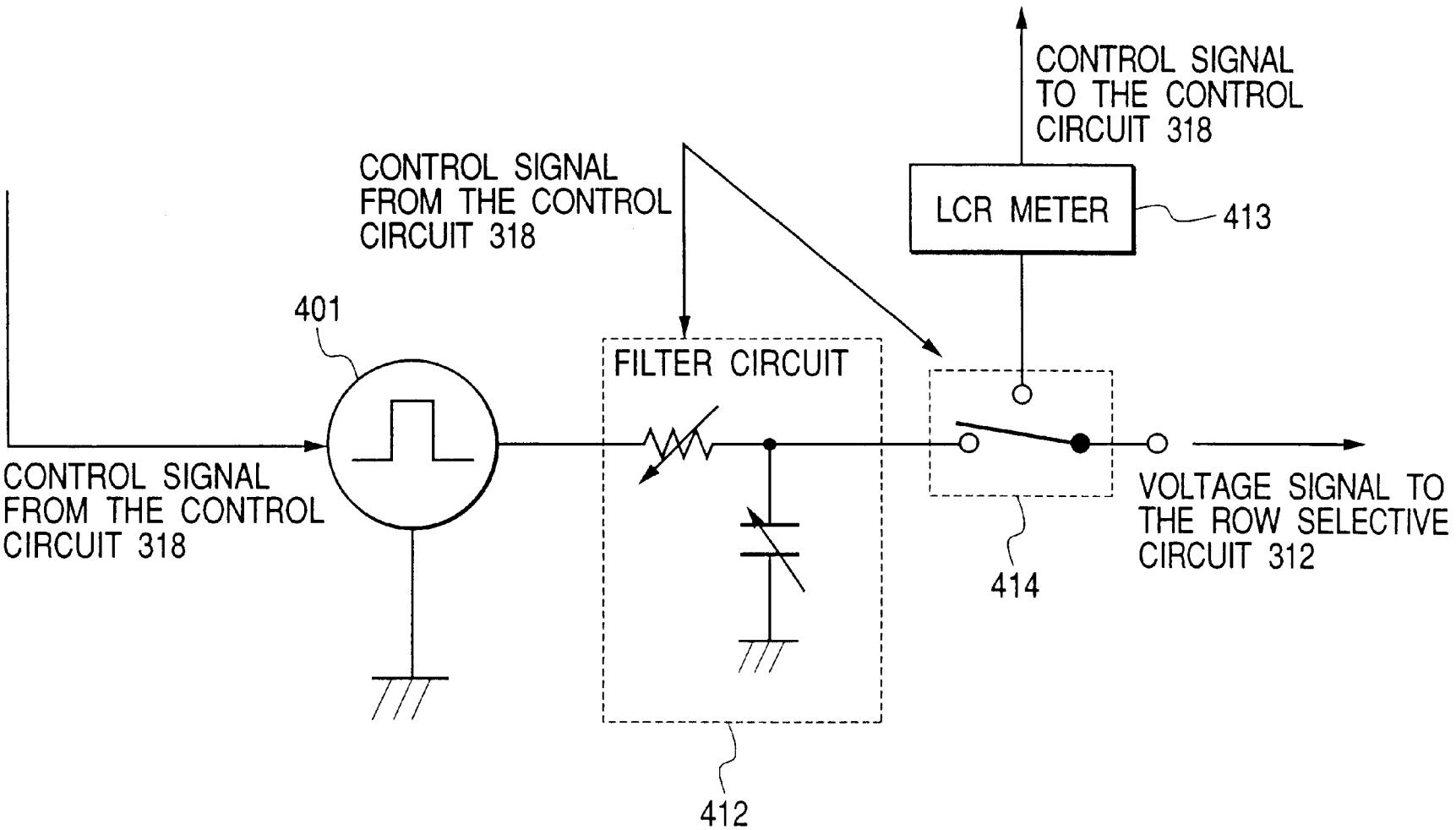
FIG. 25 is a block diagram showing the structure of a row side power supply in accordance with Embodiment 3 of the present invention.

The row side power supply 311 is different from its equivalent in Embodiment 6 in that it has an impedance measurement system and a filter circuit that can control cut-off frequency in accordance with the measured impedance. Reference is made to FIG. 25 for explanation.

The circuit in the drawing comprises a power supply 401 for generating pulse, a low-pass filter 412 for cutting off the high frequency component of the output pulse, an LCR meter 413 for measuring the impedance of the electron source substrate, and a switch 414 for switching between an LCR measurement system and an energization system. The pulse generates a pulse waveform in response to a signal from the control circuit 318. The switch 414 is switched in response to a signal from the control circuit 318.

The LCR meter sends the measured impedance data to the control circuit and changes the values of R, C constituting the filter circuit based on this signal.

Given next is a description on a method of setting values for R, C of the low-pass filter.

Similar to Embodiment 6, gain function |V out/V in| is obtained on the basis of the values of resistance R, capacitance C and impedance L which are measured by the LCR meter, calculating a frequency band with which gain Ap is equal to or less than 1.01 (the excess voltage threshold value is equal to or less than 100 [mV]). The values for R, C are set so that the obtained maximum frequency ωs coincides with cut-off frequency ωl of the low-pass filter.

Conducting the energization forming with voltage application based on the above conditions results in completion of the process without applying abnormal voltage to the electroconductive thin film.

Subsequently, a description is given on a procedure for carrying out energization forming of the electron source using the apparatus of this embodiment.

In this embodiment, a process of conducting the energization for every row wire (or column wire) (line forming process) is employed as a method of performing the energization forming on a multitude of devices.

The following is a description of the line forming process performed on the devices in the second row. In this case, the energization forming process is ended when the device current in each row reaches 10 [mA].

The difference from Embodiment 6 is the measurement at the LCR meter and RC variable sequence.

Application of voltage is started in the same manner as in Embodiment 6 to sequentially measure the impedance and change R and C of the filter circuit on the basis of the measured value.

Conducting the energization forming with voltage application as described above results in completion of the process without applying abnormal voltage to the electroconductive thin film.

The energization forming of this embodiment is similarly performed on other rows, obtaining electron-emitting characteristic uniform all over the surface.

Figure 58:
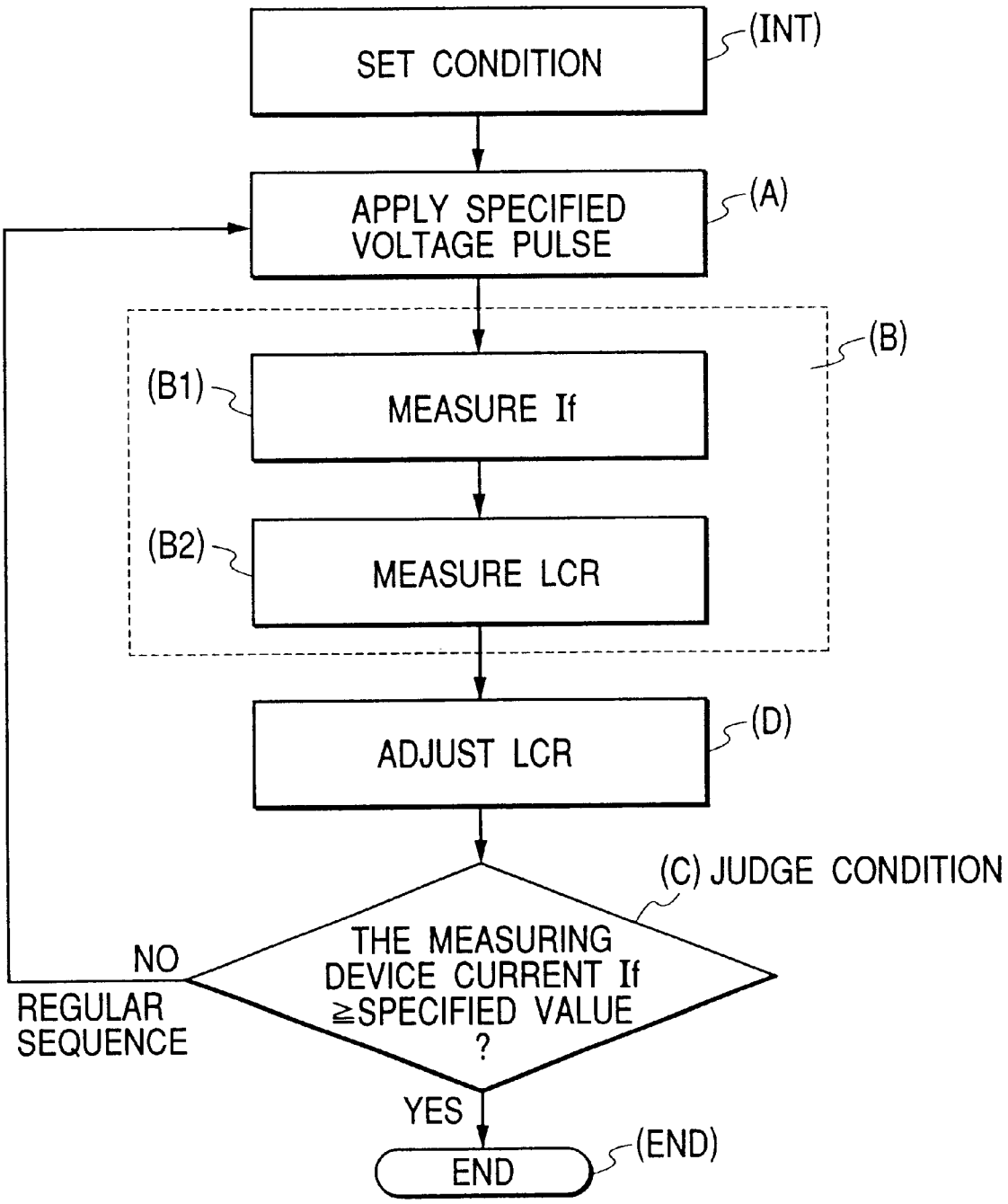
FIG. 58 is an exemplified flow chart showing another process in accordance with the present invention.

Next, operation of the controller 104 in the energization forming of this embodiment is described with reference to the flow chart of FIG. 58.

Conditions required for the energization forming are set in STEP (INT).

The electron source substrate is brought into a highly vacuumed state and the device on which the energization forming is to be performed is chosen by controlling the row selective circuit and the column selective circuit. The initial voltage application conditions are set.

STEP (A) is regular sequence for applying voltage.

The voltage pulse to be used for energization is outputted at set voltage Vf, period Tw and pulse width Tp.

STEP (B1) is measurement sequence of the device current and the emission current.

In this embodiment, the device current is measured using the pulse voltage that is used in the activation process. The device current If is measured with the use of this pulse voltage. Here, only the device current If is measured and measurement of the emission current Ie is not carried out.

STEP (B2) is LCR measurement sequence with the LCR meter.

The application of voltage is stopped and the circuit is switched to the LCR measurement system to measure the impedance. In this embodiment, the impedance measurement is conducted at any time.

STEP (C) is judgement sequence for continuation of the forming process.

Judgement is made whether or not the value of the device current If measured in STEP (B1) is smaller than the preset value 10 [mA]. When the If has smaller value than 10 [mA], the process proceeds to completion sequence (STEP (END)). On the other hand, the If value larger than 10 [mA] brings the process to LCR variable sequence (STEP (D)).

STEP (D) is the LCR variable sequence of the filter circuit.

R and C of the filter circuit are set in accordance with the value of LCR measured in STEP (B2). How to evaluate R and C follows the description above.

STEP (END) is completion sequence.

Application of voltage from the row side is stopped to end the energization forming process.

The description above is about the row wires, but the process may be conducted for every column wire.

According to the method used herein, the voltage pulse Vf used in the regular sequence serves also as the measurement pulse to constantly detect the device current and the emission current.

The device current If is constantly detected here, but the regular sequence may be stopped to put in sequence for measurement.

Employment of this method makes it possible to suppress occurrence of abnormal voltage, as compared to conventional forming methods, thereby obtaining an electron source with more unified device current.

Embodiment 9

In this embodiment, the frequency band of the applied pulse is restricted by the same method as in Embodiment 6. However, this embodiment is different from the preceding embodiments in that this method is used in the energizing activation.

As to the impedance fluctuation when surface conduction electron-emitting devices arranged into a simple matrix wiring are energized in the energizing activation process, resistance component is greatly reduced, which differs from Embodiment 6.

In the energizing activation process to be described below, the surface conduction electron-emitting devices are energized for every row wire, and application of voltage is ended when the device current reaches a prescript value. The frequency band of energization pulse is calculated on the basis of a previously measured resistance value in energizing activation, and a low-pass filter circuit is used to restrict the frequency band. The allowable range for the applied voltage is set such that the voltage error is contained within 160 [mV] with respect to the peak value of 16 [V] for the applied voltage pulse. In other words, the excess voltage threshold value is set to 160 [mV].

Employment of this method makes it possible to suppress occurrence of abnormal voltage, as compared to conventional energization methods, thereby obtaining an electron source with unified device current characteristic.

Now, a description of this embodiment is given.

The structure of an energization apparatus to be used in this embodiment is the same as that of the apparatus in Embodiment 6.

Subsequently, a description is given on a procedure of performing energizing activation on the electron source with the use of the apparatus of this embodiment.

In this embodiment, a process of conducting the energization for every row wire (or column wire) (hereinafter, abbreviated as line activation process) is employed as a method of performing energizing activation on a multitude of devices.

The following is a description of the line activation process performed on the devices in the second row.

In this case, the process is ended when the device current in each row reaches 5 [A].

First, $1\times10^{-5}$ [Torr] of acetone is introduced as activation gas into a vacuum container having the electron source substrate that has undergone the aforementioned forming operation.

Next, in order to perform the activation process on the devices in the second row, switches of the row selective circuit 312 and the column selective circuit 314 are switched over as shown in FIGS. 53A and 53B, and the voltage is then applied from the power supplies 311, 313.

The waveform of the voltage applied at this time is shown in FIG. 21.

FIG. 21 shows the voltage applied from the row side.

The waveform of the voltage applied from the row side has a pulse width (Tw) of 1 [msec] and a pulse period of 10 [msec] (Tp). The pulse rise time Tu is set to about 0 [nsec], and the pulse fall time Td is set to about Td 0 [nsec]. Vf0 is set to 16 [V] so that the voltage applied to the devices is 16 [V].

A description is next given on the design value of the low-pass filter.

The impedance fluctuation during the energization forming in an electron source substrate 310 (a matrix wiring including the surface conduction electron-emitting device) and an energization apparatus 300 which are used in this embodiment is measured in advance using another electron source substrate. As a result, only the resistance component fluctuates while the inductance (L) component and the capacitance (C) component are constant. The inductance component L is 0.1 [AH], the capacitance component is 0.04 [nF], and the resistance component fluctuates from 30 [MΩ] to 4 [Ω] (FIG. 37 shows the resistance change during the energizing activation).

The low-pass filter is designed using those values.

Those values are put into the equation (1) to obtain gain function |V out/V in|, calculating a frequency band with which gain Ap is equal to or less than 1.01 (the excess voltage threshold value is equal to or less than 160 [mV]). The result of the calculation tells that the frequency in a band of $8\times10^6$ Hz or less does not cause abnormal voltage (voltage that does not exceed the gain allowable error).

To cut off the frequency over $8\times10^6$ Hz, R and C of the low-pass filter in the circuit diagram 3 are set to 2 [mΩ] and 11 [μF], respectively.

The filter circuit of the row wires power supply is formed using those values.

Conducting the energizing activation with voltage application based on the above conditions results in completion of the process without applying abnormal voltage to the electroconductive thin film.

The energizing activation of this embodiment is similarly performed on other rows, obtaining electron-emitting characteristic uniform all over the surface.

Next, operation of the controller 104 in energizing activation in accordance with this embodiment is described with reference to the flow chart of FIG. 54.

Conditions required for the energizing activation are set in STEP (INT).

Activation gas is introduced and the device on which energizing activation is to be performed is chosen by controlling the row selective circuit and the column selective circuit. The initial voltage application conditions are set and so do R and C for use in the filter circuit.

STEP (A) is regular sequence for applying voltage.

The voltage pulse to be used for energization is outputted at set voltage Vf, period Tw and pulse width Tp.

STEP (B) is measurement sequence of the device current and the emission current.

In this embodiment, the device current is measured using the pulse voltage that is used in the activation process. The device current If is measured with the use of this pulse voltage. Here, only the device current If is measured and measurement of the emission current Ie is not carried out.

STEP (C) is judgement sequence for continuation of the activation process.

Judgement is made whether or not the value of the device current If measured in STEP (B) is larger than the preset value 4 [A]. When the If has larger value than 4 [A], the process proceeds to completion sequence (STEP (END)). On the other hand, the If value smaller than 4 [A] brings the process to LCR adjustment sequence (STEP (D)).

STEP (END) is completion sequence.

Application of voltage from both the row side and the column side is stopped to end the energizing activation process.

Employment of this method makes it possible to suppress occurrence of abnormal voltage, as compared to conventional energizing activation methods, thereby obtaining an electron source with more unified device current.

As described above, it can be understood that the same method as in the energization forming process is effective also in the energizing activation process.

Needless to say, the methods as in Embodiments 7, 8 are also effectively used for the energizing activation process.

A similar effect can be obtained in the energization process where the resistance of the surface conduction electron-emitting device fluctuates, such as the preliminary driving process and the panel degassing process. In this embodiment, the inductance component L and the capacitance component C hardly change in the preliminary driving process and the panel degassing process. The main cause of the impedance fluctuation is the resistance component, and the resistance changes in each process "from 3 [Ω] to 3.3 [Ω]", "from 3.3 [Ω] to 3.3[Ω]."

By designing a high frequency filter using those values, the effect can be obtained also in the preliminary driving process and the aging operation process.

Embodiment 10

This embodiment is an example of a method of manufacturing an image display device having a substrate on which a multitude of electroconductive thin films are arranged in simple matrix (the number of devices: 1024×3072), showing mainly an energization forming process of an electron source.

In the energization forming process described below, the energization forming is performed on the electroconductive thin films for every row wire and the application of voltage is ended when the device current reaches a prescript value. The ringing restriction parameters are calculated on the basis of a previously measured resistance value in the energization forming. The allowable range for the applied voltage is set such that the voltage error is contained within 2 V with respect to the peak value of 10 V for the applied voltage pulse. In other words, the rise voltage error threshold value and the fall voltage error threshold value are each set to 12 V, and the excess voltage threshold value is set to −2 V.

Employment of this method makes it possible to suppress occurrence of abnormal voltage, as compared to conventional energization methods, thereby obtaining an electron source with unified device current characteristic.

First, the structure of an energization apparatus to be used in this embodiment is described.

A specific description of this embodiment is given below with reference to FIG. 52, FIGS. 53A and 53B, FIGS. 29A to 29C, and FIG. 56.

FIG. 52 is a block diagram showing the structure of an energization forming apparatus in this embodiment. The electron source substrate shown in FIG. 48 is connected as shown in FIG. 52 to conduct the energization forming operation.

Reference numeral 310 denotes an image display device with electroconductive thin films arranged into a simple matrix wiring of m rows×n columns (m=1024, n=3072, in this embodiment). The image display device is connected to a not-shown evacuating apparatus and the inside of the device is evacuated to about $10^{-4}$ to $10^{-5}$ [Torr]. On the electron source substrate, row-directional wires Dx1 to Dxm are connected to Sx1 to Sxm of an energization operation apparatus 300, and column-directional wires Dy1 to Dyn are connected to Sy1 to Syn of the energization operation apparatus 300.

Further, an anode electrode Hv is connected to Sz of the energization operation apparatus 300. However, voltage is not applied to the anode electrode Hv in this embodiment.

Reference numeral 311 denotes a power supply on the row wire side, for generating the voltage pulse. Denoted by 312 is a row wire selective region for selecting an arbitrary row. The row wire selective region has a measurement system for applying the voltage pulse generated in the power supply to an arbitrary row and for measuring current. Reference numeral 313 denotes a power supply on the column wire side, for generating the voltage pulse. Denoted by 314 is a column wire selective region for applying the voltage pulse generated in the power supply to an arbitrary column. Reference numeral 315 denotes an anode power supply for supplying voltage to an anode electrode 307, and 316 denotes a current detecting region for measuring emission current led out by the anode electrode. As voltage is not applied to the anode electrode 307 in this embodiment, the measurement of emission current is not carried out.

A control circuit 3123 controls the power supplies 311, 313, the row wire selective region 312 and the column wire selective region 314 on the basis of a device current value 321 detected at the row selective circuit 312.

Next, the selective circuits are described with reference to FIGS. 53A and 53B.

FIGS. 53A and 53B illustrate the row selective circuit 312 and the column selective circuit 314, respectively.

These selective circuits are comprised of switches such as a relay and an analogue switch. In the row selective circuit 312, m pieces of switches Swx1 to Swxm are arranged in parallel and the output of each switch is connected to each of row directional wire terminals Dx1 to Dxm of the electron source substrate through wires Sx1 to Sxm. An ammeter is also connected.

The column selective circuit has the structure similar to that of the row selective circuit.

In FIG. 53A, all the row selective switches except for the one in the second row are grounded, indicating that the second row is selected.

Subsequently, a description is given on a procedure for carrying out the energization forming of the electron source using the apparatus of this embodiment.

In this embodiment, a process of conducting the energization for every row wire (or column wire) (hereinafter, abbreviated as line forming process) is employed as a method of performing the energization forming on a multitude of devices.

The following is a description of the line forming process performed on the devices in the second row.

In this case, the energization forming process is ended when the device current in each row reaches 10 mA.

First, a vacuum container having the electron source substrate on which the electroconductive thin film is formed is vacuum-sucked to about $1\times10^{-5}$ [Torr].

Next, in order to perform activation process on the devices in the second row, switches of the row selective circuit 312 and the column selective circuit 314 are switched over as shown in FIGS. 53A and 53B, and the voltage is then applied from the power supplies 311, 313 of FIG. 52.

The waveform of the voltage applied at this time is shown in FIGS. 29A to 29C.

FIGS. 29A to 29C show the applied voltage. FIG. 29B shows voltage Vin_x applied from the row side, and FIG. 29C shows voltage Vin_y applied from the column side. FIG. 29A shows voltage (Vin_x−Vin_y) applied to the electron source.

The waveform of the applied voltage has a pulse width Tw of 1 msec and a pulse period Tp of 10 msec. The row directional voltage Vx0 is set to 5 V and the column directional voltage Vy0 is set to −5 V so that the voltage (Vin_x−Vin_y) applied to the electron source is 10 V. The rise delay time on the row side is designed to have a value Δt_up1, and the fall delay time on the column side, Δt_down1.

The output voltage of the high-voltage power supply 315 is set to 0 [V], for the emission current is not measured.

A description is next given on design of the row side applied voltage Vin_x, the column side applied voltage Vin_y, the rise delay time Δt_up and the fall delay time Δt_down.

The impedance fluctuation during the process in an electron source substrate 310 equivalent to the electron source substrate 310 (a matrix wiring including the surface conduction electron-emitting device) that is used in this embodiment is measured in advance using the energization apparatus 300. As a result, only the resistance component fluctuates while the inductance (L) component and the capacitance (C) component are constant.

At this time, the inductance component L is 0.1 uH, the capacitance component is 0.04 nF, and the resistance component fluctuates from 3 Ω to 30 MΩ. The resistance change during the energization forming is shown in FIG. 37.

The row side applied voltage Vin_x, the column side applied voltage Vin_y, the rise delay time Δt_up and the fall delay time Δt_down are designed using those values.

For evaluation, the inductance, the capacitance component and the fluctuation in resistance component are put into the equations (13), (15), and the rise voltage error threshold value voltage V_up_th is set to 12 V and the fall voltage error threshold value voltage V_down_th is set to 2 V. As a result of the evaluation, the applied voltage Vin_x, Vin_y are each set to 5 V, and the rise delay time Δt_up1 and the fall delay time Δt_down1 are each set to 3.1 nsec.

Conducting the energization forming with voltage application based on the above conditions results in completion of the process without applying abnormal voltage to the electroconductive thin film.

The energization forming of this embodiment is similarly performed on other rows to form the electron source, obtaining electron-emitting characteristic uniform all over the surface.

Next, operation of a controller 104 in the energization forming of this embodiment is described with reference to the flow chart of FIG. 22.

Conditions required for the energization forming are set in STEP (INT).

First, the electron source substrate is brought into a highly vacuumed state. A device on which the energization forming process is to be performed is chosen by controlling the row selective circuit and the column selective circuit. The applied voltage values Vin_x, Vin_y, the rise delay time Δt_up and the fall delay time Δt_down are set.

STEP (A) is regular sequence for applying voltage.

The voltage pulse to be used for energization is outputted at set voltage Vf, period Tw and pulse width Tp.

STEP (B) is measurement sequence of the device current and the emission current.

In this embodiment, the device current is measured using the pulse voltage that is used in the forming process. The device current If is measured with the use of this pulse voltage. Here, only the device current If is measured and measurement of the emission current Ie is not carried out.

STEP (C) is judgement sequence for continuation of the forming process.

Judgement is made whether or not the value of the device current If measured in STEP (B) is smaller than the preset value 10 mA. When the If has smaller value than 10 mA, the process proceeds to completion sequence (STEP (END)). On the other hand, the If value larger than 10 mA brings the process to application voltage changing sequence (STEP (D)).

STEP (END) is completion sequence.

Application of voltage from both the row side and the column side is stopped to end the energization forming process.

Though shown in this embodiment is the case where the energization forming process is conducted for every row, the process may be carried out in column unit.

According to the method used herein, the voltage pulse Vf used in the regular sequence serves also as the measurement pulse to constantly detect the device current.

The device current If is constantly measured here, but the regular sequence may he stopped to put in sequence for measurement.

Employment of this method makes it possible to suppress occurrence of excess voltage, as compared to conventional forming methods, thereby obtaining an electron source with more unified device current.

This embodiment shows the case where the energization forming process is conducted row by row. However, the method of applying voltage pulse shown in this embodiment is effective also when the energization forming process is performed by applying voltage to devices in a plurality of rows at once as shown in FIG. 56. The conditions for setting the voltage pulse are similar to the conditions mentioned above.

Here, how to actually apply voltage to a plurality of rows at once is described.

As shown in FIG. 56, in order to apply voltage to the second and the third rows, the Sx2 and Sx3 of the row selective circuit 312 have to be switched over so that the power supply and the electron source are connected to each other. When carrying out the energization forming operation explained above after setting the selective circuit, occurrence of excess voltage can be suppressed, as compared to conventional forming methods, thereby obtaining an electron source with more unified device current.

Embodiment 11

This embodiment employs a method different from the one in Embodiment 10 in setting the ringing control parameters.

The setting of the winging control parameters is achieved such that the impedance fluctuation during the process is measured in real time, and the voltage pulse conditions (the applied voltage Vin_x, Vin_y and the rise/fall delay time Δt_up, Δt_down) are adjusted in real time in accordance with the measured impedance value so that the abnormal voltage has the minimum value.

The description here is made on the part different from Embodiment 10.

First, the structure of an energization forming apparatus used in this embodiment is described The structure of the energization apparatus in this embodiment is the same as in Embodiment 1. However, "the row side power supply circuit and its operation, and the operation of the column side selective circuit" is different.

A row side power supply 311 is described.

Figure 59:
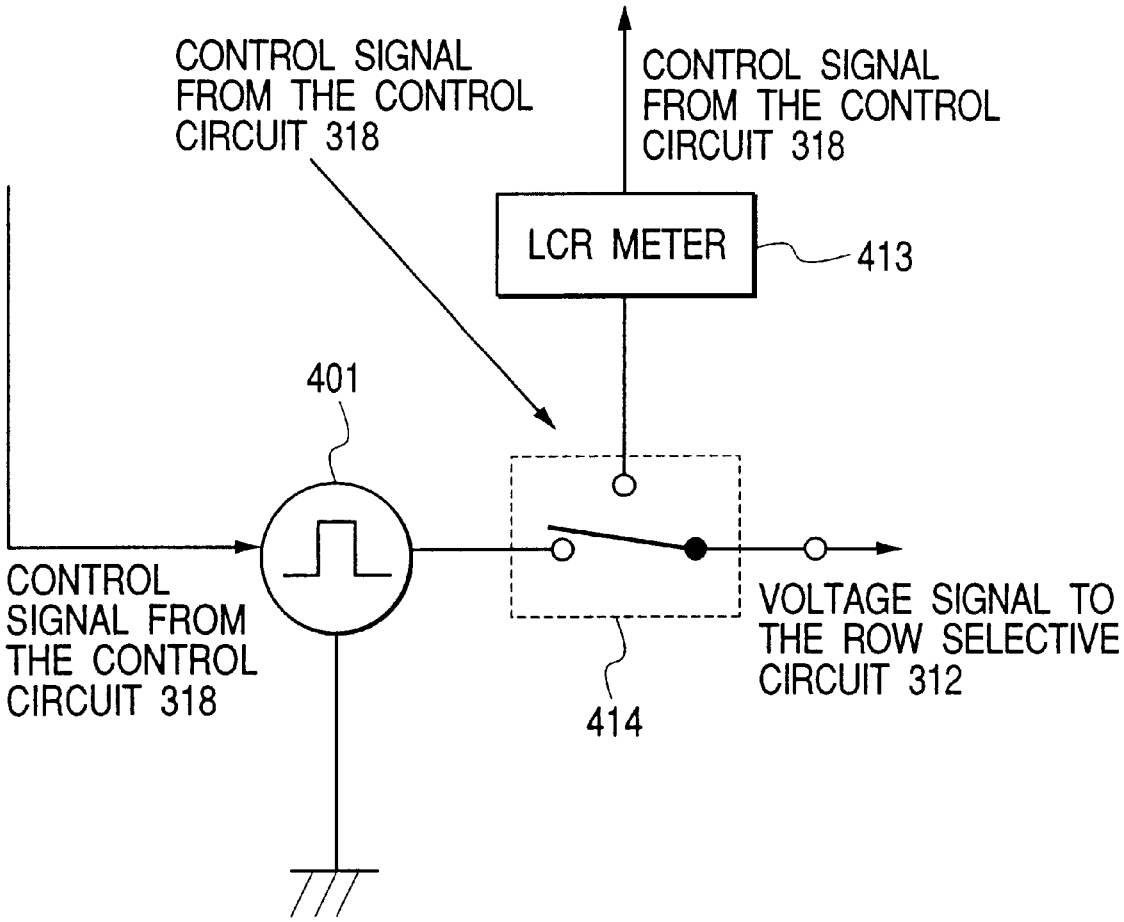
FIG. 59 is a view showing another energization method of the present invention.

The row side power supply 311 is different from its equivalent in Embodiment 10 in that it has an impedance measurement system and a mechanism for adjusting the ringing parameters in accordance with the measured impedance. Reference is made to FIG. 59 for explanation.

The circuit in FIG. 59 comprises a power supply 401 for generating pulse, an LCR meter 413 for measuring the impedance of the electron source substrate, and a switch 414 for switching between an LCR measurement system and an energization system. The pulse generates a pulse waveform in response to a signal from the control circuit 318. The switch 414 is switched in response to a signal from the control circuit 318.

The LCR meter 413 sends the measured impedance data to the control circuit and, based on this signal, changes the voltage values and the pulse rise/fall delay time which are the ringing control parameters.

When the LCR meter is used to measure the impedance, it is required not only to switch over the switch 414 (FIG. 59) to the LCR meter side but also to ground all the switches in the column side selective circuit 314 (FIG. 53B).

Conducting the energization forming with voltage application based on the above conditions results in completion of the process without applying abnormal voltage to the electroconductive thin film.

Subsequently, a description is given on a procedure for carrying out the energization forming of the electron source using the apparatus of this embodiment.

In this embodiment, a process of conducting the energization for every row wire (or column wire) (line forming process) is employed as a method of performing the energization forming on a multitude of devices.

The following is a description of the line forming process performed on the devices in the second row. In this case, the energization forming process is ended when the device current in each row reaches 10 mA. The difference between this embodiment and Embodiment 10 is the measurement with the LCR meter and the setting of the ringing control parameters.

In this embodiment, the row side voltage Vin_x and the column side voltage Vin_y are fixed to 5 V and −5 V, respectively, while the rise/fall delay time Δt_up, Δt_down are variable. The delay time Δt_up, Δt_down are calculated using the equations (13), (15).

Similar to Embodiment 10, application of voltage is started to sequentially measure the impedance with the LCR meter and change the ringing control parameters on the basis of the measured value, conducting the energization forming. As a result, the process can be completed without applying abnormal voltage to the electroconductive thin film.

The energization forming of this embodiment is similarly performed on other rows, obtaining electron-emitting characteristic un form all over the surface.

Figure 60:
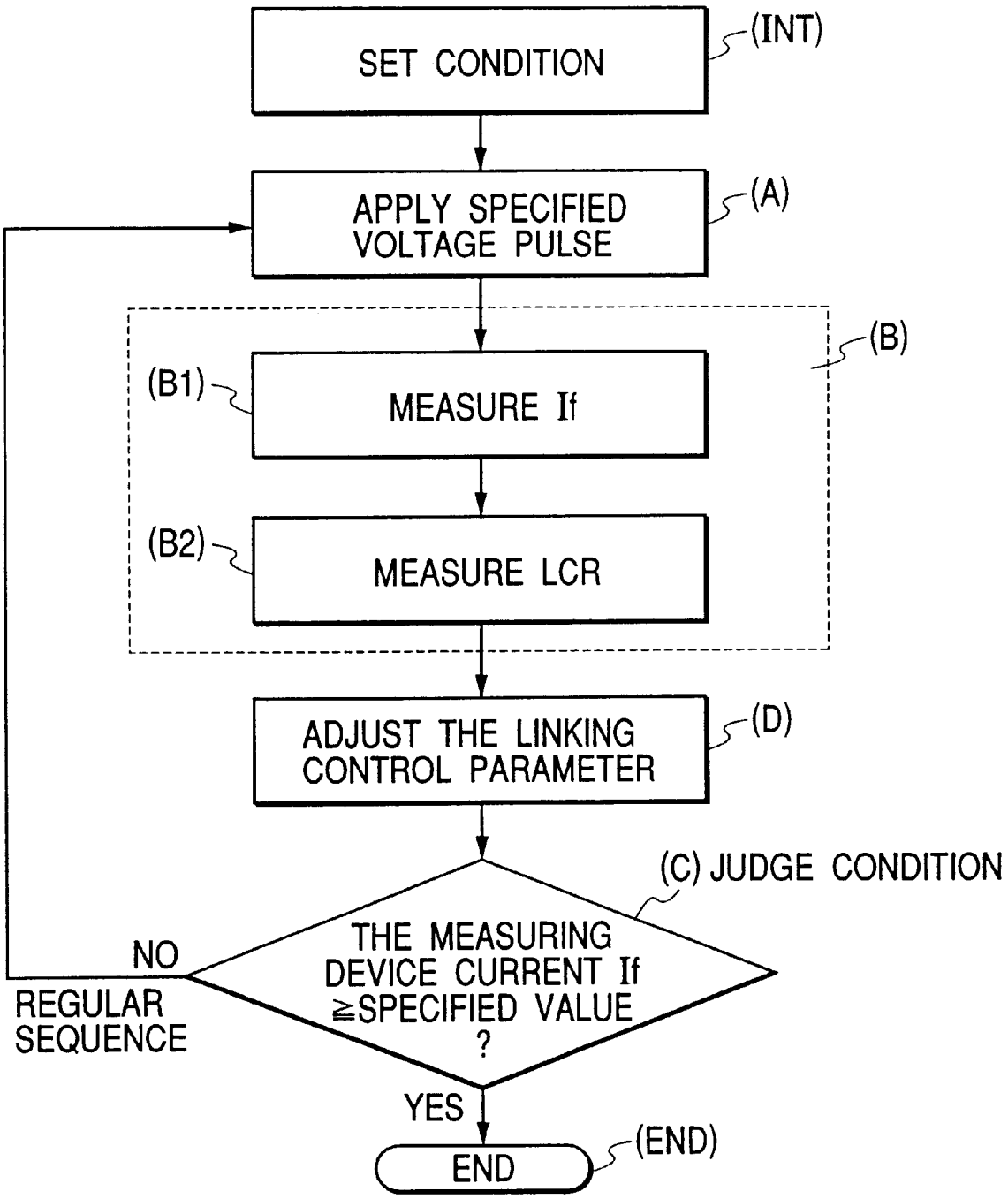
FIG. 60 is an exemplified flow chart showing still another process in accordance with the present invention.

Next, operation of the controller 104 in the energization forming of this embodiment is described with reference to the flow chart of FIG. 60.

Conditions required for the energization forming are set in STEP (INT).

The electron source substrate is brought into a highly vacuumed state and the device on which the energization forming is to be performed is chosen by controlling the row selective circuit and the column selective circuit. The initial voltage application conditions are set.

STEP (A) is regular sequence for applying voltage.

The voltage pulse to be used for energization is outputted at set voltage Vf, period Tw and pulse width Tp.

STEP (B1) is measurement sequence of the device current and the emission current.

In this embodiment, the device current is measured using the pulse voltage that is used in the activation process. The device current If is measured with the use of this pulse voltage. Here, only the device current If is measured and measurement of the emission current Ie is not carried out.

STEP (B2) is LCR measurement sequence with the LCR meter.

The application of voltage is stopped and the circuit is switched to the LCR measurement system to measure the impedance. In this embodiment, the impedance measurement is conducted at any time.

STEP (C) is judgement sequence for continuation of the forming process.

Judgement is made whether or not the value of the device current If measured in STEP (B1) is smaller than the preset value 10 mA. When the If has smaller value than 10 mA, the process proceeds to completion sequence (STEP (END)). On the other hand, the If value larger than 10 mA brings the process to regular sequence for applying voltage (STEP (A)).

STEP (D) is the LCR variable sequence of the filter circuit.

The ringing control parameters are changed in accordance with the value of LCR measured in STEP (B2).

STEP (END) is completion sequence.

Application of voltage from the row side is stopped to end the energization forming process.

The description above is about the row wires, but the process may be conducted for every column wire.

According to the method used herein, the voltage pulse Vf used in the regular sequence serves also as the measurement pulse to constantly detect the device current and the emission current.

The device current If is constantly measured here, but the regular sequence may be stopped to put in sequence for measurement.

Employment of this method makes it possible to suppress occurrence of abnormal voltage, as compared to conventional forming methods, thereby obtaining an electron source with more unified device current.

Embodiment 12

In this embodiment, the ringing control parameters are set by the same method as in Embodiment 10. However, this embodiment is different from the preceding embodiments in that the method is used in the energizing activation process. As to the impedance fluctuation when surface conduction electron-emitting devices arranged into a simple matrix wiring are energized in the energizing activation process, resistance component is greatly reduced, which differs from Embodiment 10.

In the energizing activation process described below, the energizing activation is performed on the surface conduction electron-emitting devices for every row wire and the application of voltage is ended when the device current reaches a prescript value. The ringing control parameters are calculated on the basis of a previously measured resistance value in energizing activation. The allowable range for the applied voltage is set such that the voltage error is contained within 3.2 V with respect to the peak value of 16 V for the applied pulse. In other words, the rise voltage error threshold value and the fall voltage error threshold value are each set to 15.2 V, and the excess voltage threshold value is set to −3.2 V.

Employment of this method makes it possible to suppress occurrence of abnormal voltage, as compared to conventional energization methods, thereby obtaining an electron source with unified device current characteristic.

Now, a description of this embodiment is given.

The structure of an energization apparatus to be used in this embodiment is the same as that of the apparatus in Embodiment 10.

Subsequently, a description is given on a procedure of performing energizing activation on the electron source with the use of the apparatus of this embodiment.

In this embodiment, a process of conducting the energization for every row wire (or column wire) (hereinafter, abbreviated as line activation process) is employed as a method of performing energizing activation on a multitude of devices.

The following is a description of the line activation process performed on the devices in the second row.

In this case, the process is ended when the device current in each row reaches 5 A.

First, $1\times10^{-5}$ Torr of acetone is introduced as activation gas into a vacuum container having the electron source substrate that has undergone the aforementioned forming operation.

Next, in order to perform activation process on the devices in the second row, switches of the row selective circuit 312 and the column selective circuit 314 are switched over as shown in FIGS. 53A and 53B, and the voltage is then applied from the power supplies 311, 313.

The waveform of the voltage applied at this time is shown in FIGS. 29A to 29C.

FIGS. 29A to 29C show the applied voltage. FIG. 29B shows voltage Vin_x applied from the row side, and FIG. 29C shows voltage Vin_y applied from the column side. FIG. 29A shows voltage (Vin_x−Vin_y) applied to the electron source.

The waveform of the applied voltage has a pulse width of 1 msec (Tw) and a pulse period of 10 msec (Tp). The row directional voltage Vx0 is set to 8 V and the column directional voltage Vy0 is set to −8 V so that the voltage (Vin_x−Vin_y) applied to the electron source is 16 V. The rise delay time on the row side is designed to have a value Δt_up1, and the fall delay time on the column side, Δt_down1.

The output voltage of the high-voltage power supply 315 is set to 0 [V], for the emission current is not measured.

A description is next given on design of the row side applied voltage Vin_x, the column side applied voltage Vin_y, the rise delay time Δt_up and the fall delay time Δt_down.

The impedance fluctuation during the process in an electron source substrate 310 equivalent to the electron source substrate 310 (a matrix wiring including the surface conduction electron-emitting device) that is used in this embodiment is measured in advance using the energization apparatus 300. As a result, only the resistance component fluctuates while the inductance (L) component and the capacitance (C) component are constant.

At this time, the inductance component L is 0.1 $\mu$H, the capacitance component is 0.04 nF, and the resistance component fluctuates from 4 Ω to 30 MΩ. The resistance change during the energization forming is shown in FIG. 37.

The row side applied voltage Vin_x, the column side applied voltage Vin_y, the rise delay time Δt_up and the fall delay time Δt_down are designed using those values.

For evaluation, the inductance, the capacitance component and the fluctuation in resistance component are put into the equations (13), (15), and the rise voltage error threshold value voltage V_up_th is set to 19.2 V and the fall voltage error threshold value voltage V_down_th is set to 3.2 V. As a result of the evaluation, the applied voltage Vin_x, Vin_y are each set to 5 V, and the rise delay time Δt_up1 and the fall delay time Δt_down1 are each set to 3.1 nsec.

Conducting the energization forming with voltage application based on the above conditions results in completion of the process without applying abnormal voltage to the electroconductive thin film.

The energizing activation of this embodiment is similarly performed on other rows, obtaining electron-emitting characteristic uniform all over the surface.

Next, operation of the controller 104 in the energizing activation of this embodiment is described with reference to the flow chart of FIG. 22.

Conditions required for the energizing activation are set in STEP (INT)

Activation gas is introduced and the device on which the energizing activation process is to be performed is chosen by controlling the row selective circuit and the column selective circuit. The initial voltage application conditions are set.

STEP (A) is regular sequence for applying voltage.

The voltage pulse to be used for energization is outputted at set voltage Vf, period Tw and pulse width Tp.

STEP (B) is measurement sequence of the device current and the emission current.

In this embodiment, the device current is measured using the pulse voltage that is used in the forming process. The device current If is measured with the use of this pulse voltage. Here, only the device current If is measured and measurement of the emission current Ie is not carried out.

STEP (C) is judgement sequence for continuation of the activation process.

Judgement is made whether or not the value of the device current If measured in STEP (B) is larger than the preset value 4 mA. When the If has larger value than 4 mA, the process proceeds to completion sequence (STEP (END)). On the other hand, the If value smaller than 4 mA brings the process to application voltage changing sequence (STEP (D)).

STEP (END) is completion sequence.

Application of voltage from both the row side and the column side is stopped to end the energizing activation process.

Employment of this method makes it possible to suppress occurrence of abnormal voltage, as compared to conventional energizing activation methods, thereby obtaining an electron source with more unified device current.

As described above, it can be understood that the same method as in the energization forming process is effective also in the energizing activation process.

Needless to say, the methods as in Embodiments 11, 12 are also effectively used for the energizing activation process.

A similar effect can be obtained in the energization process where the resistance of the surface conduction electron-emitting device fluctuates, such as the preliminary driving process and the panel degassing process. In this embodiment, the inductance component L and the capacitance component C hardly change in the preliminary driving process and the panel degassing process. The main cause of the impedance fluctuation is the resistance component, and the resistance changes in each process "from 3 Ω to 3.3 Ω", "from 3.3 Ω to 3.6 Ω."

By designing the ringing control parameters using those values, the effect can be obtained also in the preliminary driving process and the aging operation process.

Embodiment 13

In this embodiment, the energization forming is conducted in a way similar to Embodiment 11. However, the ringing control parameters are differently set.

The description here is made on the part different from Embodiment 10.

In this embodiment, the row side voltage Vin_x, the column side voltage Vin_y, and the rise/fall delay time Δt_up, Δt_down are all variable. The voltage Vin_x and Vin_y are calculated using the equations (13), (15).

Specific setting of the voltage is as follows.

As the ringing does not takes place at a resistance of 3 Ω, the applied voltage Vin_x and Vin_y may take arbitrary values. Here, Vin_x and Vi_y are set to 10 V and 0 V, respectively.

At a resistance of 40 Ω, the ringing control parameters are set such that the applied voltage Vin_x and Vin_y are 9 V and 1 V, respectively, and the rise/fall delay time Δt_up, Δt_down are both 10 nsec. (A method of applying Vin_y after the ringing waveform is sufficiently attenuated)

At a resistance of 30 Ω, the ringing control parameters are set such that the applied voltage Vin_x and Vin_y are both 5 V and the rise/fall delay time Δt_up, Δt_down are both 3.1 nsec.

Employment of this method makes it possible to suppress occurrence of abnormal voltage, as compared to conventional energization methods, thereby obtaining an electron source with unified device current characteristic.

The specific embodiments explained above are not intended to limit thereto the present invention and, needless to say, the invention may include variations where the components are substituted or the design is modified to the extent that the objects of the present invention are attained.

Figure 61:
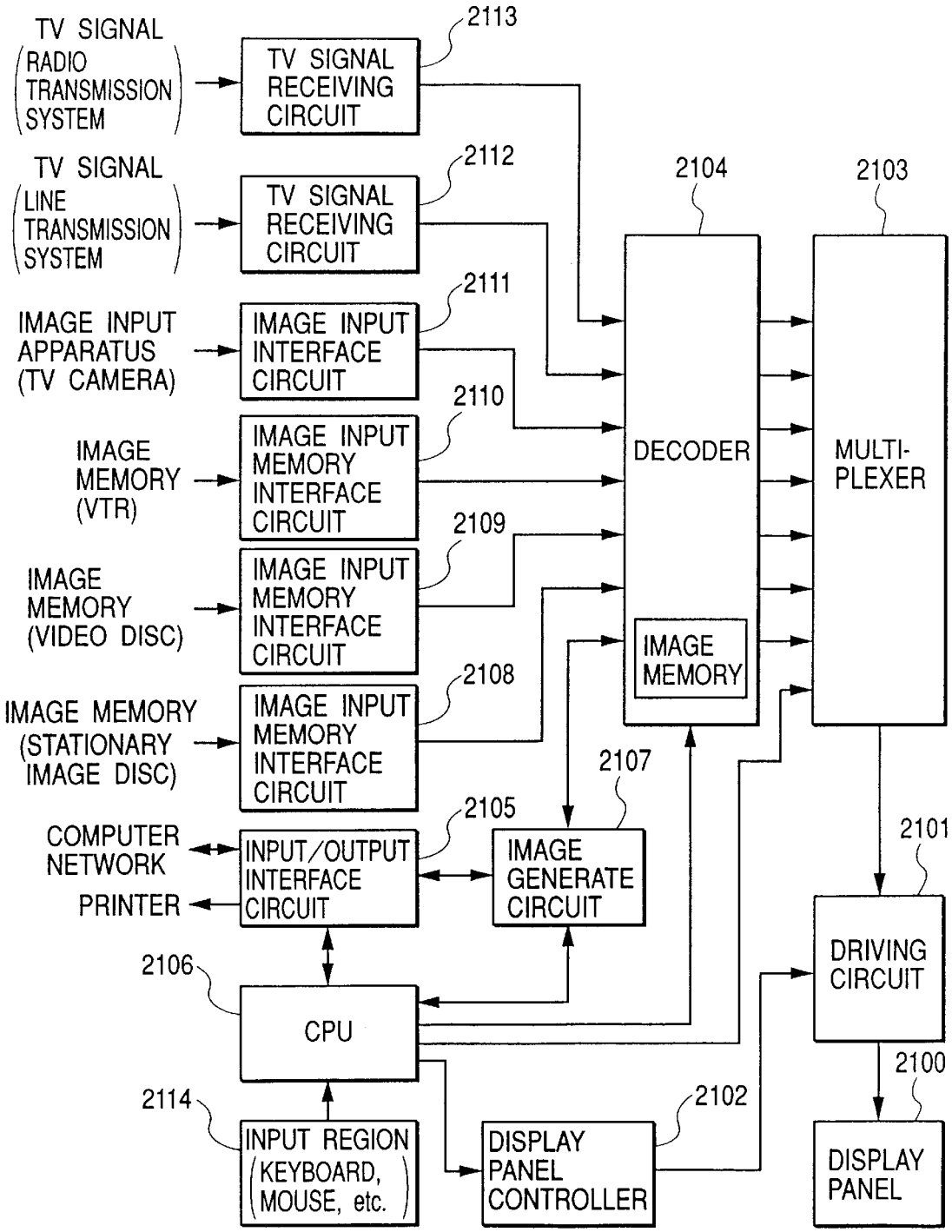
FIG. 61 is a block diagram showing a driving circuit in an image-forming apparatus.

FIG. 61 is a diagram showing an example of a display device. The display device is constructed such that image information provided by various kinds of image information sources, e.g., television broadcasting, is displayed on a display panel that uses as an electron source the surface conduction type electron-emitting device described above.

In the drawing, reference numeral 2100 denotes a display panel; 2101, a driving circuit of the display panel; 2102, a display panel controller; 2103, a multiplexer; 2104, a decoder; 2105, an input/output interface circuit; 2106, a CPU; 2107, an image generate circuit; 2108, 2109, 2110, image input memory interface circuits; 2111, an image input interface circuit; 2112, 2113, TV signal receiving circuits; and 2114, an input region.

This display device naturally reproduces sound as well as it displays an image when receiving a signal, such as a television signal, that contains both of image information and sound information. However, explanation is omitted as to a circuit or a speaker pertaining to reception, separation, reproduction, processing and storing of sound information, which is not related to the characteristic of the present invention directly.

The function of the respective parts is described below, following the path an image signal takes in the device.

First, the TV signal receiving circuit 2113 receives a TV image signal transmitted by a wireless transmission system such as radio wave and spatial optical communication. The system of receivable TV signal is not particularly limited and signals of various systems such as NTSC system, PAL system and SECAM system may be received. A TV signal with even more scanning lines than those signals have (so-called 'high quality TV signal' exemplified by an MUSE system signal) is a signal source suitable to make the most of the above display panel that is appropriate to have a large area and a large number of pixels. The TV signal received at the TV signal receiving circuit 2113 is outputted to the decoder 2104.

The TV signal receiving circuit 2112 is a circuit for receiving a TV image signal transmitted via a wire transmission system such as coaxial cable or optical fiber communication. Similar to -the aforementioned TV signal receiving circuit 2113, the system of the TV signal receivable by the circuit 2112 is not particularly limited, and the TV signal received by this circuit is also outputted to the decoder 2104.

The image input interface circuit 2111 takes in an image signal provided by a TV camera or an image input device such as an image reading scanner. The entered image signal is outputted to the decoder 2104.

The image input memory interface circuit 2109 takes in an image signal stored in a video disk and the entered image signal is outputted to the decoder 2104.

The image input memory interface circuit 2110 takes in an image signal stored in a video tape recorder (hereinafter abbreviated as VTR) and the entered image signal is outputted to the decoder 2104.

The image input memory interface circuit 2108 is a circuit for taking in an image signal from a device storing still image data, as in a so-called 'still image disk.' The still image data that is entered is outputted to the decoder 2104.

The input/output interface circuit 2105 is a circuit for connecting the display device to an external computer or computer network, or to an output device such as a printer. The circuit is capable of inputting/outputting, not to mention image data and letter/picture information, a control signal and numerical data from/to the CPU 2106 included in this display device and the external, depending on circumstances.

The image generate circuit 2107 generates image data for display on the basis of image data and letter/picture information inputted from the external through the input/output interface circuit 2105, or of image data and letter/picture information outputted from the CPU 2106. Circuits necessary for generating an image, such as an erasable memory for storing therein image data and letter/picture information, a ROM that stores image patterns corresponding character code, and a processor for image processing are incorporated inside the circuit 2107.

The image data for display generated by this circuit is outputted to the decoder 2104, but it may be outputted to an external computer network or printer through the input/output interface circuit 2105, depending on the situation.

The CPU 2106 handles mainly the operation control of this display panel and jobs related to generation, selection and editing of a display image.

For instance, the CPU outputs a control signal to the multiplexer 2103 to properly select or combine image signals to be displayed on the display panel. At this point, the CPU outputs a control signal to the display panel controller 2102 in accordance with the image signals to be displayed so as to properly control the operation of the display device regarding to the screen display frequency, scanning method (e.g., interlaced scanning or non-interlace scanning), the number of scanning lines for one screen, etc.

It also outputs image data and letter/picture information directly to the image generate circuit 2107, or inputs image data and letter/picture information by accessing an external computer network or a memory through the input/output interface circuit 2105.

The CPU 2106 may of course deal with jobs whose objective is not related to the ones mentioned above. For instance, it may directly take part in generating and processing information as in a personal computer or a word processor.

The CPU, as mentioned above, may be connected to an external computer network through the input/output interface circuit 2105 to cooperate with the external equipment in doing jobs such as arithmetic operation.

The input region 2114 is used by a user to input command, programs or data into the CPU 2106 and various input instrument may be employed for 2114, such as a joystick, a bar code reader, a sound recognition device, etc., in addition to a keyboard and a mouse.

The decoder 2104 inversely converts various kinds of image signal inputted from the image generate circuit 2107 or the TV signal receiving circuit 2113 into primary color signals or into a luminance signal and an I signal and a Q signal. As shown in the drawing by the dotted line, the decoder 2104 desirably has an image memory inside. This is because it handles a TV signal that requires the image memory upon the inverse conversion., the signal exemplified by a MUSE system signal. Besides, installation of the image memory gives advantage of facilitating display of a still image, or facilitating image processing and editing such as image thinning-out, interpolation., enlargement, reduction and composition, in cooperation with the image generate circuit 2107 and the CPU 2106.

The multiplexer 2103 properly selects a display image on the basis of the control signal inputted from the CPU 2106. In other words, the multiplexer 2103 selects a desired image signal out of the inversely converted image signals inputted from the decoder 2104 to output the signal to the driving circuit 2101. In that case, it is also possible to display images different in every section of one screen by switching and selecting the image signals within one screen display time, as in a so-called 'multi-screen television set,' where one screen is divided into a plurality of sections.

The display panel controller 2102 is a circuit for controlling the operation of the driving circuit 2101 on the basis of the control signal inputted from the CPU 2106.

First, as what pertains to the basic operation of the display panel, the controller outputs to the driving circuit 2101 a signal for, e.g., controlling operation sequence of a power supply (not shown) for driving the display panel.

As what pertains to the method of driving the display panel, the controller outputs to the driving circuit 2101 a signal for controlling the screen display frequency and the scanning method (e.g., interlaced scanning or non-interlace scanning).

In some cases, the controller outputs to the driving circuit 2101 a control signal relating to adjustment of the image quality such as luminance, contrast, chromatic gradation and sharpness of the display image.

The driving circuit 2101 is a circuit for generating a driving signal applied to the display panel 2100, and operates based on the image signal inputted from the multiplexer circuit 2103 and the control signal inputted from the display panel controller 2102. The function of the respective parts is thus described above. With the structure shown in FIG. 61, this display device can display image information inputted from various image information sources on the display panel 2100.

That is, various kinds of image signals exemplified by signals for television broadcasting are inversely converted by the decoder 2104, then properly selected by the multiplexer 2103 and inputted to the driving circuit 2101. Meanwhile, the display panel controller 2102 generates a control signal for controlling the operation of the driving circuit 2101 in accordance with the image signal to be displayed. The driving circuit 2101 applies a driving signal to the display panel 2100 based on the image signal and the control signal.

In this way, an image is displayed on the display panel 2100. The CPU 2106 collectively controls a series of those operations.

With the participation of the image memory incorporated in the decoder 2104 and of the image generate circuit 2107 and the CPU 2106, this display device can not only display an image selected out of plural image information but also perform image processing and image editing on image information to be displayed. The image processing includes enlargement, reduction, rotation, transfer, edge emphasis, thinning-out, interpolation, color conversion, change of aspect ratio. The image editing includes composition, erasing, connecting, replacement and insertion. Though not mentioned in the description of this embodiment, this device may be provided with circuits dedicated for processing and editing sound information as well as the image processing and the image editing.

Accordingly, the display device by itself may play the role of all the following equipment: a display for television broadcasting, a terminal for television conference, an image editor handling still images and animated images, a terminal for computers, an office terminal exemplified by a word processor, and a video game machine. This device may thus have a wide application range in either industrial or private field.

FIG. 61 merely shows an example of the structure of the display device having as the electron source the surface conduction electron-emitting device and, needless to say, the display device is not limited to the one shown in the drawing. For instance, among the structural components in FIG. 61, circuits relating to unnecessary function in view of the use purpose may be omitted. Conversely, other structural components may be added depending on the use purpose. If, for example, this display device is applied as a video telephone, it is appropriate to add to the existing structural components a television camera, a microphone, a lighting unit, transmission/reception circuit including a modem, etc.

In this display device, particularly the display panel having as the electron source the surface conduction electron-emitting device can be readily thinned, making it possible to reduce the depth of the whole display device. In addition, the display panel having as the electron source the surface conduction electron-emitting device is easy to increase its size, high in luminance and excellent in view angle characteristic. Therefore, this display device can display lively and dynamic images with good visibility.

The specific embodiments explained above are not intended to limit the present invention and, needless to say, the invention may include variations where the components are substituted or the design is modified to the extent that the objects of the present invention are attained.

As described above, the present invention can prevent degradation of device current and emission current in the energization forming process of the electron-emitting device, the electron source in which a plurality of electron-emitting devices are connected by wires, and the image-forming apparatus.

What is claimed is:

1. A method of manufacturing an electron source comprising an electron-emitting device comprising a pair of electroconductive members, and at least one first wire and at least one second wire being connected to said pair of electroconductive members, respectively, said method comprising a step of applying a pulse voltage to said pair of electroconductive members via at least one of said first and second wires, wherein said pulse voltage is a pulse obtained as a result of restricting a specific frequency band included in a signal outputted from a pulse power supply.

2. A method of manufacturing an electron source according to claim 1, wherein said frequency band is varied according to impedance fluctuation of said electron source.

3. A method of manufacturing an electron source according to claim 1, wherein the specific frequency band included in the pulse voltage is restricted to suppress a ringing during a process of energizing the electron source.

4. A method of manufacturing an electron source comprising an electron-emitting device comprising a pair of electroconductive members, and at least one first wire and at least one second wire being connected to said pair of electroconductive members, respectively, said method comprising a step of applying a pulse voltage between said pair of electroconductive members via at least one of said first and second wires so that a voltage experiences at least one of an increase and a decrease in steps, wherein said pulse voltage increases by at least two steps from its absolute minimum voltage Vmin to its absolute maximum voltage Vmax, and wherein the maximum value of a voltage to be effectively applied to said pair of electroconductive members is not larger than $V_{max}+|V_{max}-V_{min}|\times 0.1$.

5. A method of manufacturing an electron source according to claim 4, wherein the maximum value of a voltage to be effectively applied to said pair of electroconductive members is not larger than $V_{max}+|V_{max}-V_{min}|\times 0.05$.

6. A method of manufacturing an electron source according to claim 5, wherein the maximum value of a voltage to be effectively applied to said pair of electroconductive members is not larger than $V_{max}+|V_{max}-V_{min}|\times 0.01$.

7. A method of manufacturing an electron source according to any one of claims 1–2 and 4–6, wherein said voltage applying step is a step to form a gap on an electroconductive film connecting said pair of electroconductive members.

8. A method of manufacturing an electron source according to any one of claims 1–2 and 4–6, wherein said voltage applying step is a step to arrange a carbon film between said pair of electroconductive members.

9. A method of manufacturing an image-forming apparatus including: an electron source comprising an electron-emitting device comprising a pair of electroconductive members, and at least one first wire and at least one second wire being connected to said pair of electroconductive members, respectively; and an imageforming member for forming an image by means of electron emitted from said electron source, wherein said electron source is manufactured by a manufacturing method according to any one of claims 1–2 and 4–6.

10. A method of manufacturing an electron source according to claim 1 or 4, wherein said first and second wires are substantially perpendicular to each other, and an insulating layer is disposed between said first and second wires.

11. A method of manufacturing an electron source according to claim 1 or 4, wherein an electroconductive film is disposed between said pair of electroconductive members.

12. A method of manufacturing an electron source according to claim 1 or 4, wherein a carbon film is disposed between said pair of electroconductive members.

13. An apparatus for manufacturing an electron source comprising an electron-emitting device comprising a pair of electroconductive members, and at least one first wire and at least one second wire being connected to said pair of electroconductive members; respectively, said apparatus comprising:

a pulse voltage source for applying a pulse voltage to said pair of electroconductive members via at least one of said first and second wires; and a pulse voltage control circuit connecting said pulse voltage source and at least one of said first and second wires, wherein said pulse voltage control circuit restricts a specific frequency band included in said pulse voltage.

14. An apparatus according to claim 13, wherein said voltage control circuit makes the frequency band to be restricted vary according to impedance fluctuation of said electron source.

15. An apparatus according to claim 13 or 14, wherein said voltage control circuit includes a low-pass filter circuit.

16. An apparatus according to claim 13 or 14, wherein said voltage control circuit is provided with a capacitance component and a resistance component.

17. A method of manufacturing an electron source according to claim 13, wherein said first and second wires are substantially perpendicular to each other, and an insulating layer is disposed between said first and second wires.

18. A method of manufacturing an electron source according to claim 13, wherein an electroconductive film is disposed between said pair of electroconductive members.

19. A method of manufacturing an electron source according to claim 13, wherein a carbon film is disposed between said pair of electroconductive members.

20. An apparatus for manufacturing an image-forming apparatus including: an electron source comprising an electron-emitting device comprising a pair of electroconductive members, and at least one first wire and at least one second wire being connected to said pair of electroconductive members, respectively; and an image-forming member for forming an image by means of electron emitted from said electron source, said apparatus comprising:

a pulse voltage source for applying a pulse voltage to said pair of electroconductive members via at least one of said first and second wires; and a pulse voltage control circuit connecting said pulse voltage source and the at least one of said first and second wires, wherein said pulse voltage control circuit restricts a specific frequency band included in said pulse voltage.

21. An apparatus according to claim 20, wherein the frequency band to be restricted is varied according to impedance fluctuation of said electron source.

22. An apparatus according to claim 20 or 21, wherein said voltage control circuit includes a low-pass filter circuit.

23. Its An apparatus according to claim 20 or 21, wherein said voltage control circuit is provided with a capacitance component and a resistance component.

24. An apparatus according to claim 20, wherein said first and second wires are substantially perpendicular to each other, and an insulating layer is disposed between said first and second wires.

25. An apparatus according to claim 20, wherein an electroconductive film is disposed between said pair of electroconductive members.

26. An apparatus according to claim 20, wherein a carbon film is disposed between said pair of electroconductive members.

27. A method of manufacturing an electron source comprising an electron-emitting device comprising a pair of electroconductive members, and at least one first wire and at least one second wire being connected to said pair of electroconductive members, respectively, said method comprising the steps of:

applying a pulse voltage to said pair of electroconductive members via at least one of said first and second wires; and controllably restricting a frequency of said pulse voltage to within a predetermined range of frequencies, the predetermined range of frequencies being predetermined based on a predefined relationship between predetermined electrical characteristics of the electron source and a predetermined, maximum gain of the electron source.

28. An apparatus for manufacturing an electron source comprising an electron-emitting device comprising a pair of electroconductive members, and at least one first wire and at least one second wire being connected to said pair of electroconductive members, respectively, said apparatus comprising:

a pulse voltage source for applying a pulse voltage to said pair of electroconductive members via at least one of said first and second wires; and a pulse voltage control circuit connecting said pulse voltage source and the at least one of said first and second wires, wherein said pulse voltage control circuit controllably restricts a frequency of said pulse to within a predetermined range of frequencies, and the predetermined range of frequencies is predetermined based on a predefined relationship between predetermined electrical characteristics of the electron source and a predetermined, maximum gain of the electron source.

29. An apparatus for manufacturing an imageforming apparatus, the image-forming apparatus including an electron source comprising an electron-emitting device comprising a pair of electroconductive members and at least one first wire and at least one second wire being connected to said pair of electroconductive members, respectively, the imageforming apparatus also including an image-forming member for forming an image by means of electrons emitted from said electron source, said apparatus for manufacturing the image-forming apparatus comprising:

a pulse voltage source for applying a pulse voltage to said pair of electroconductive members via at least one of said first and second wires; and a pulse voltage control circuit connecting said pulse voltage source and the at least one of said first and second wires, wherein said pulse voltage control circuit controllably restricts a frequency of said pulse to within a predetermined range of frequencies, and the predetermined range of frequencies is predetermined based on a predefined relationship between predetermined electrical characteristics of the electron source and a predetermined, maximum gain of the electron source.

* * * * *

UNITED STATES PATENT AND TRADEMARK OFFICE

CERTIFICATE OF CORRECTION

PATENT NO. : 6,346,773 B1
DATED : February 12, 2002
INVENTOR(S) : Tsuyoshi Takegami It is certified that error appears in the above-identified patent and that said Letters Patent is hereby corrected as shown below:

Column l,
Line 21, "emission"," should read -- Emission", --;
Line 38, "SnO2" should read -- $SnO_2$ --;
Line 41, "In203/SnO2" should read -- $In_2O_3/SnO_2$ --; and
Line 49, "et al." should read -- et al., --.

Column 2,
Line 45, "imageforming" should read -- image-forming --.

Column 8,
Line 55, "decreases" should read -- decrease --.

Column 9,
Line 62, "O." should read -- $\omega_o$. --.

Column 10,
Line 1, "film," should read -- films, --;
Line 2, "and." should read -- and --; and
Line 63, "EL" should read -- a --.

Column 12,
Line 17, "mono-one" should read -- monotone --.

Column 13,
Line 34, "Coltage" should read -- Voltage --; and
Line 44, "A voltage" should read -- ¶ A voltage --.

Column 14,
Line 28, "(t > 0)." should read -- ($t \geqq 0$). --;
Line 36, "1" should read -- 1% --; and
Line 40, "Setting" should read -- ¶ Setting --.

Column 15,
Line 14, "(qxt-t1))" should read -- (qx(t-t1)) --; and
Line 63, "C" should read -- $\zeta$ --.

UNITED STATES PATENT AND TRADEMARK OFFICE

CERTIFICATE OF CORRECTION

PATENT NO. : 6,346,773 B1
DATED : February 12, 2002
INVENTOR(S) : Tsuyoshi Takegami It is certified that error appears in the above-identified patent and that said Letters Patent is hereby corrected as shown below:

Column 17,
Line 44, "1(t>0)," should read -- 1(t≧0), --.

Column 18,
Line 22, "Setting" should read -- ¶ Settings -- and "an" should be deleted.

Column 20,
Line 4, "Re: A" should read -- ¶ Re: A --.

Column 23,
Line 2, "an" should be deleted; and
Line 15, "ha," should read -- has --.

Column 24,
Line 7, "electrically" should read -- electrical --;
Line 27, "electrically" should read -- electrical --;
Line 62, “lees.” should read -- less. --.

Column 25,
Line 32, "Present" should read -- present --.

Column 26,
Line 27, "CnH2n+2" should read -- $C_nH_{2\ n+2}$ --; and
Line 29, "CnHZn," should read -- $C_nH_{2n}$, --.

Column 27,
Line 24, "an" should be deleted.

Column 29,
Line 47, "(a" should read -- (an --.

Column 30,
Line 18, "been" should be deleted.

Column 34,
Line 12, "313" should read -- 318 -- and, "a" should be deleted.

Column 35,
Line 30, "over" should read -- more --.

UNITED STATES PATENT AND TRADEMARK OFFICE

CERTIFICATE OF CORRECTION

PATENT NO. : 6,346,773 B1
DATED : February 12, 2002
INVENTOR(S) : Tsuyoshi Takegami It is certified that error appears in the above-identified patent and that said Letters Patent is hereby corrected as shown below:

Column 36,
Line 54, "IVIA," should read -- 1$\mu$A, --.

Column 37,
Line 42, "t down" should read -- t_down --;
Line 54, "embodiment:" should read -- embodiment --;
Line 62, "V_down 3," should read -- V down 3, --;
Line 63, "V_down 4," should read -- V down 4, --; and
Line 64, "t-down 1" should read -- t_down 1 --.

Column 39,
Line 2, "genera ed." should read -- generated. --.

Column 43,
Line 53, "volt-age" should read -- voltage --; and
Line 64, ", or" should read -- for --.

Column 46,
Line 39, "[AH]," should read -- [$\mu$H], --; and
Line 40, "[Ω]," should read -- [nF], --.

Column 47,
Line 7, "do" should read -- are --.

Column 48,
Line 8, "of" should read -- off --.

Column 53,
Line 22, "[AH]," should read -- [$\mu$H] ,--.

Column 55,
Line 34, "3123" should read -- 318 --.

Column 58,
Line 11, "described" should read -- described. --.

Column 59,
Line 3, "un form" should read -- uniform --.

UNITED STATES PATENT AND TRADEMARK OFFICE

CERTIFICATE OF CORRECTION

PATENT NO. : 6,346,773 B1
DATED : February 12, 2002
INVENTOR(S) : Tsuyoshi Takegami It is certified that error appears in the above-identified patent and that said Letters Patent is hereby corrected as shown below:

Column 62,
Line 43, "(A method" should read -- ¶ (A method --.

Column 67,
Line 11, "imageforming" should read -- image-forming --.

Column 68,
Line 14, "Its" should be deleted.

Signed and Sealed this

Twenty-second Day of April, 2003

JAMES E. ROGAN
*Director of the United States Patent and Trademark Office*